US009275846B2

(12) United States Patent
Matsumoto et al.

(10) Patent No.: US 9,275,846 B2
(45) Date of Patent: Mar. 1, 2016

(54) LIGHT SOURCE DEVICE AND FILAMENT

(71) Applicant: Stanley Electric Co., Ltd., Tokyo (JP)

(72) Inventors: Takahiro Matsumoto, Tokyo (JP); Takao Saito, Tokyo (JP); Yasuyuki Kawakami, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/362,383

(22) PCT Filed: Nov. 30, 2012

(86) PCT No.: PCT/JP2012/081149
§ 371 (c)(1),
(2) Date: Jun. 2, 2014

(87) PCT Pub. No.: WO2013/081127
PCT Pub. Date: Jun. 6, 2013

(65) Prior Publication Data

US 2014/0333194 A1 Nov. 13, 2014

(30) Foreign Application Priority Data

Dec. 1, 2011 (JP) ..... 2011-263984

(51) Int. Cl.
*H01K 1/20* (2006.01)
*H01K 1/08* (2006.01)
(Continued)

(52) U.S. Cl.
CPC .. *H01K 1/20* (2013.01); *H01K 1/04* (2013.01); *H01K 1/08* (2013.01); *H01K 1/10* (2013.01); *H01K 5/00* (2013.01)

(58) Field of Classification Search
CPC ..... H01K 1/20; H01K 1/04; H01K 1/08; H01K 1/10; H01K 5/00
See application file for complete search history.

(56) References Cited

U.S. PATENT DOCUMENTS 2,114,426 A 4/1938 Laise
4,196,368 A 4/1980 Hauer
(Continued)

FOREIGN PATENT DOCUMENTS

JP 55-72357 A 5/1980
JP 59-58752 A 4/1984
(Continued)

OTHER PUBLICATIONS

International Preliminary Report on Patentability for PCT Patent App. No. PCT/JP2012/081149 (Jun. 12, 2014).
(Continued)

*Primary Examiner* — Anne Hines
(74) *Attorney, Agent, or Firm* — Kenealy Vaidya LLP

(57) ABSTRACT

A light source device comprising a filament showing high electric power-to-visible light conversion efficiency is provided. A light source device comprising a translucent gastight container, a filament disposed in the translucent gastight container, and a lead wire for supplying an electric current to the filament is provided. The filament comprises a substrate formed from a metal material and a visible light reflectance-reducing film coating the substrate for reducing visible light reflectance of the substrate. The reflectance of the substrate for visible lights is thereby made low, and the reflectance of the substrate for infrared lights is thereby made high. Therefore, radiation of infrared lights is suppressed, and visible luminous efficiency can be enhanced.

23 Claims, 76 Drawing Sheets

(51) Int. Cl.

| | |
|---|---|
| ***H01K 1/10*** | (2006.01) |
| ***H01K 1/04*** | (2006.01) |
| ***H01K 5/00*** | (2006.01) |

(56) References Cited

U.S. PATENT DOCUMENTS

| | | | |
|---|---|---|---|
| 2006/0076868 | A1 | 4/2006 | Pullini et al. |
| 2008/0237541 | A1 | 10/2008 | Zalyubovskiy et al. |

FOREIGN PATENT DOCUMENTS

| | | | |
|---|---|---|---|
| JP | 60-253146 | A | 12/1985 |
| JP | 62-10854 | A | 1/1987 |
| JP | 62-501109 | A | 4/1987 |
| JP | 6-2167 | A | 1/1994 |
| JP | 6-5263 | A | 1/1994 |
| JP | 2000-123795 | A | 4/2000 |
| JP | 2001-519079 | A | 10/2001 |
| JP | 2006-156224 | A | 6/2006 |
| JP | 2006-205332 | A | 8/2006 |
| JP | 2006-520074 | A | 8/2006 |
| JP | 2011-124206 | A | 6/2011 |
| JP | 2011-222211 | A | 11/2011 |
| WO | 86/02775 | A1 | 5/1986 |
| WO | 98/43281 | A1 | 10/1998 |
| WO | 2011/057410 | A1 | 5/2011 |

OTHER PUBLICATIONS

Fuminori Kusunoki et al.; "Narrow-Band Thermal Radiation with Low Directivity by Resonant Modes inside Tungsten Microcavities"; Japanese Journal of Applied Physics; vol. 43, No. 8A, 2004; pp. 5253-5258.

International Search Report for PCT/JP2012/081149 dated Mar. 5, 2013.

Extended European search for the related European Patent Application No. 128541091 dated Jun. 22, 2015.

--Ta rough surface--

--Ta mirror surface--

Substrate: Ta (Examples1－1 to 1－11)

| Structure | R (550 nm) | R (1 μm) | Cut-off | Luminous efficiency η |
|---|---|---|---|---|
| MgO(50nm)/Ta | 0.12 | 0.82 | 740 nm | 58.9 lm/W |
| ZrO2(30nm)/Ta | 0.12 | 0.82 | 740 nm | 57.9 lm/W |
| Y2O3(50nm)/Ta | 0.10 | 0.81 | 720 nm | 58.8 lm/W |
| 6HSiC(20nm)/Ta | 0.14 | 0.81 | 750 nm | 56.7 lm/W |
| GaN(20nm)/Ta | 0.18 | 0.82 | 730 nm | 57.2 lm/W |
| 3CSiC(20nm)/Ta | 0.14 | 0.81 | 740nm | 56.7 lm/W |
| HfO2(40nm)/Ta | 0.12 | 0.81 | 750 nm | 58.0 lm/W |
| Lu2O3(40nm)/Ta | 0.11 | 0.81 | 750 nm | 58.4 lm/W |
| Yb2O3(40nm)/Ta | 0.11 | 0.81 | 750 nm | 58.4 lm/W |
| Carbon(20nm)/Ta | 0.11 | 0.81 | 760 nm | 60.7 lm/W |
| Diamond(20nm)/Ta | 0.11 | 0.81 | 760 nm | 60.7 lm/W |

Fig.17

--Os rough surface--

-Os mirror surface--

Substrate: Os (Examples 2—1 to 2—11)

| Structure | R (550 nm) | R (1 μm) | Cut-off | Luminous efficiency η |
|---|---|---|---|---|
| MgO(70nm)/Os | 0.13 | 0.39 | 1050 nm | 22.9 lm/W |
| ZrO2(50nm)/Os | 0.08 | 0.34 | 1050 nm | 22.7 lm/W |
| Y2O3(70nm)/Os | 0.11 | 0.37 | 1050 nm | 22.9 lm/W |
| 6HSiC(40nm)/Os | 0.07 | 0.27 | 1050 nm | 21.5 lm/W |
| GaN(40nm)/Os | 0.11 | 0.35 | 1050 nm | 22.2 lm/W |
| 3CSiC(40nm)/Os | 0.07 | 0.27 | 1050nm | 21.4 lm/W |
| HfO2(60nm)/Os | 0.11 | 0.36 | 1050 nm | 22.6 lm/W |
| Lu2O3(60nm)/Os | 0.09 | 0.36 | 1050 nm | 22.9 lm/W |
| Yb2O3(60nm)/Os | 0.09 | 0.35 | 1050 nm | 22.9 lm/W |
| Carbon(40nm)/Os | 0.04 | 0.26 | 1100 nm | 22.3 lm/W |
| Diamond(40nm)/Os | 0.04 | 0.26 | 1100 nm | 22.3 lm/W |

Fig.32

--Ir rough surface--

-Ir mirror surface--

Substrate: Ir (Examples 3－1 to 3－11)

| Structure | R (550 nm) | R (1 μm) | Cut-off | Luminous efficiency η |
|---|---|---|---|---|
| MgO(70nm)/Ir | 0.37 | 0.69 | 700 nm | 26.1 lm/W |
| ZrO2(50nm)/Ir | 0.23 | 0.67 | 800 nm | 29.1 lm/W |
| Y2O3(60nm)/Ir | 0.37 | 0.70 | 700 nm | 26.3 lm/W |
| 6HSiC(40nm)/Ir | 0.24 | 0.69 | 720 nm | 29.5 lm/W |
| GaN(40nm)/Ir | 0.19 | 0.67 | 780 nm | 30.3 lm/W |
| 3CSiC(40nm)/Ir | 0.25 | 0.69 | 750 nm | 29.5 lm/W |
| HfO2(60nm)/Ir | 0.31 | 0.68 | 750 nm | 27.1 lm/W |
| Lu2O3(60nm)/Ir | 0.30 | 0.67 | 750 nm | 27.5 lm/W |
| Yb2O3(60nm)/Ir | 0.30 | 0.67 | 750 nm | 27.5 lm/W |
| Carbon(40nm)/Ir | 0.14 | 0.64 | 950 nm | 31.2 lm/W |
| Diamond(40nm)/Ir | 0.14 | 0.64 | 950 nm | 31.2 lm/W |

Fig.47

--Mo rough surface--

-Mo mirror surface--

Substrate: Mo (Examples 4－1 to 4－11)

| Structure | R (550 nm) | R (1 μm) | Cut-off | Luminous efficiency η |
|---|---|---|---|---|
| MgO(70nm)/Mo | 0.23 | 0.50 | 1000 nm | 28.8 lm/W |
| ZrO2(50nm)/Mo | 0.12 | 0.46 | 1030 nm | 30.2 lm/W |
| Y2O3(60nm)/Mo | 0.25 | 0.52 | 1000 nm | 28.8 lm/W |
| 6HSiC(40nm)/Mo | 0.08 | 0.40 | 1020 nm | 29.4 lm/W |
| GaN(40nm)/Mo | 0.11 | 0.47 | 1010 nm | 30.5 lm/W |
| 3CSiC(40nm)/Mo | 0.07 | 0.40 | 1050nm | 29.4 lm/W |
| HfO2(60nm)/Mo | 0.18 | 0.48 | 1030 nm | 29.1 lm/W |
| Lu2O3(60nm)/Mo | 0.17 | 0.47 | 1030 nm | 29.5 lm/W |
| Yb2O3(60nm)/Mo | 0.17 | 0.47 | 1030 nm | 29.4 lm/W |
| Carbon(40nm)/Mo | 0.04 | 0.40 | 1050 nm | 30.7 lm/W |
| Diamond(40nm)/Mo | 0.04 | 0.40 | 1050 nm | 30.7 lm/W |

Fig.62

--Re rough surface--

-Re mirror surface--

Substrate : Re (Examples 5－1 to 5－11)

| Structure | R (550 nm) | R (1 μm) | Cut-off | Luminous efficiency η |
|---|---|---|---|---|
| MgO(70nm)/Re | 0.15 | 0.45 | 1160 nm | 20.4 lm/W |
| ZrO2(50nm)/Re | 0.08 | 0.41 | 1150 nm | 20.8 lm/W |
| Y2O3(70nm)/Re | 0.13 | 0.43 | 1160 nm | 20.4 lm/W |
| 6HSiC(40nm)/Re | 0.07 | 0.36 | 1150 nm | 19.8 lm/W |
| GaN(40nm)/Re | 0.09 | 0.42 | 1150 nm | 20.6 lm/W |
| 3CSiC(40nm)/Re | 0.07 | 0.36 | 1150 nm | 19.8 lm/W |
| HfO2(60nm)/Re | 0.11 | 0.43 | 1150 nm | 20.4 lm/W |
| Lu2O3(60nm)/Re | 0.10 | 0.43 | 1160 nm | 20.6 lm/W |
| Yb2O3(60nm)/Re | 0.10 | 0.42 | 1160 nm | 20.6 lm/W |
| Carbon(40nm)/Re | 0.02 | 0.35 | 1180 nm | 21.2 lm/W |
| Diamond(40nm)/Re | 0.02 | 0.35 | 1180 nm | 21.2 lm/W |

Fig.77

--W rough surface--

--W mirror surface--

Substrate : W (Examples 6—1 to 6—11)

| Structure | R (550 nm) | R (1 μm) | Cut-off | Luminous efficiency η |
|---|---|---|---|---|
| MgO(70nm)/W | 0.17 | 0.42 | 1050 nm | 21.9 lm/W |
| ZrO2(50nm)/W | 0.08 | 0.38 | 1040 nm | 22.5 lm/W |
| Y2O3(60nm)/W | 0.11 | 0.40 | 1020 nm | 22.3 lm/W |
| 6HSiC(30nm)/W | 0.14 | 0.41 | 1050 nm | 21.8 lm/W |
| GaN(40nm)/W | 0.08 | 0.39 | 1030 nm | 22.5 lm/W |
| 3CSiC(30nm)/W | 0.14 | 0.41 | 1040nm | 21.7 lm/W |
| HfO2(60nm)/W | 0.12 | 0.40 | 1000 nm | 22.0 lm/W |
| Lu2O3(60nm)/W | 0.11 | 0.39 | 1040 nm | 22.2 lm/W |
| Yb2O3(60nm)/W | 0.11 | 0.39 | 1030 nm | 22.1 lm/W |
| Carbon(40nm)/W | 0.01 | 0.32 | 1060 nm | 22.7 lm/W |
| Diamond(40nm)/W | 0.02 | 0.35 | 1060 nm | 21.2 lm/W |

Fig.92

--Ru rough surface--

-Ru mirror surface--

Substrate: Ru (Examples7—1 to 7—11)

| Structure | R (550 nm) | R (1 μm) | Cut-off | Luminous efficiency η |
|---|---|---|---|---|
| MgO(70nm)/Ru | 0.35 | 0.46 | 1150 nm | 18.2 lm/W |
| ZrO2(50nm)/Ru | 0.22 | 0.43 | 1140 nm | 20.5 lm/W |
| Y2O3(60nm)/Ru | 0.27 | 0.43 | 1150 nm | 19.4 lm/W |
| 6HSiC(40nm)/Ru | 0.13 | 0.39 | 1140 nm | 21.3 lm/W |
| GaN(50nm)/Ru | 0.17 | 0.38 | 1140 nm | 20.6 lm/W |
| 3CSiC(40nm)/Ru | 0.13 | 0.39 | 1140 nm | 21.1 lm/W |
| HfO2(60nm)/Ru | 0.30 | 0.44 | 1140 nm | 18.9 lm/W |
| Lu2O3(60nm)/Ru | 0.28 | 0.44 | 1150 nm | 19.3 lm/W |
| Yb2O3(60nm)/Ru | 0.27 | 0.43 | 1160 nm | 19.4 lm/W |
| Carbon(40nm)/Ru | 0.14 | 0.39 | 1170 nm | 21.5 lm/W |
| Diamond(40nm)/Ru | 0.14 | 0.39 | 1170 nm | 21.5 lm/W |

Fig.107

LIGHT SOURCE DEVICE AND FILAMENT

TECHNICAL FIELD

The presently disclosed subject matter relates to a filament for light sources showing improved energy utilization efficiency, and it also relates to, in particular, a light source device and a thermoelectronic emission source utilizing such a filament.

BACKGROUND ART

There are widely used incandescent light bulbs which produce light with a filament such as tungsten filament heated by flowing an electric current through it. Incandescent light bulbs show a radiation spectrum close to that of sunlight providing superior color rendering properties, and show high electric power-to-light conversion efficiency of 80% or higher. However, 90% or more of the components of the light radiated by incandescent light bulbs consists of infrared radiation components as shown in FIG. 1 (in the case of 3000K in FIG. 1). Therefore, the electric power-to-visible light conversion efficiency of incandescent light bulbs is as low as about 15 lm/W. In contrast, the electric power-to-visible light conversion efficiency of fluorescent lamps is about 90 lm/W, which is higher than that of incandescent light bulbs. Therefore, although incandescent light bulbs show superior color rendering properties, they have a problem that they impose large environmental loads.

Various proposals have been made so far as attempts for realizing higher efficiency, higher luminance and longer lifetime of incandescent light bulbs. For example, Patent documents 1 and 2 propose a configuration for realizing a higher filament temperature, in which an inert gas or halogen gas is enclosed in the inside of an electric bulb so that the evaporated filament material is halogenated and returned to the filament (halogen cycle) to obtain higher filament temperature. Such a lamp is generally called halogen lamp, and such a configuration provides the effects of increasing electric power-to-visible light conversion efficiency and prolonging filament lifetime. In this configuration, type of the gas to be enclosed and control of the pressure thereof are important for obtaining increased efficiency and prolonged filament lifetime.

Patent documents 3 to 5 disclose a configuration in which an infrared light reflection coating is applied on the surface of electric bulb glass to reflect infrared lights emitted from the filament and return them to the filament, so that the returned lights are absorbed by the filament. In this configuration, infrared lights are used for the re-heating of the filament to attain higher efficiency.

Patent documents 6 to 9 propose a configuration that a microstructure is produced on the filament itself, and infrared radiation is suppressed by the physical effects of the microstructure to increase the rate of visible light radiation.

CONVENTIONAL ART REFERENCES

Patent Documents

Patent document 1: Japanese Patent Unexamined Publication (Kokai) No. 60-253146

Patent document 2: Japanese Patent Unexamined Publication (Kokai) No. 62-10854

Patent document 3: Japanese Patent Unexamined Publication (Kokai) No. 59-58752

Patent document 4: Japanese Patent Unexamined Publication (Kohyo) No. 62-501109

Patent document 5: Japanese Patent Unexamined Publication (Kokai) No. 2000-123795

Patent document 6: Japanese Patent Unexamined Publication (Kohyo) No. 2001-519079

Patent document 7: Japanese Patent Unexamined Publication (Kokai) No. 6-5263

Patent document 8: Japanese Patent Unexamined Publication (Kokai) No. 6-2167

Patent document 9: Japanese Patent Unexamined Publication (Kokai) No. 2006-205332

Non-Patent Documents

Non-patent document 1: F. Kusunoki et al., Jpn. J. Appl. Phys., 43, 8A, 5253 (2004)

SUMMARY

Although the effect for prolonging the lifetime is realizable with the technique of using the halogen cycle such as those disclosed in Patent documents 1 and 2, it is difficult to markedly improve the conversion efficiency with such a technique, and the efficiency currently obtainable thereby is about 20 lm/W.

Further, the technique of reflecting infrared lights with an infrared reflection coating to cause the reabsorption by the filament such as those described in Patent documents 3 to 5 cannot provide efficient reabsorption of infrared lights by the filament, since the filament has a high reflectance for infrared lights as high as 70%. Furthermore, the infrared lights reflected by the infrared reflection coating are absorbed by the parts other than the filament, for example, the part for holding the filament, base, and so forth, and are not fully used for heating the filament. For these reasons, it is difficult to significantly improve the conversion efficiency with this technique. The efficiency currently obtainable thereby is about 20 lm/W.

Concerning the technique of suppressing infrared radiation lights with a microstructure such as those described in Patent documents 6 to 9, there have been reported the effects of enhancing and suppressing lights of only an extremely small part of the wavelength region of the infrared radiation spectrum as reported in Non-patent document 1, but it is extremely difficult to suppress infrared radiation lights over the wide total range of the infrared radiation spectrum. This is because the infrared radiation lights have a property that infrared light of a certain wavelength is suppressed, those of the other wavelengths are enhanced. Therefore, it is considered that it is difficult to attain marked improvement in the efficiency with this technique. Furthermore, the production of the microstructure requires use of a highly advanced microprocessing technique such as the electron beam lithography, and light sources produced by utilizing it becomes extremely expensive. In addition, it has also a problem that even though a microstructure is formed on a W substrate, which is a high temperature resistant material, the microstructure on the surface of W is melted and destroyed at a heating temperature of about 1000° C.

An aspect of the presently disclosed subject matter is to provide a light source device comprising a filament showing high electric power-to-visible light conversion efficiency.

In order to achieve the aforementioned aspect, one embodiment of the presently disclosed subject matter provides a light source device comprising a translucent gastight container, a filament disposed in the translucent gastight container, and a lead wire for supplying an electric current to the filament. The filament has a structure for controlling light reflectance of the surface thereof. For example, the filament comprises a substrate formed with a high melting point metal material and a visible light reflectance-reducing film coating the substrate for reducing the light reflectance of the substrate.

According to the presently disclosed subject matter, infrared light radiation can be reduced and visible light radiation can be enhanced with a filament showing a high reflectance for the infrared wavelength region and a low reflectance for the visible light wavelength region, and therefore a light source device showing a high visible luminous efficiency can be obtained.

BRIEF DESCRIPTION OF THE DRAWINGS

FIG. 17 is an explanatory table showing the values of optimal thickness and visible luminous efficiency of the filaments of Examples 1-1 to 1-11.

FIG. 32 is an explanatory table showing the values of optimal thickness and visible luminous efficiency of the filaments of Examples 2-1 to 2-11.

FIG. 47 is an explanatory table showing values of the optimal thickness and visible luminous efficiency of the filaments of Examples 3-1 to 3-11.

FIG. 62 is an explanatory table showing values of the optimal thickness and visible luminous efficiency of the filaments of Examples 4-1 to 4-11.

FIG. 77 is an explanatory table showing values of the optimal thickness and visible luminous efficiency of the filaments of Examples 5-1 to 5-11.

FIG. 92 is an explanatory table showing values of the optimal thickness and visible luminous efficiency of the filaments of Examples 6-1 to 6-11.

FIG. 107 is an explanatory table showing values of the optimal thickness and visible luminous efficiency of the filaments of Examples 7-1 to 7-11.

DETAILED DESCRIPTION OF EXEMPLARY EMBODIMENTS

Figure 1:
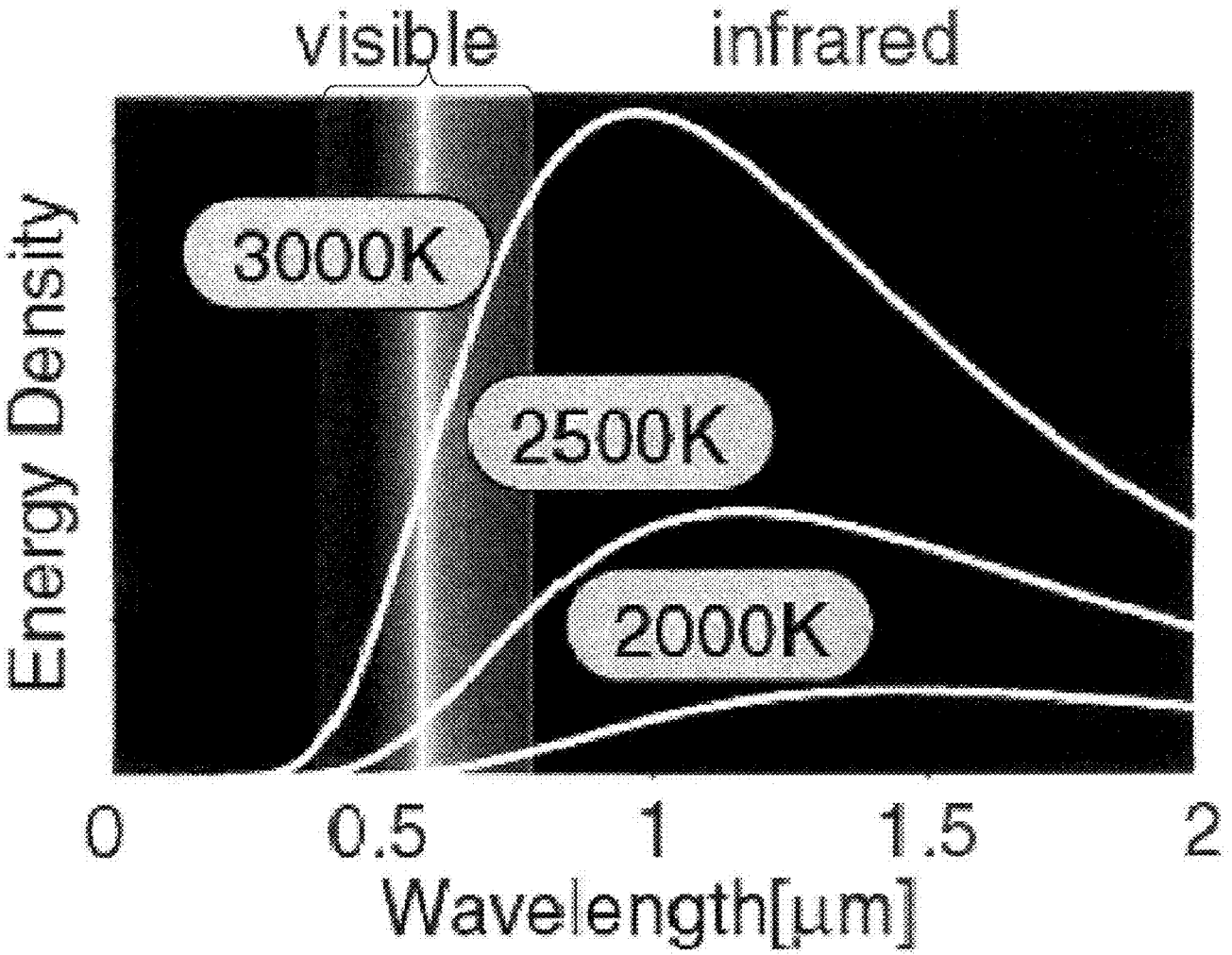
FIG. 1 is a graph showing wavelength dependency of radiation energy of a conventional tungsten filament.

The light source device of the presently disclosed subject matter has a configuration that it comprises a translucent gastight container, a filament disposed in the translucent gastight container, and a lead wire for supplying an electric current to the filament. According to the presently disclosed subject matter, by controlling the light reflectance of the surface of the filament, infrared light radiation is suppressed, and the radiation ratio of visible light radiation is enhanced. The visible luminous efficiency of the filament is thereby improved.

The principle for increasing the ratio of the visible light radiation by suppressing the light reflectance of the surface of the filament will be explained below on the basis of the Kirchhoff's law for black body radiation.

Loss of energy from the input energy induced by a material (filament in this case) in an equilibrium state under conditions of no natural convection heat transfer (for example, in vacuum) is calculated in accordance with the following equation (1).

[Equation 1]

$$P(\text{total})=P(\text{conduction})+P(\text{radiation}) \tag{1}$$

In the above equation, P(total) represents total input energy, P(conduction) represents energy lost through the lead wires for supplying electric current to the filament, and P(radiation) represents energy lost from the filament due to radiation of light to the outside at the heated temperature. At a high temperature of the filament of 2500K or higher, the energy lost from the filament through the lead wires becomes as low as only 5%, and the remaining energy corresponding to 95% or more of the input energy is lost due to the light radiation to the outside. And therefore almost all the input electric energy can be converted into light. However, visible light components of radiation lights radiated from a conventional general filament consist of only about 10%, and most of them consist of infrared radiation components. Therefore, such a filament as it is cannot serve as an efficient visible light source.

The term of P(radiation) in the aforementioned equation (1) can generally be described as the following equation (2).

[Equation 2]

$$P(\text{Radiation}) = \int_0^{\infty} \varepsilon(\lambda) \frac{\alpha\lambda^{-5}}{\exp(\beta/\lambda T)-1} d\lambda \tag{2}$$

In the equation (2), $\in(\lambda)$ is emissivity for each wavelength, the term of $\alpha\lambda^{-5}/(\exp(\beta/\lambda T)-1)$ represents the Planck's law of radiation, $\alpha=3.747\times10^8$ Wμm4/m$^2$, and $\beta=1.4387\times10^4$ μmK. The relation of $\in(\lambda)$ and the reflectance $R(\lambda)$ is described as the equation (3) according to the Kirchhoff's law.

[Equation 3]

$$\in(\lambda)=1-R(\lambda) \tag{3}$$

According to both the relations represented by the equations (2) and (3), $\in(\lambda)$ of a material showing the reflectance of 1 for all the wavelengths is 0 in accordance with the equation (3), thus the integral value in the equation (2) becomes 0, and therefore the material does not cause loss of energy due to radiation. The physical meaning of such a case as mentioned above is that P(total)=P(conduction) in such a case, extremely high temperature of the filament is attained even for a small amount of input energy. On the other hand, a material showing a reflectance of 0 for all the wavelengths is called perfect black body, and the value of $\in(\lambda)$ thereof is 1 in accordance with the equation (3). As a result, the integral value in the equation (2) is the maximum value in such a case, and therefore the amount of loss due to radiation becomes the maximum. The emissivity $\in(\lambda)$ of usual materials satisfies the condition of $0<\in(\lambda)<1$, and the wavelength dependency thereof is not so significant (but it shows mild dependencies on the wavelength $\lambda$ and the temperature T). Therefore, from the infrared region to visible region, such a material shows uniform light radiation from approximately visible region to the infrared region as represented by the spectrum shown in FIG. 2 with the two-dot chain line. The two-dot chain line shown in FIG. 2 is obtained by plotting the black body radiation spectrum under the condition of $\in(\lambda)=1$ for the total wavelength region for simplicity of the discussion.

Figure 2:
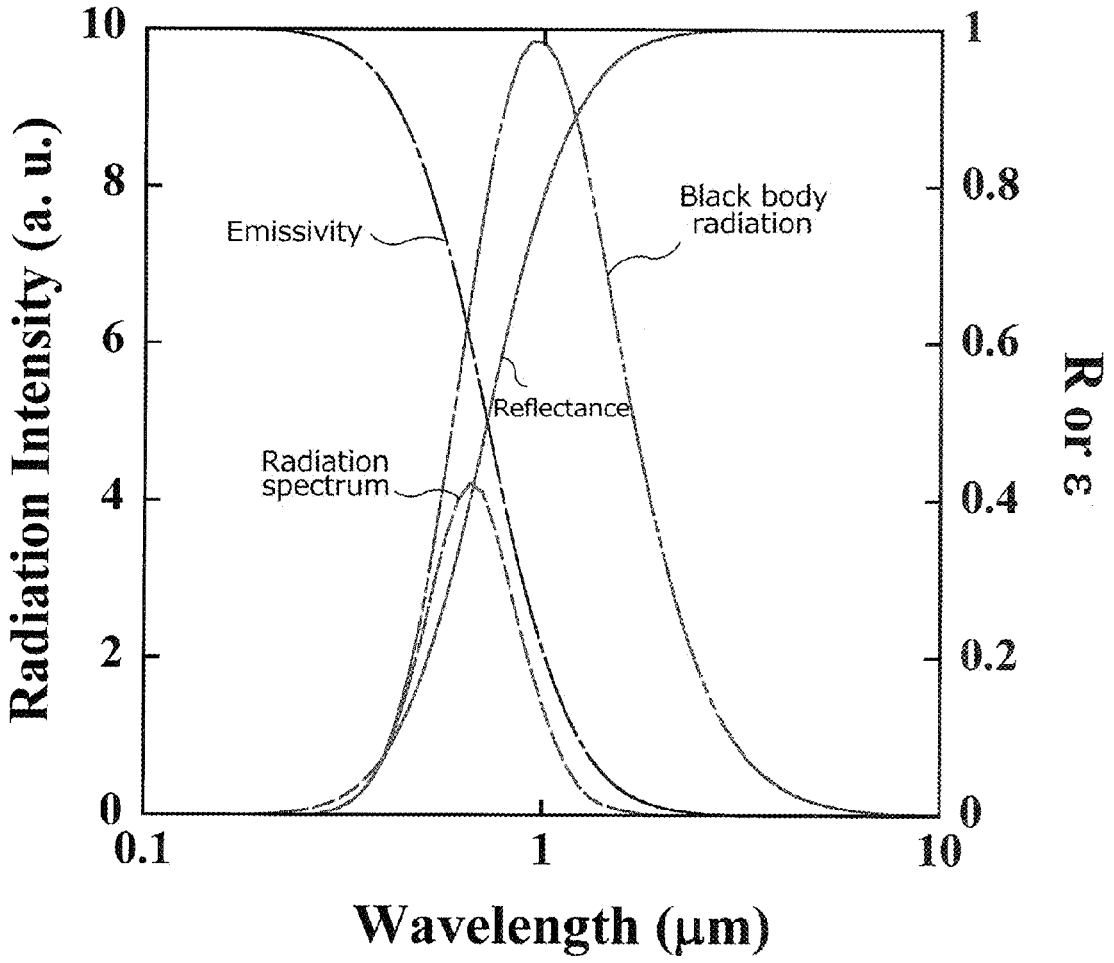
FIG. 2 is a graph showing relation of reflectance, emissivity, and radiation spectrum of a filament of the presently disclosed subject matter.

On the other hand, heat radiation observed when a material showing approximately 0% of emissivity for the infrared region and approximately 100% of emissivity for the visible region of 700 nm or shorter heated in vacuum is represented by the following equation (4) as shown in FIG. 2 with an alternate long and short dash line.

[Equation 4]

$$P(\text{Radiation}) = \int_0^{\infty} \varepsilon(\lambda)\theta(\lambda-\lambda_0)\frac{\alpha\lambda^{-5}}{\exp(\beta/\lambda T)-1}d\lambda \tag{4}$$

In the equation (4), $\theta(\lambda-\lambda_0)$ is a function which gives values like step function, i.e., gives a value of the emissivity of 0 for the region of wavelength on the longer wavelength side of a certain visible light wavelength $\lambda_0$, and a value of the emissivity of 1 for the region of wavelength on the shorter wavelength side of the certain wavelength $\lambda_0$. The radiation spectrum to be obtained has a shape obtained by convoluting the shape of the emissivity spectrum like that of a step function and the shape of the black body radiation spectrum, and the result of the calculation is the spectrum shown in FIG. 2 with the broken line. That is, the physical meaning of the equation (4) is as follows. Namely, in the low temperature region where small energy is input into the filament, the radiation loss is suppressed, the value of the term P(radiation) in the equation (4) is 0, therefore the energy loss consists only of P(conduction), and the filament temperature extremely efficiently rises. On the other hand, in such a temperature region that the filament temperature becomes high, and the peak wavelength of the black body radiation spectrum is shorter than $\lambda_0$, the energy input into the filament is lost as visible light radiation as represented by the spectrum shown in FIG. 2 with the broken line.

As described above, $\theta(\lambda-\lambda_0)$ in the equation (4) represents a function which gives a value of the emissivity of 0 for the region of wavelength from longer wavelength to a certain visible light wavelength $\lambda_0$, and the value of the emissivity of 1 for the region of wavelength shorter than the certain wavelength $\lambda_0$. A material to which such a function is applied shows reflectance of 0 for the region of wavelength not longer than $\lambda_0$ and reflectance of 1 for the region of wavelength longer than $\lambda_0$ as shown in FIG. 2 with the solid line according to the Kirchhoff's law represented by the equation (3). This means that, by controlling the light reflectance of the surface of the filament as in the presently disclosed subject matter, the infrared light radiation can be suppressed when the filament is heated by supply of an electric current or the like, and thereby the radiation ratio of visible light radiation can be increased. That is, by using a filament showing a low reflectance for the visible region of wavelengths not longer than $\lambda_0$, and a high reflectance for a predetermined infrared region of wavelengths longer than $\lambda_0$, infrared radiation can be suppressed, and the visible luminous efficiency can be improved.

As the structure for controlling the light reflectance of the surface of the filament, any structure may be chosen so long as the chosen structure can control the light reflectance even at the high temperature at the time of light emission of the filament (for example, 2000K or higher), and there can be used, for example, a structure that the surface of the filament is processed into a mirror surface, a structure that the surface of the filament has a visible light reflectance-reducing film, a structure that the substrate of the filament is coated with a thin film having a desired light reflectance, and so forth.

According to the first embodiment of the presently disclosed subject matter, the surface of the filament desirably shows a reflectance of 20% or lower for the visible region of wavelengths not longer than 4, and a reflectance of 90% or higher for a predetermined infrared region of wavelengths longer than 4. The visible region of wavelengths not longer than $\lambda_0$ is preferably a region of wavelengths not longer than 700 nm and not shorter than 380 nm, more preferably a region of wavelengths not longer than 750 nm and not shorter than 380 nm. The predetermined infrared region of wavelengths longer than $\lambda_0$ for which the surface of the filament shows a reflectance of 90% or higher is preferably an infrared region of wavelengths of 4000 nm or longer. If the surface of the filament shows a reflectance of 90% or higher for the infrared region of wavelengths of 1000 nm or longer, further improvement in the luminous efficiency can be expected, and therefore such a property of the surface of the filament can be beneficial. In addition, so long as the reflectance is 20% or lower for the visible region, the reflectance may exceed 20% for the region of wavelengths shorter than those of visible region. Further, since there is a region where the reflectance changes from 20% or lower to 90% or higher exists between the visible region for which the reflectance is 20% or lower and the infrared region for which the reflectance is 90% or higher, and the reflectance for this region may be smaller than 90%. Therefore, for the wavelength region not shorter than 750 nm and not longer than 4000 nm, the reflectance may be higher than 20% and lower than 90%.

Further, according to the second embodiment of the presently disclosed subject matter, the surface of the filament desirably shows a reflectance of 80% or higher for lights of wavelengths not shorter than 1000 nm and not longer than 5000 nm, and a reflectance of 50% or lower for lights of wavelengths not shorter than 400 nm and not longer than 600 nm. These wavelengths and the values of the reflectance can be defined in order to suppress infrared light radiation and improve the visible luminous efficiency at the filament heating temperature. Further, since lights of wavelengths shorter than 400 nm are hardly emitted at the actual heating temperature of about 3000K, the value of the reflectance for lights of wavelengths shorter than 400 nm may be an arbitrary value.

According to the third embodiment of the presently disclosed subject matter, it is desirable that difference of the minimum value of the reflectance of the surface of the filament for lights of wavelengths not shorter than 1000 nm and not longer than 5000 nm and the maximum value of the reflectance of the same for lights of wavelengths not shorter than 400 nm and not longer than 600 nm is 30% or larger.

Figure 109A:
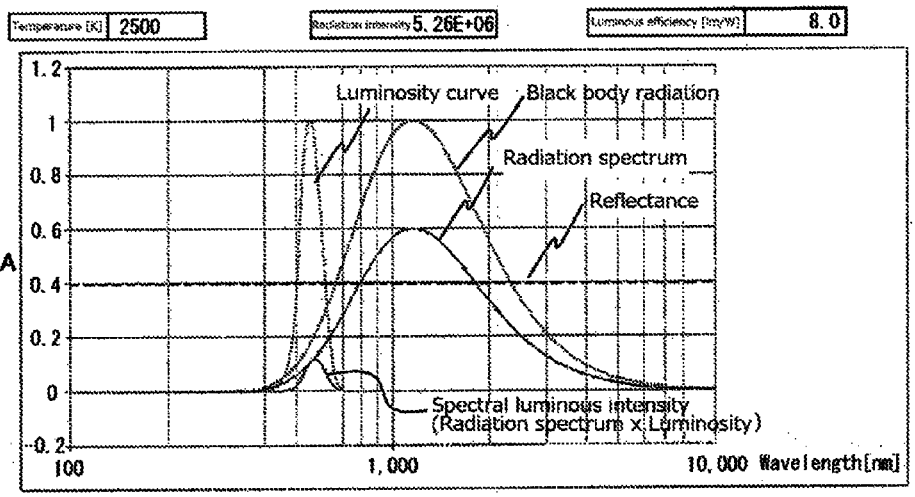
FIG. 109A to FIG. 109C are graphs showing reflectance curves on which the reflectance for the visible region is 40%, and the reflectance for the infrared region is changed according to FIG. 109A to FIG. 109C.
Figure 109B:
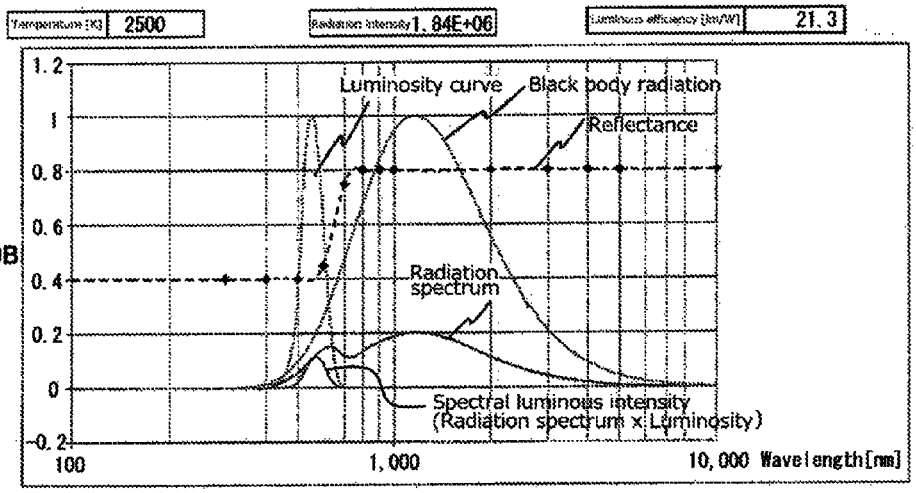
Figure 109C:
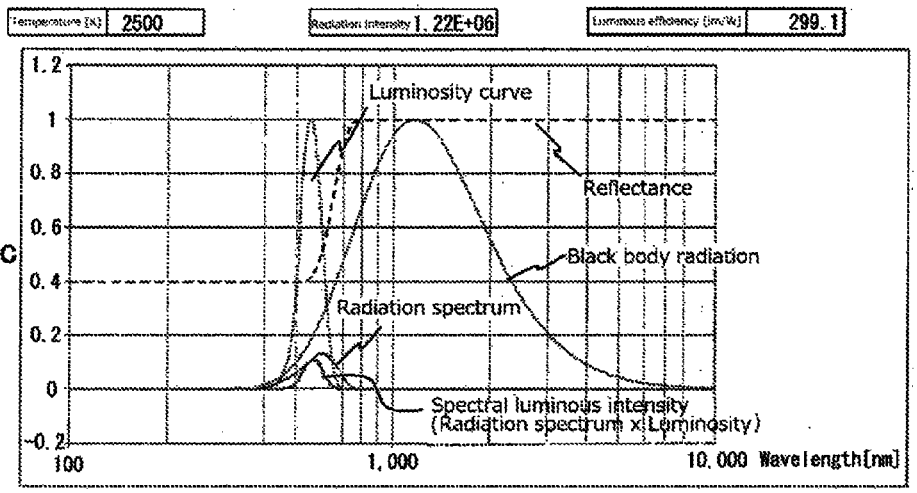

The reasons why the aforementioned characteristics of the second and third embodiments can be beneficial will be explained below. The reflectance for the visible region of a high temperature refractory metal material as the material of the filament decreases as the wavelength approaches the ultraviolet region, and does not significantly depends on the surface roughness, and the reflectance is about 40% for light of a wavelength around 400 nm. Therefore, reflectance curves were virtually created for the surface of filament, on which reflectance for the visible region is 40%, and reflectance for the infrared region is changed from 40% to 100% by an appropriate treatment (mirror surface polishing, coating with an optical thin film (for example, visible light reflectance-reducing film), or the like of the surface of the filament), and the visible luminous efficiency was calculated for each curve by simulation. FIGS. 109A to 109C show reflectance curves, on which the values of reflectance for the infrared region are 40%, 80%, and 100%. The infrared region referred to here means a wavelength region of from 700 nm to 2500 nm including the near-infrared region invisible for human eyes, of which representative wavelength is 1000 nm.

Figure 110:
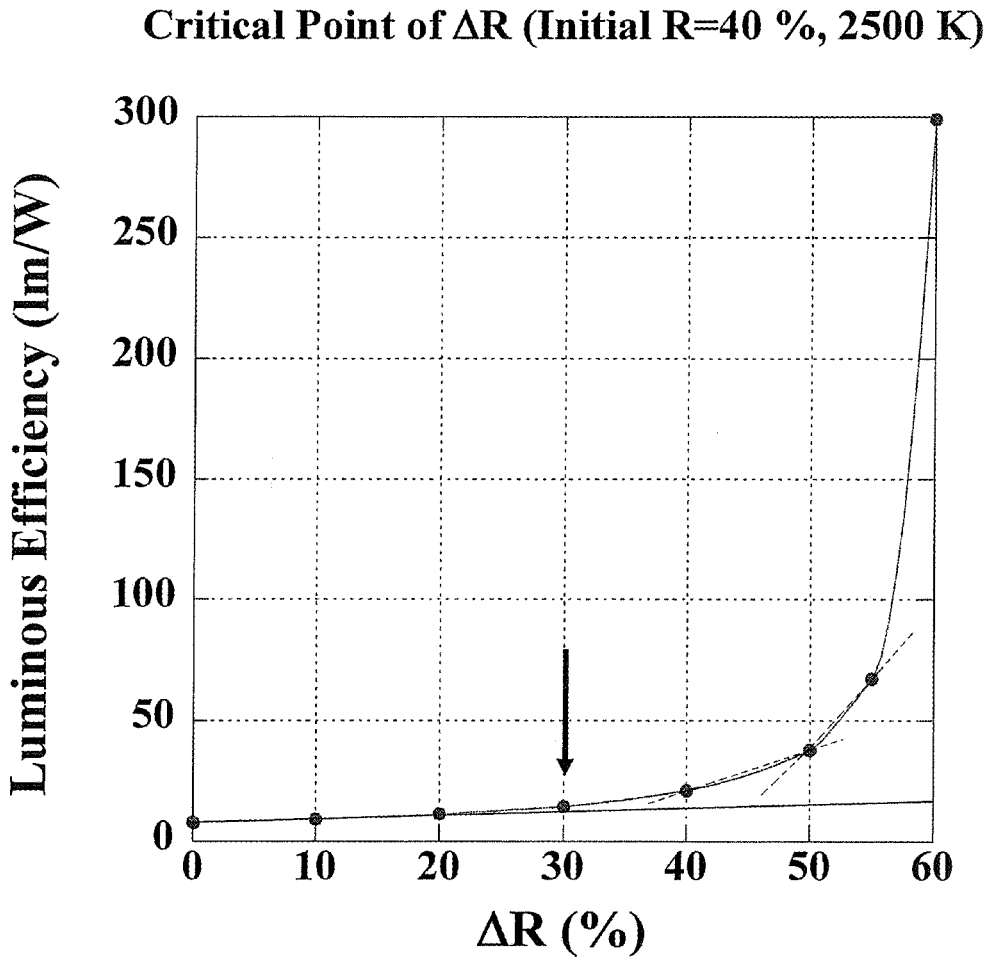
FIG. 110 is a graph showing the relation of the difference ΔR between the reflectances for the visible region and the infrared region, and the visible luminous efficiency.

FIG. 110 shows the simulation results for the visible luminous efficiency obtained for the filament that shows the aforementioned curves. In FIG. 110, the vertical axis indicates the visible luminous efficiency, and the horizontal axis indicates the difference ΔR of the reflectance for the visible region and the reflectance for the infrared region. As clearly seen from FIG. 110, it can be seen that, for the relation of the visible luminous efficiency and ΔR, the visible luminous efficiency monotonously increases in the region where ΔR is smaller than 30%, but it sharply increases from the point where ΔR is around 30% (that is, reflectance for visible lights is 40%, reflectance for infrared lights is 70%) as the border and in the region where ΔR is larger than that, as ΔR becomes larger. The increasing ratio becomes still larger from the point where ΔR is 40% (that is, reflectance for visible lights is 40%, reflectance for infrared lights is 80%), and in the region where ΔR is 50% or larger (that is, reflectance for visible lights is 40%, reflectance for infrared lights is 90%), the increasing ratio becomes further larger.

Therefore, it is derived that the surface of the filament desirably shows a reflectance of 80% or higher for lights of wavelengths not shorter than 1000 nm and not longer than 5000 nm, and a reflectance of 50% or lower for lights of wavelengths not shorter than 400 nm and not longer than 600 nm as defined in the second embodiment of the presently disclosed subject matter mentioned above. Further, it is also derived that the difference of the minimum value of the reflectance of the surface of the filament for lights of wavelengths not shorter than 1000 nm and not longer than 5000 nm and the maximum value of the reflectance of the same for lights of wavelengths not shorter than 400 nm and not longer than 600 nm is desirably 30% or larger as defined in the third embodiment of the presently disclosed subject matter mentioned above.

The chromaticities (x, y) of the filament of which reflectance curve shown in FIG. 109A for the case of ΔR=0 are (0.477, 0.414). However, the chromaticities (x, y) of the filament of which reflectance curve shown in FIG. 109B for the case of ΔR=40% are (0.456, 0.424), and the chromaticities (x, y) of the filament of which reflectance curve shown in FIG. 109C for the case of ΔR=60% are (0.441, 0.429). From these values, it can be seen that a filament showing ΔR of 30% or larger, or showing a reflectance of 80% or higher for lights of wavelengths not shorter than 1000 nm and not longer than 5000 nm, and a reflectance of 50% or lower for lights of wavelengths not shorter than 400 nm and not longer than 600 nm, has an appearance in gold or copper color.

The filaments of the aforementioned first to third embodiments can be realized with, for example, a configuration comprising a substrate made of a metal substance and a visible light reflectance-reducing film coating the substrate for reducing the visible light reflectance of the substrate. The substrate is desirably made of a high melting point material (melting point is 2000K or higher). The surface of the substrate may be made into a mirror surface by polishing. In such a case, as for the surface roughness, the surface of the substrate desirably satisfies at least one of the following conditions: center line average height Ra of 1 μm or smaller, maximum height Rmax of 10 μm or smaller, and ten-point average roughness Rz of 10 μm or smaller.

As the visible light reflectance-reducing film, a film transparent to visible lights can be used. As the visible light reflectance-reducing film, a dielectric film showing a melting point of 2000K or higher can be used. Specifically, as the visible light reflectance-reducing film, any of metal oxide film, metal nitride film, metal carbide film and metal boride film showing a melting point of 2000K or higher can be used.

The filaments of the second and third embodiments can also be realized by using a substrate of which surface is mirror-polished as the substrate of the filament, even without using the configuration that the substrate is coated with a thin film such as the visible light reflectance-reducing film. In such a case, as for the surface roughness of the substrate, the surface of the substrate desirably satisfies at least one of the following conditions: center line average height Ra of 1 μm or smaller, maximum height Rmax of 10 μm or smaller, and ten-point average roughness Rz of 10 μm or smaller. In addition, an optical thin film such as a visible light reflectance-reducing film may of course be also disposed on the mirror-polished surface of the substrate.

Further, the filaments of the first to third embodiments can also be realized by coating a substrate with a thin film showing a predetermined reflectance characteristic (namely, a thin film having a radiation controlling property). It is also possible to further dispose a visible light reflectance-reducing film on the thin film having a radiation controlling property.

The filament of the second embodiment mentioned above shows a reflectance of 80% or higher for lights of wavelengths not shorter than 1000 nm and not longer than 5000 nm, and a reflectance of 50% or lower for lights of wavelengths not shorter than 400 nm and not longer than 600 nm, and such a filament can further show a reflectance of 90% or higher for lights of wavelengths not shorter than 4000 nm. Furthermore, such a filament still more preferably further show a reflectance of 20% or lower for lights of wavelengths not shorter than 400 nm and not longer than 700 nm.

The filament of the third embodiment mentioned above shows difference (ΔR) of 30% or larger between the minimum value of the reflectance of the surface of the filament for lights of wavelengths not shorter than 1000 nm and not longer than 5000 nm and the maximum value of the reflectance of the same for lights of wavelengths not shorter than 400 nm and not longer than 600 nm, and the difference (ΔR) is more preferably 40% or larger, still more preferably 50% or higher, since such an increased difference provides more marked increase of the visible luminous efficiency.

As the high melting point material constituting the substrate, a metal material showing a melting point of 2000K or higher, for example, any one of Ta, Os, Ir, Mo, Re, W, Ru, Nb, Cr, Zr, V, Rh, C, $B_4C$, SiC, ZrC, TaC, HfC, NbC, ThC, TiC, WC, AlN, BN, ZrN, TiN, HfN, $LaB_6$, $ZrB_2$, $HfB_2$, $TaB_2$, and $TiB_2$, or an alloy comprising any of these can be used.

Further, if crystal grains grow in the substrate at the time of the heating at a high temperature, the surface is roughened, which may be a cause of decrease in the reflectance for infrared lights and destruction of the thin film formed on the substrate at the time of the heating at a high temperature. Therefore, it can be beneficial to use a substrate heated to a high temperature beforehand so that the growth of crystal grains has been completed, and then mirror-polished.

The visible light reflectance-reducing film is transparent to visible lights, and reduces the light reflectance of the filament by the interference between visible lights reflected by the surface of the visible light reflectance-reducing film and visible lights passing through the visible light reflectance-reducing film and reflected by the surface of the substrate. The visible light reflectance-reducing film is formed with, for example, a dielectric film showing a melting point of 2000K or higher. For example, any of metal oxide film, metal nitride film, metal carbide film and metal boride film showing a melting point of 2000K or higher is used. Specifically, there can be used a single layer film consisting of any of MgO, $ZrO_2$, $Y_2O_3$, 6H-SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$, $ZrB_{12}$, C, $B_4C$, ZrC, TaC, HfC, NbC, ThC, TiC, WC, AlN, BN, ZrN, TiN, HfN, $LaB_6$, $ZrB_2$, $HfB_2$, $TaB_2$, $TiB_2$, CaO, $CeO_2$ and $ThO_2$, a multi-layer film being lamination of a plurality of kinds of single layer films of these materials, or a single layer film or multi-layer film comprising a composite material formed from the aforementioned materials.

Thickness of the visible light reflectance-reducing film is designed to be an appropriate thickness according to the refractive index thereof by calculation, experimentally, or by simulation. When the thickness is designed by calculation, the thickness is determined so that, for example, the optical path length for visible light ($\lambda/n_0$, $n_0$ is refractive index) corresponds to about ¼ of the wavelength. When it is designed experimentally or by simulation, there is used a method of determining thickness dependency of the reflectance of the filament by obtaining reflectance values for various thickness values, and then obtaining a thickness providing the lowest reflectance for all the wavelengths of visible lights. In the presently disclosed subject matter, it is desirable to design the thickness of the visible light reflectance-reducing film so that the reflectance is reduced for the whole wavelength region of visible lights, and therefore the latter method can be beneficially used.

When the substrate is coated with a film having a radiation controlling property, any of metal oxide film, metal nitride film, metal carbide film and metal boride film showing a melting point of 2000K or higher can be used as the film having a radiation controlling property. For example, there can be used a single layer film consisting of any of Ta, Os, Ir, Mo, Re, W, Ru, Nb, Cr, Zr, V, Rh, C, $B_4C$, SiC, ZrC, TaC, HfC, NbC, ThC, TiC, WC, AlN, BN, ZrN, TiN, HfN, $LaB_6$, $ZrB_2$, $HfB_2$, $TaB_2$, $TiB_2$, CaO, $CeO_2$, MgO, $ZrO_2$, $Y_2O_3$, $HfO_2$, $Lu_2O_3$, $Yb_2O_3$, and $ThO_2$, a multi-layer film being a lamination of a plurality of kinds of single layer films of these materials, or a single layer film or multi-layer film comprising a composite material formed from the aforementioned materials.

Shape of the filament may be any shape that allows heating of the filament to a high temperature, and it may be in the form of, for example, wire, rod or thin plate, which can generate heat in response to supply of electric current from a lead wire. Further, the filament may have a structure that allows direct heating of the filament other than heating by supplying electric current.

The inventors of the presently disclosed subject matter searched for conventional techniques that may be used to obtain a material (filament) showing such a reflectance characteristic as mentioned above, and found that the following methods (a) to (d) were already known. However, as a result of detailed investigation of these methods, it was found that the materials obtained by these methods could not bear a temperature of 1000° C. or higher, and could not attain the above-mentioned reflection characteristics (reflectance of 20% or lower for the visible region of wavelength $\lambda_0$ not longer than 700 nm, and reflectance of 90% or higher for the infrared region) at a temperature of 2000K or higher. The conventional techniques are:

(a) a method of coating a substrate with a chromium film, nickel film, or the like by using such a technique as electroplating (refer to, for example, G. Zajac, et al., J. Appl. Phys., 51, 5544 (1980)), (b) a method of anodizing aluminum to produce a porous nanostructure on the surface with controlled pore diameter and depth, and thereby control the reflectance (refer to, for example, A. Anderson, et al., J. Appl. Phys., 51, 754 (1980)), (c) a method of forming a composite thin film consisting of a dielectric substance containing metal microparticles (the composite thin film is produced by a method of depositing a metal such as Cu, Cr, Co and Au, or a semiconductor such as PbS and CdS simultaneously with a dielectric substance such as those consisting of oxide or fluoride by vapor deposition, sputtering or ion implantation) (for example, J. C. C. Fan and S. A. Spura, Appl. Phys. Lett., 30, 511 (1977)), (d) a method of producing a photonic crystal structure on a surface of metal or semiconductor to control the reflectance thereof (for example, F. Kusunoki et al., Jpn. J. Appl. Phys., 43, 8A, 5253 (2004)), and so forth.

Hereafter, examples of the presently disclosed subject matter will be specifically explained.

<Examples of Mirror-Surface Processing of Substrate>

First, examples of the filaments of the second and third embodiments of the presently disclosed subject matter mentioned above will be explained. The reflection characteristics of the filament according to the second embodiment of the presently disclosed subject matter consist of a reflectance of 80% or higher for lights of wavelengths not shorter than 1000 nm and not longer than 5000 nm, and a reflectance of 50% or lower for lights of wavelengths not shorter than 400 nm and not longer than 600 nm. The reflection characteristic of the filament according to the third embodiment of the presently disclosed subject matter is that difference between the minimum value of the reflectance of the surface of the filament for lights of wavelengths not shorter than 1000 nm and not longer than 5000 nm and the maximum value of the reflectance of the same for lights of wavelengths not shorter than 400 nm and not longer than 600 nm is 30% or larger.

In this example, filaments satisfying the requirement of the reflectance characteristics according to the second and third embodiments mentioned above are obtained by constituting the filament (substrate) with Ta and polishing the surface thereof.

The Ta substrate is produced by a known process such as sintering and drawing of a material metal. The substrate is formed in a desired shape, for example, in the form of wire, rod, thin plate, or the like.

Since the Ta substrate produced by such a process as sintering and drawing has a rough surface, it shows only a low reflectance. Therefore, in this example, the surface of the substrate is polished to increase the reflectance for infrared wavelength region or longer wavelength region.

Specifically, a Ta substrate produced by the aforementioned manufacturing process is heated to a high temperature beforehand to complete growth of crystal grains, and the substrate in which growth of crystal grains has been completed is mirror-polished. As the polishing method, for example, a method of performing polishing with two or more kinds of diamond abrasive grains is used. The surface of the substrate is thereby processed into a mirror surface showing a center line average height Ra of 1 μm or smaller, a maximum height Rmax of 10 μm or smaller, and a ten-point average roughness Rz of 10 μm or smaller.

Figure 3:
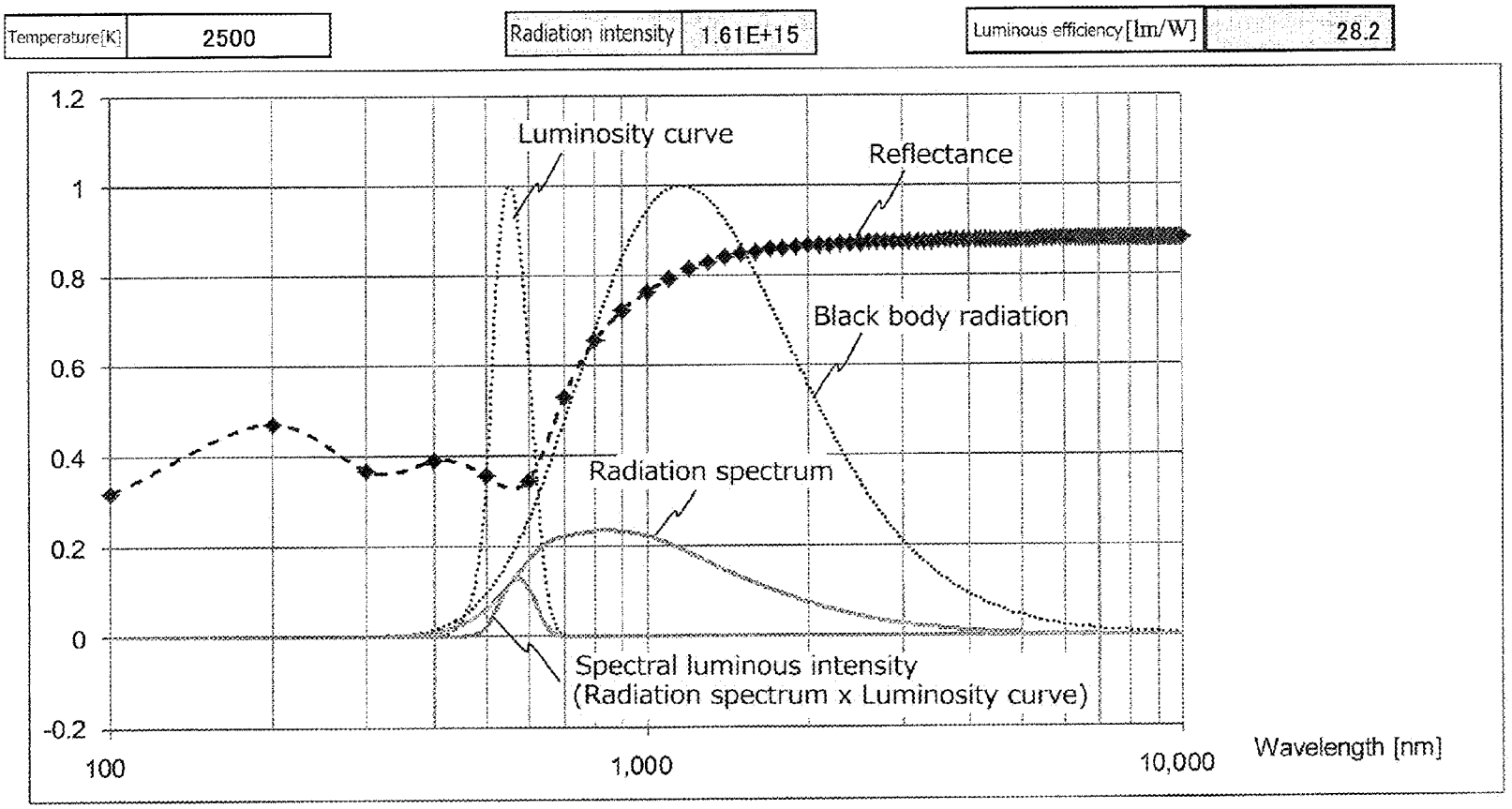
FIG. 3 is a graph showing the wavelength dependency of the reflectance, obtained radiation spectrum, and spectral luminous intensity (radiation spectrum×luminosity curve) observed for the Ta substrate used in Example 1 before polishing.
Figure 4:
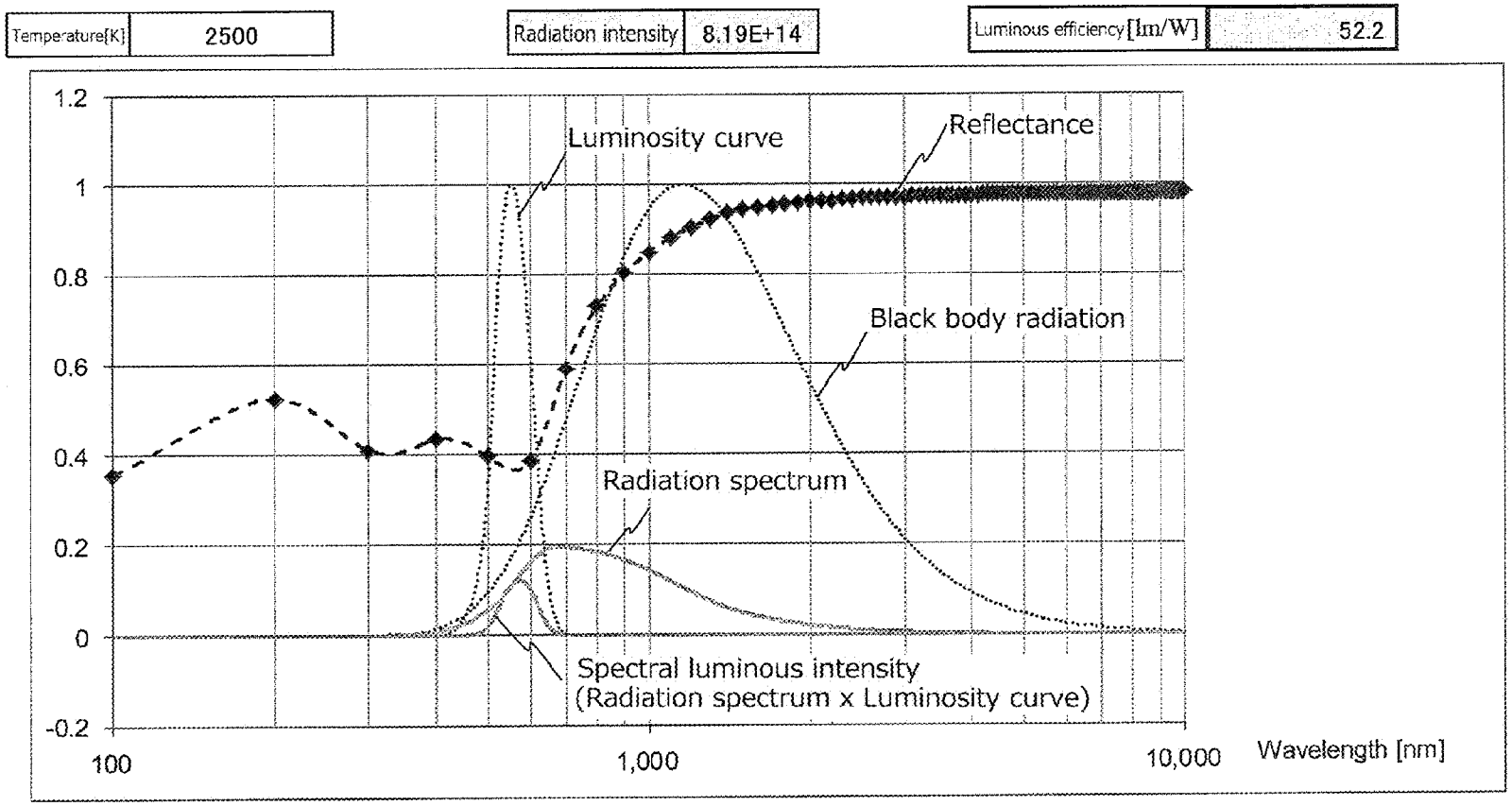
FIG. 4 is a graph showing the wavelength dependency of the reflectance, obtained radiation spectrum, and spectral luminous intensity observed for the Ta substrate used in Example 1 after polishing.

FIGS. 3 and 4 show reflectance, radiation spectra and radiation spectra of substrates in the range where luminosity is obtained, which were obtained by simulation, for a Ta substrate not polished and having a rough surface and the mirror-polished Ta substrate. They also show black body radiation spectra and luminosity curves. The both are for a temperature of 2500K. The radiation spectrum is obtained by multiplying the emissivity $\in(\lambda)$ and the black body radiation spectrum of the substrate. The radiation spectrum of the Ta substrate in the range where luminosity is obtained is obtained by multiplying the luminosity curve and the radiation spectrum of the substrate.

As shown in FIG. 4, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 3, and was 80% or higher. Further, the reflectance for wavelengths not shorter than 400 nm and not longer than 600 nm was 50%. Therefore, it can be seen that the filament of the second embodiment showing a reflectance of 80% or higher for lights of wavelengths not shorter than 1000 nm and not longer than 5000 nm, and a reflectance of 50% or lower for lights of wavelengths not shorter than 400 nm and not longer than 600 nm was obtained. Further, this filament also satisfied the requirement of the third embodiment, i.e., the difference between the minimum value of the reflectance for lights of wavelengths not shorter than 1000 nm and not longer than 5000 nm and the maximum value of the reflectance for lights of wavelengths not shorter than 400 nm and not longer than 600 nm is 30% or larger.

As described above, a filament that satisfies the reflectance characteristics of the second and third embodiments can be realized by mirror polishing. It was confirmed that, because of such reflectance characteristics, the emissivity of the filament for the infrared wavelength region was suppressed, and as a result, the luminous efficiency (radiation efficiency for visible lights) was improved from 28.2 lm/W to 52.2 lm/W, which means improvement of 85%.

Hereafter, examples of the filament comprising a visible light reflectance-reducing film according to the first embodiment of the presently disclosed subject matter will be specifically explained.

Example 1

Substrate: Ta

Examples 1-1 to 1-11 mentioned below are examples of constituting the substrate with Ta.

Example 1-1

In Example 1-1, there is explained a filament in which the substrate is constituted with Ta, and an MgO film is provided as a visible light reflectance-reducing film on the surface of the substrate.

The Ta substrate was a mirror-polished substrate as explained in the above-mentioned examples, and the reflectance characteristics thereof were as shown in FIG. 4.

In this example, a visible light reflectance-reducing film was formed on the mirror-polished surface of the Ta substrate to reduce the visible light reflectance of the surface. In Example 1-1, an MgO film was formed as the visible light reflectance-reducing film.

Specifically, an MgO film was formed in a predetermined thickness as a visible light reflectance-reducing film on the mirror-polished surface of the Ta substrate to coat the substrate surface. As the method for forming the film, various methods such as the electron beam deposition method, sputtering method, and chemical vapor deposition method can be used. Further, in order to enhance adhesion of the film to the substrate after the film formation, and enhance film properties (crystallinity, optical characteristics, etc.), it is also possible to perform annealing in a temperature range of 1500 to 2500° C.

There is an optimal range of the thickness of the visible light reflectance-reducing film (MgO film) for obtaining the maximum visible luminous efficiency. In this example, in order to find the optimal range of the thickness, a plurality of filament samples were prepared with various thicknesses, and visible luminous efficiencies of the filament samples were obtained by simulation. The thickness range providing the maximum visible light luminous efficiency was defined as the thickness of the visible light reflectance-reducing film.

Figure 5:
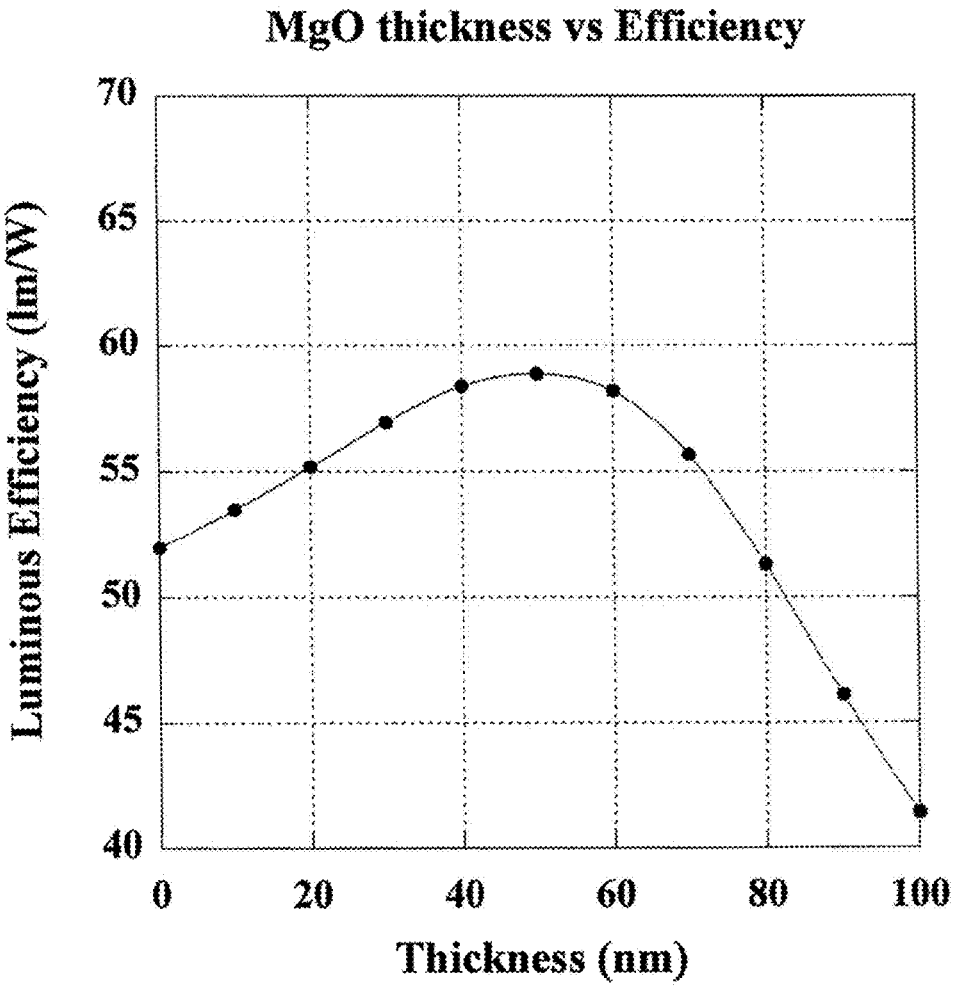
FIG. 5 is a graph showing the film thickness dependency of the luminous efficiency of the filament of Example 1-1 comprising a Ta substrate and a visible light reflectance-reducing film (MgO film).

Specifically, the thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 5. From the results shown in FIG. 5, when the visible light reflectance-reducing film was an MgO film, the optimal thickness was determined to be 50 nm. The luminous efficiency for visible lights of the filament coated with the MgO film of the optimal thickness of 50 nm was 58.9 lm/W.

Figure 6:
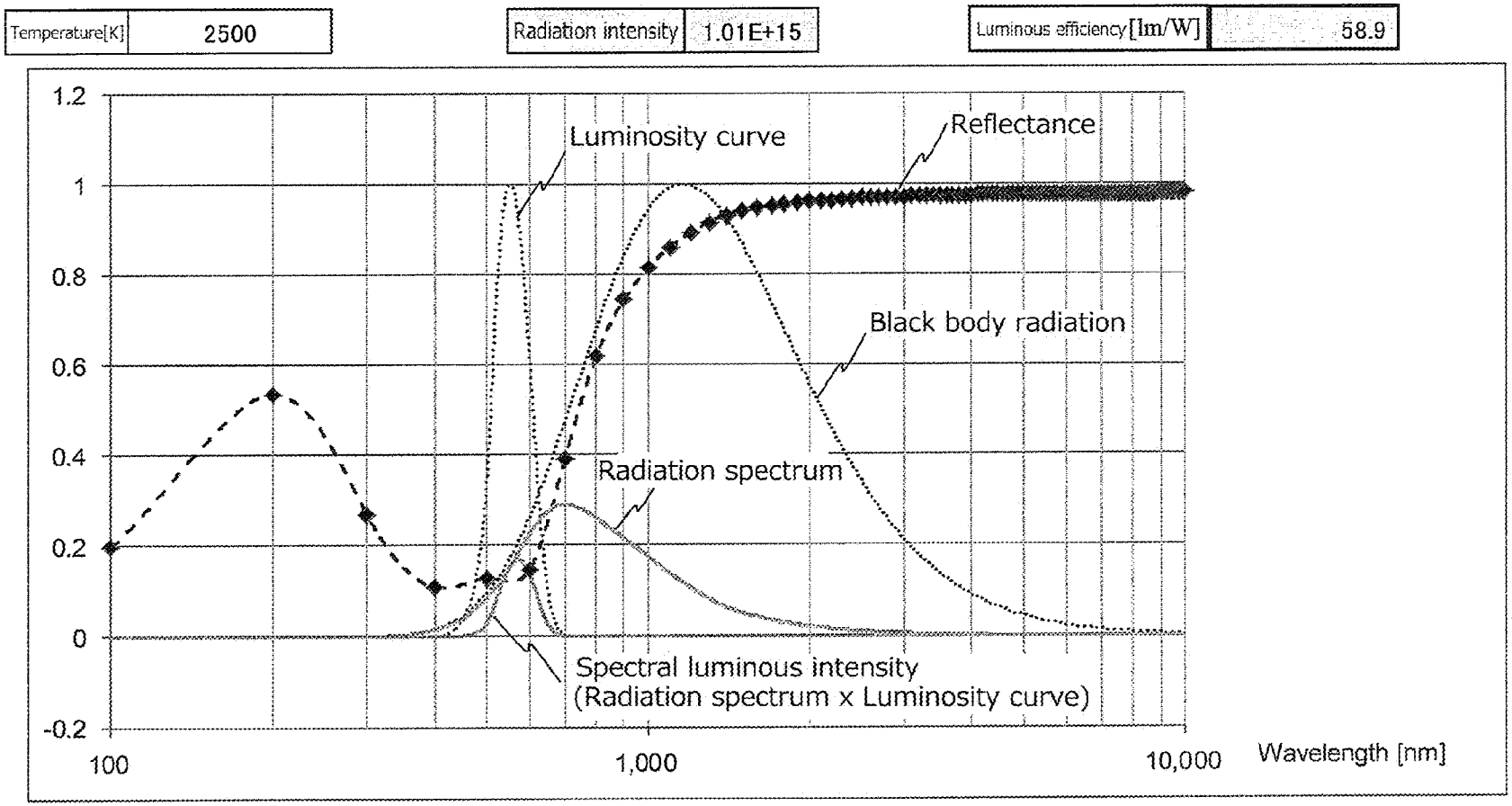
FIG. 6 is a graph showing the wavelength dependency of the reflectance, obtained radiation spectrum, and spectral luminous intensity of the filament of Example 1-1 comprising a Ta substrate and a visible light reflectance-reducing film (MgO film).

FIG. 6 shows the reflectance, radiation spectrum, and spectral luminous intensity of the substrate in the range where luminosity is obtained, which were obtained for the Ta substrate (filament) coated with an MgO film of 50 nm thickness by simulation and experiments. From comparison of the reflectance shown in FIG. 6 with the reflectance shown in FIG. 4 observed before forming the MgO film, it can be seen that the reflectance for the visible region was markedly reduced by the formation of the MgO film, i.e., around 40% of the reflectance of the Ta substrate observed before the formation of the MgO film was decreased to about 15% by the coating with the MgO film. As a result, the visible luminous efficiency of 52.2 lm/W could be improved to 58.9 lm/W, i.e., improved by 13%.

As described above, in this example, by coating the Ta substrate with a visible light reflectance-reducing film (MgO film), a filament for light sources and light source device showing an efficiency of about 60 lm/W at 2500K could be provided.

Examples 1-2 to 1-11

In Examples 1-2 to 1-11, the substrate was constituted with Ta, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 1-2 to 1-11, the methods described in Example 1-1 can be used likewise. Further, for the visible light reflectance-reducing film consisting of GaN, SiC or the like, a method of growing GaN film, SiC film, or the like in a desired thickness on a highly smooth growth substrate, metal-bonding a Ta substrate on the GaN film, SiC film or the like, and then removing the growth substrate by lift-off removing through etching or the like can also be used. As the growth substrate, for example, sapphire can be used for GaN, and Si can be used for SiC.

Changes of the visible luminous efficiency of the filaments of Examples 1-2 to 1-11 to be observed when the thickness of the visible light reflectance-reducing film is variously changed were obtained by simulation. The results are shown in FIGS. 7 to 16, respectively.

Figure 7:
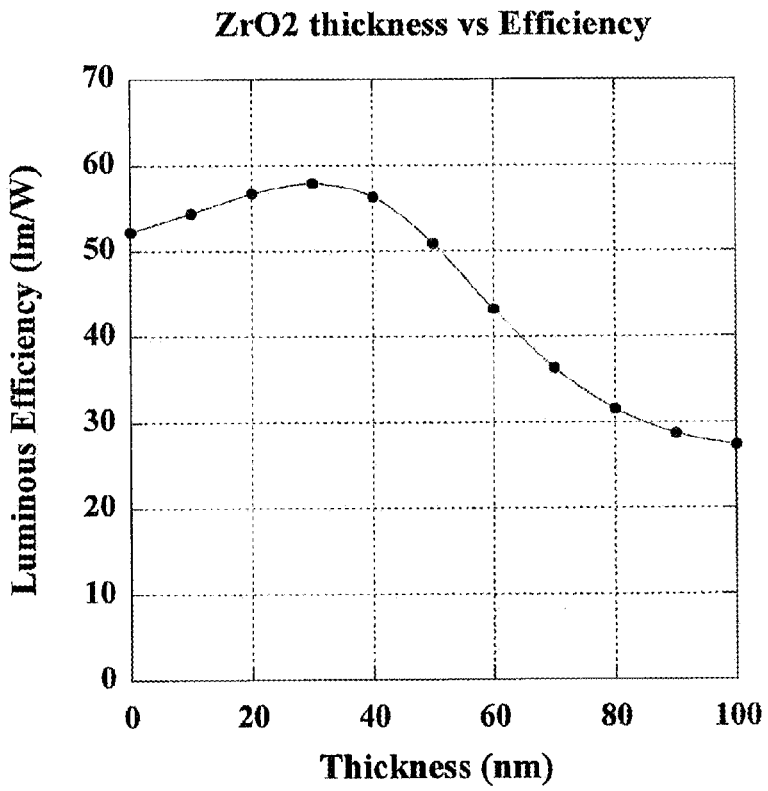
FIG. 7 is a graph showing the film thickness dependency of the luminous efficiency of the filament of Example 1-2 comprising a Ta substrate and a visible light reflectance-reducing film ($ZrO_2$ film).

FIG. 7 shows the visible luminous efficiency observed in Example 1-2 using a Ta substrate and a $ZrO_2$ film as the visible light reflectance-reducing film. As shown in FIG. 7, it can be seen that the maximum visible luminous efficiency of 57.9 lm/W was attained with a film thickness of 30 nm.

Figure 8:
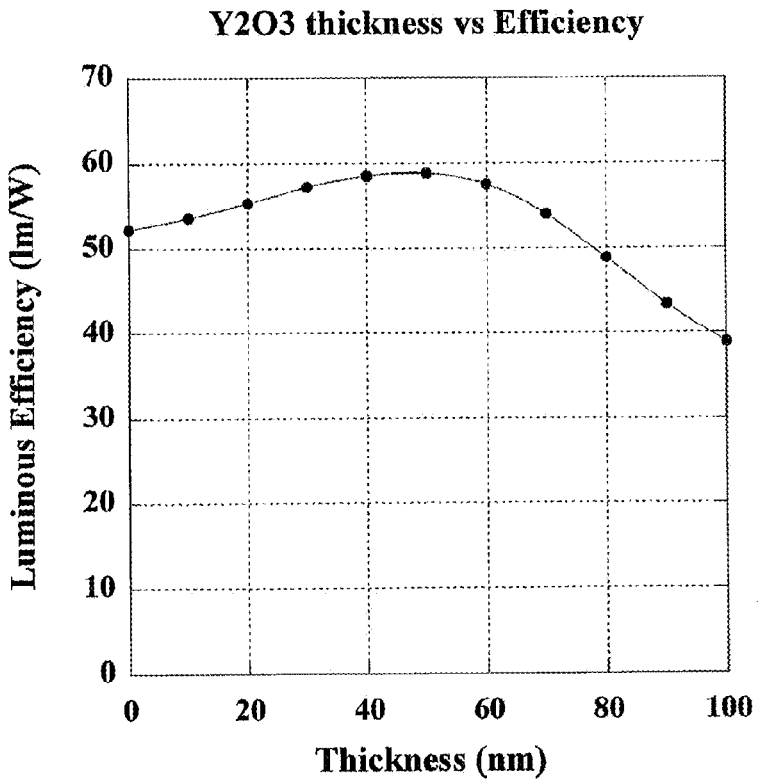
FIG. 8 is a graph showing the film thickness dependency of the luminous efficiency of the filament of Example 1-3 comprising a Ta substrate and a visible light reflectance-reducing film ($Y_2O_3$ film).

FIG. 8 shows the visible luminous efficiency observed in Example 1-3 using a Ta substrate and a $Y_2O_3$ film as the visible light reflectance-reducing film. As shown in FIG. 8, it can be seen that the maximum visible luminous efficiency of 58.8 lm/W was attained with a film thickness of 50 nm.

Figure 9:
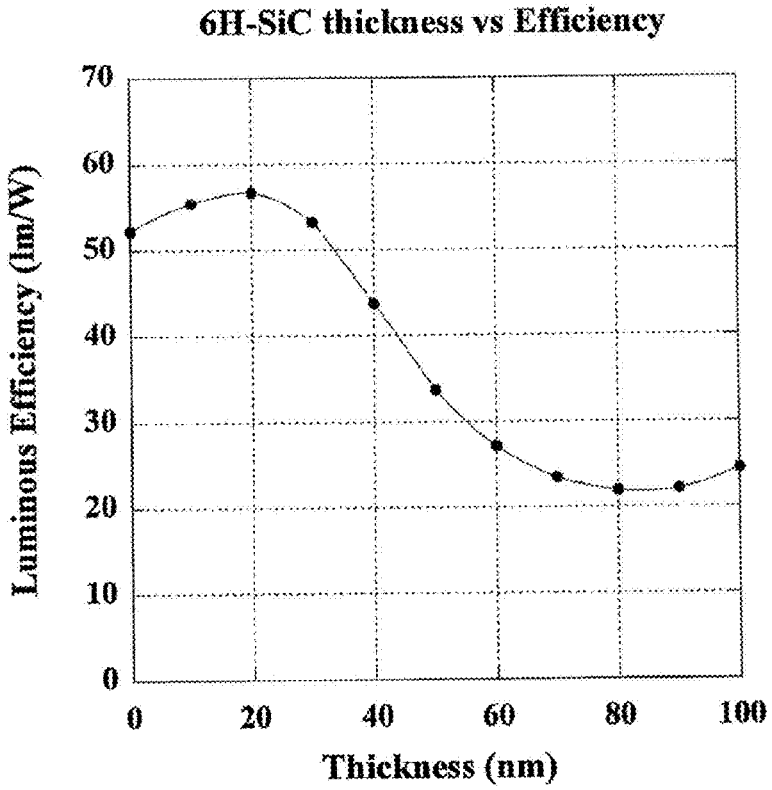
FIG. 9 is a graph showing the film thickness dependency of the luminous efficiency of the filament of Example 1-4 comprising a Ta substrate and a visible light reflectance-reducing film (6H-SiC (hexagonal SiC) film).

FIG. 9 shows the visible luminous efficiency observed in Example 1-4 using a Ta substrate and a 6H-SiC (hexagonal SiC) film as the visible light reflectance-reducing film. As shown in FIG. 9, it can be seen that the maximum visible luminous efficiency of 56.7 lm/W was attained with a film thickness of 20 nm.

Figure 10:
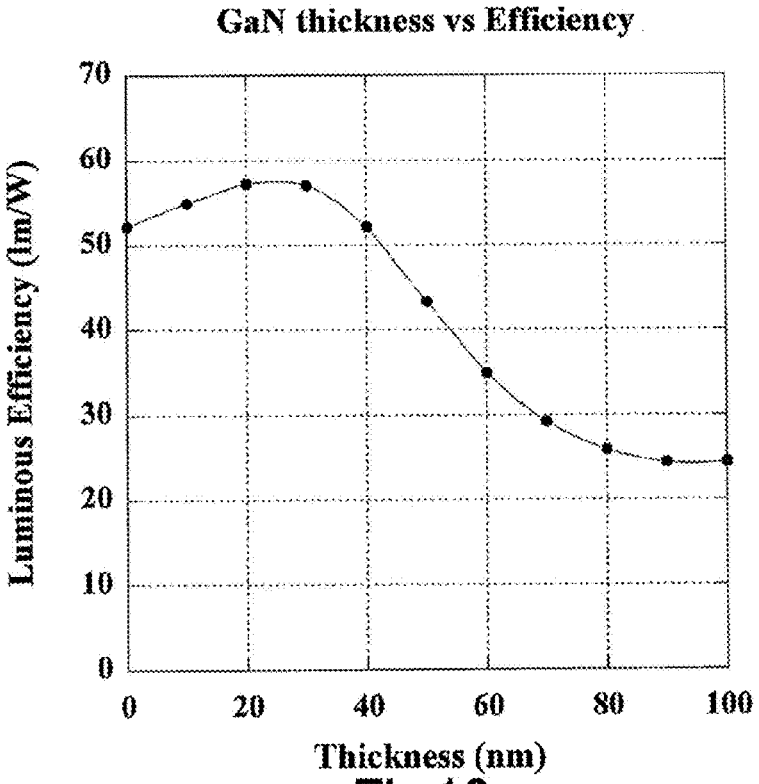
FIG. 10 is a graph showing the film thickness dependency of the luminous efficiency of the filament of Example 1-5 comprising a Ta substrate and a visible light reflectance-reducing film (GaN film).

FIG. 10 shows the visible luminous efficiency observed in Example 1-5 using a Ta substrate and a GaN film as the visible light reflectance-reducing film. As shown in FIG. 10, it can be seen that the maximum visible luminous efficiency of 57.2 lm/W was attained with a film thickness of 20 nm.

Figure 11:
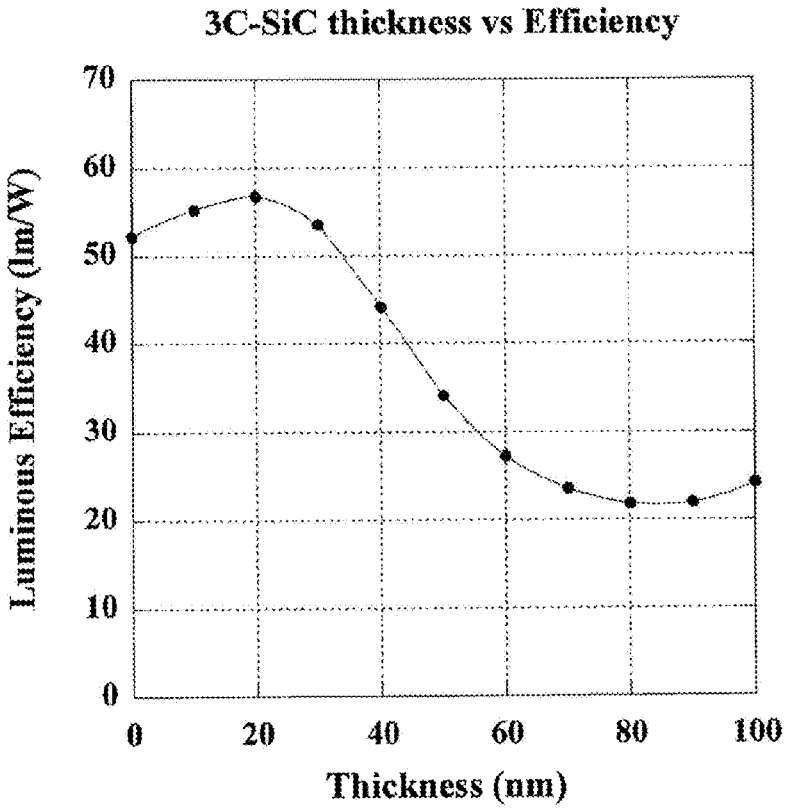
FIG. 11 is a graph showing the film thickness dependency of the luminous efficiency of the filament of Example 1-6 comprising a Ta substrate and a visible light reflectance-reducing film (3C-SiC (cubic SiC) film).

FIG. 11 shows the visible luminous efficiency observed in Example 1-6 using a Ta substrate and a 3C-SiC (cubic SiC) film as the visible light reflectance-reducing film. As shown in FIG. 11, it can be seen that the maximum visible luminous efficiency of 56.7 lm/W was attained with a film thickness of 20 nm.

Figure 12:
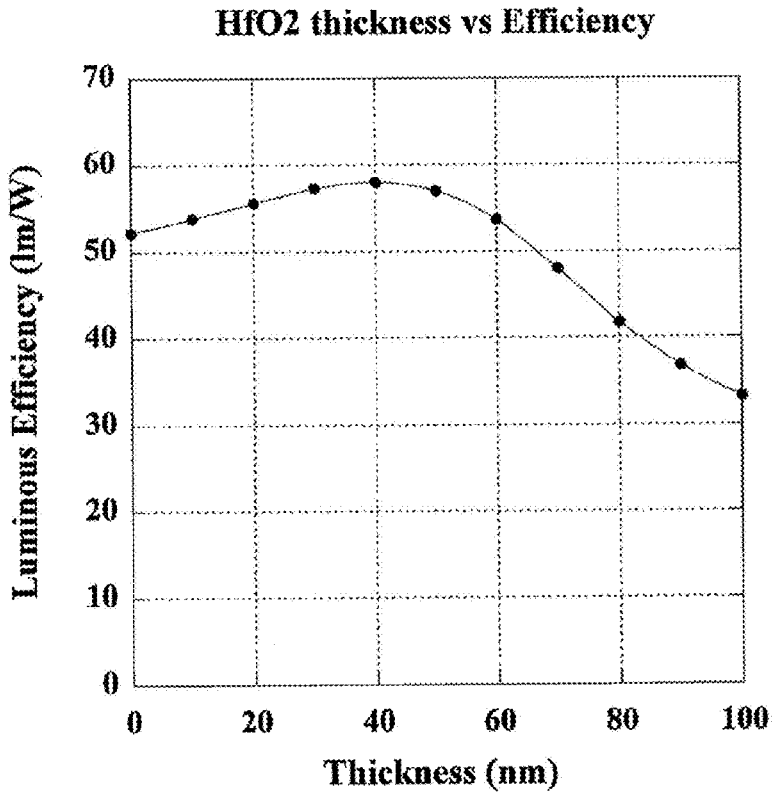
FIG. 12 is a graph showing the film thickness dependency of the luminous efficiency of the filament of Example 1-7 comprising a Ta substrate and a visible light reflectance-reducing film ($HfO_2$ film).

FIG. 12 shows the visible luminous efficiency observed in Example 1-7 using a Ta substrate and an $HfO_2$ film as the visible light reflectance-reducing film. As shown in FIG. 12, it can be seen that the maximum visible luminous efficiency of 58.9 lm/W was attained with a film thickness of 40 nm.

Figure 111:
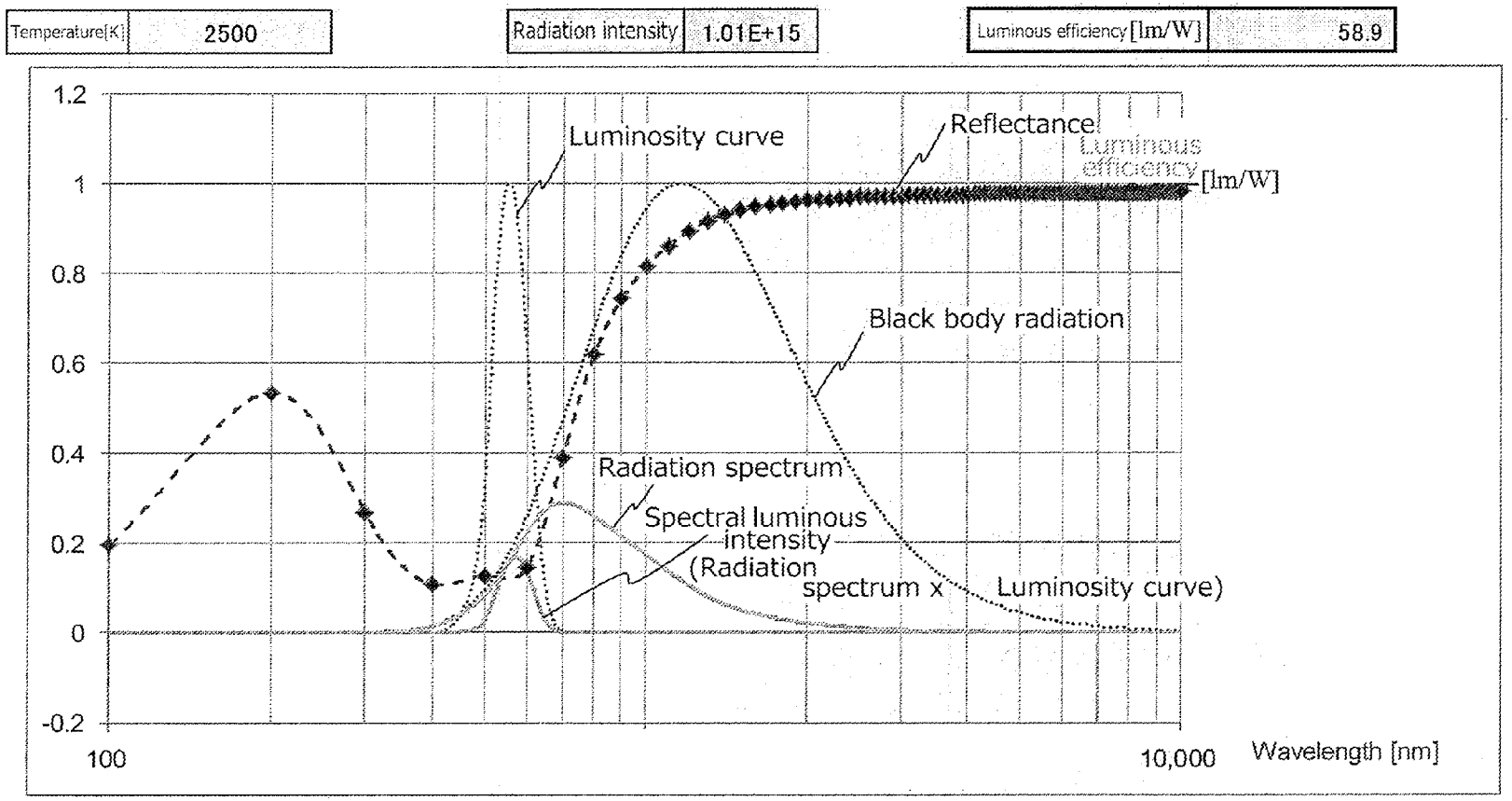
FIG. 111 is a graph showing the wavelength dependency of the reflectance, obtained radiation spectrum, and spectral luminous intensity of the filament of Example 1-7 comprising a Ta substrate and a visible light reflectance-reducing film ($HfO_2$ film).

FIG. 111 shows the reflectance, radiation spectrum, and radiation spectrum in the range where luminosity is obtained of the Ta substrate (filament) coated with an $HfO_2$ film of 40 nm thickness, which were obtained by simulation. From comparison of the reflectance shown in FIG. 111 with the reflectance of the Ta substrate shown in FIG. 4 observed before forming the $HfO_2$ film, it can be seen that the reflectance for the visible region was markedly reduced by the formation of the $HfO_2$ film, i.e., around 40% of the reflectance for visible lights (wavelength of 400 to 600 nm) of the Ta substrate observed before the formation of the $HfO_2$ film was decreased to about 15% by the coating with the $HfO_2$ film. As a result, the visible luminous efficiency of 52.2 lm/W could be improved to 58.9 lm/W, i.e., improved by 13%.

Figure 13:
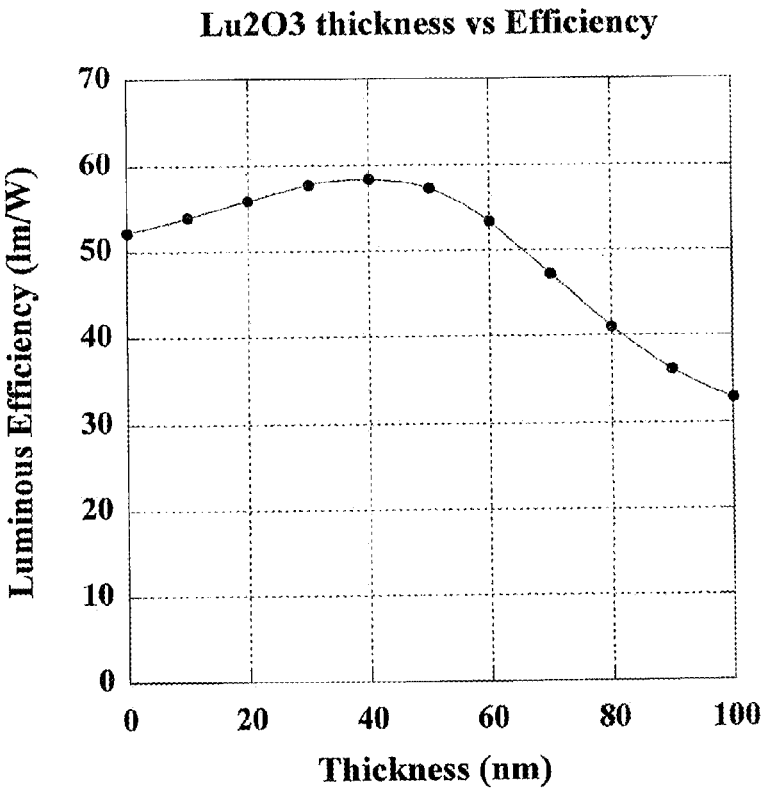
FIG. 13 is a graph showing the film thickness dependency of the luminous efficiency of the filament of Example 1-8 comprising a Ta substrate and a visible light reflectance-reducing film ($Lu_2O_3$ film).

FIG. 13 shows the visible luminous efficiency observed in Example 1-8 using a Ta substrate and an $Lu_2O_3$ film as the visible light reflectance-reducing film. As shown in FIG. 13, it can be seen that the maximum visible luminous efficiency of 58.4 lm/W was attained with a film thickness of 40 nm.

Figure 14:
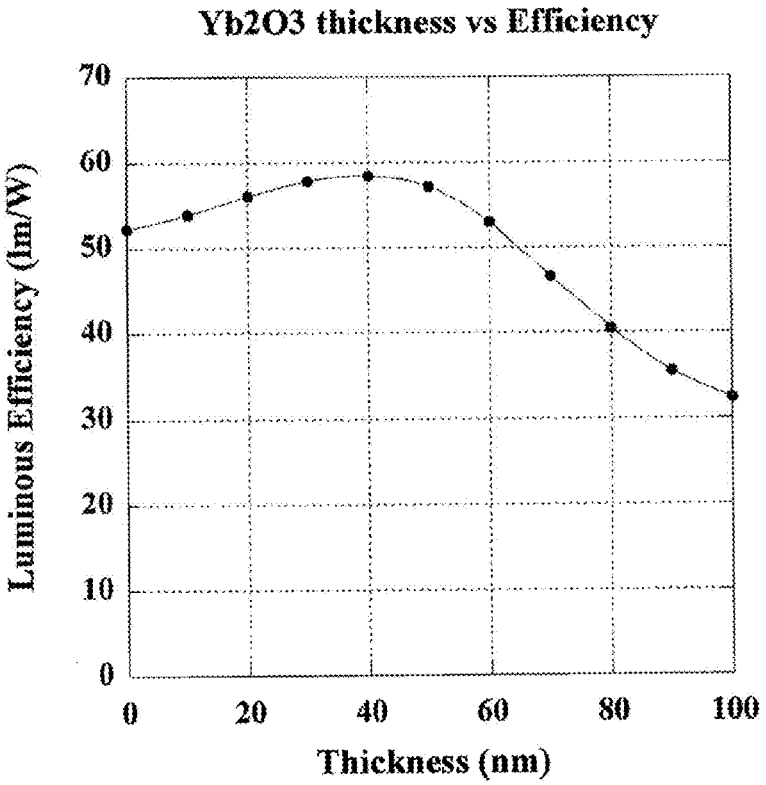
FIG. 14 is a graph showing the film thickness dependency of the luminous efficiency of the filament of Example 1-9 comprising a Ta substrate and a visible light reflectance-reducing film ($Yb_2O_3$ film).

FIG. 14 shows the visible luminous efficiency observed in Example 1-9 using a Ta substrate and a $Yb_2O_3$ film as the visible light reflectance-reducing film. As shown in FIG. 14, it can be seen that the maximum visible luminous efficiency of 58.4 lm/W was attained with a film thickness of 40 nm.

Figure 15:
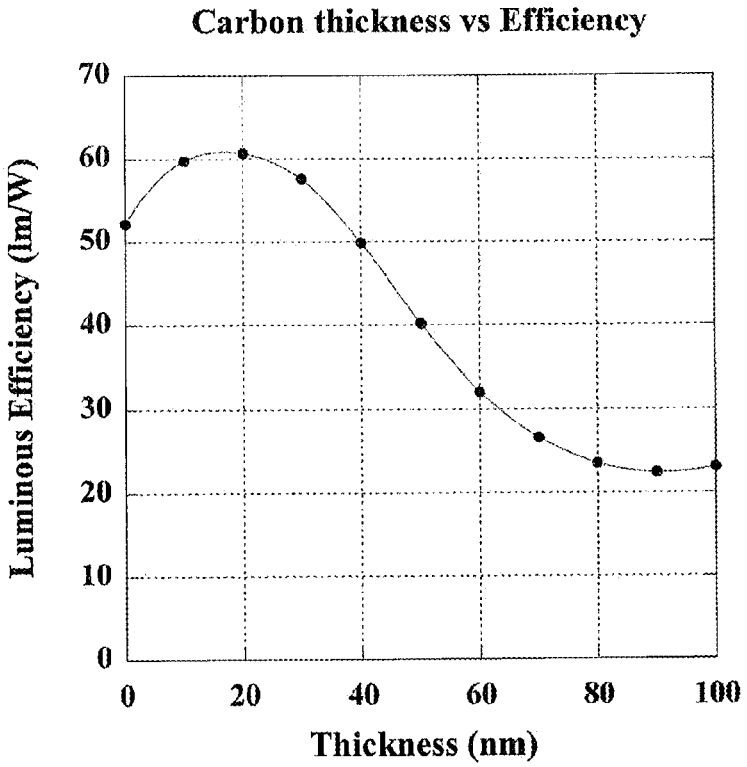
FIG. 15 is a graph showing the film thickness dependency of the luminous efficiency of the filament of Example 1-10 comprising a Ta substrate and a visible light reflectance-reducing film (graphite film).

FIG. 15 shows the visible luminous efficiency observed in Example 1-10 using a Ta substrate and a carbon (graphite) film as the visible light reflectance-reducing film. As shown in FIG. 15, it can be seen that the maximum visible luminous efficiency of 60.7 lm/W was attained with a film thickness of 20 nm.

Figure 16:
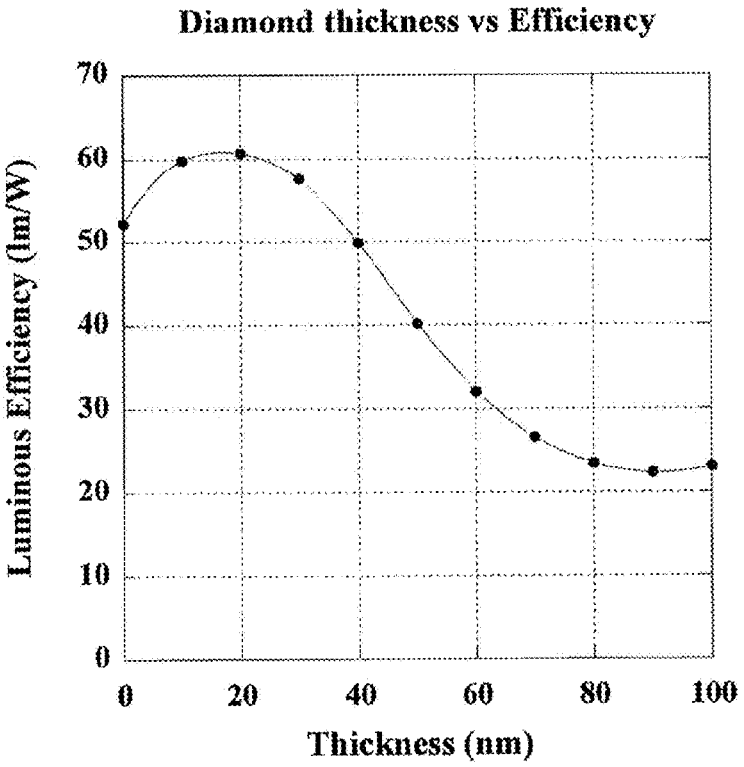
FIG. 16 is a graph showing the film thickness dependency of the luminous efficiency of the filament of Example 1-11 comprising a Ta substrate and a visible light reflectance-reducing film (diamond film).

FIG. 16 shows the visible luminous efficiency observed in Example 1-11 using a Ta substrate and a diamond film as the visible light reflectance-reducing film. As shown in FIG. 16, it can be seen that the maximum visible luminous efficiency of 60.7 lm/W was attained with a film thickness of 20 nm.

The results of Examples 1-1 to 1-11 are summarized as shown in FIG. 17. In FIG. 17, there are shown values of the optimal thickness of the visible light reflectance-reducing film and the visible luminous efficiency (luminous efficiency) n of the filaments of those thickness values, as well as the reflectance values for the wavelengths of 550 nm and 1 μm and the wavelength for which the reflectance is 50% (cutoff wavelength) as the reflectance characteristics of the filaments.

The values of the visible luminous efficiency of the filaments of Example 1-2 to 1-12 having the visible light reflectance-reducing film shown in FIGS. 7 to 17 are 56.7 lm/W or larger, and they were increased compared with the visible luminous efficiency 52.2 lm/W of the mirror-polished Ta substrate not having the visible light reflectance-reducing film. Therefore, the values of the visible luminous efficiency of the filaments of Example 1-2 to 1-12 could be improved by providing the visible light reflectance-reducing film, as in Example 1-1.

Example 2

Substrate: Os

Examples 2-1 to 2-11 mentioned below are examples of constituting the substrate with Os.

Example 2-1

In Example 2-1, there is explained a filament in which the substrate is constituted with Os, and an MgO film is provided as a visible light reflectance-reducing film on the surface of the substrate.

The Os substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 18:
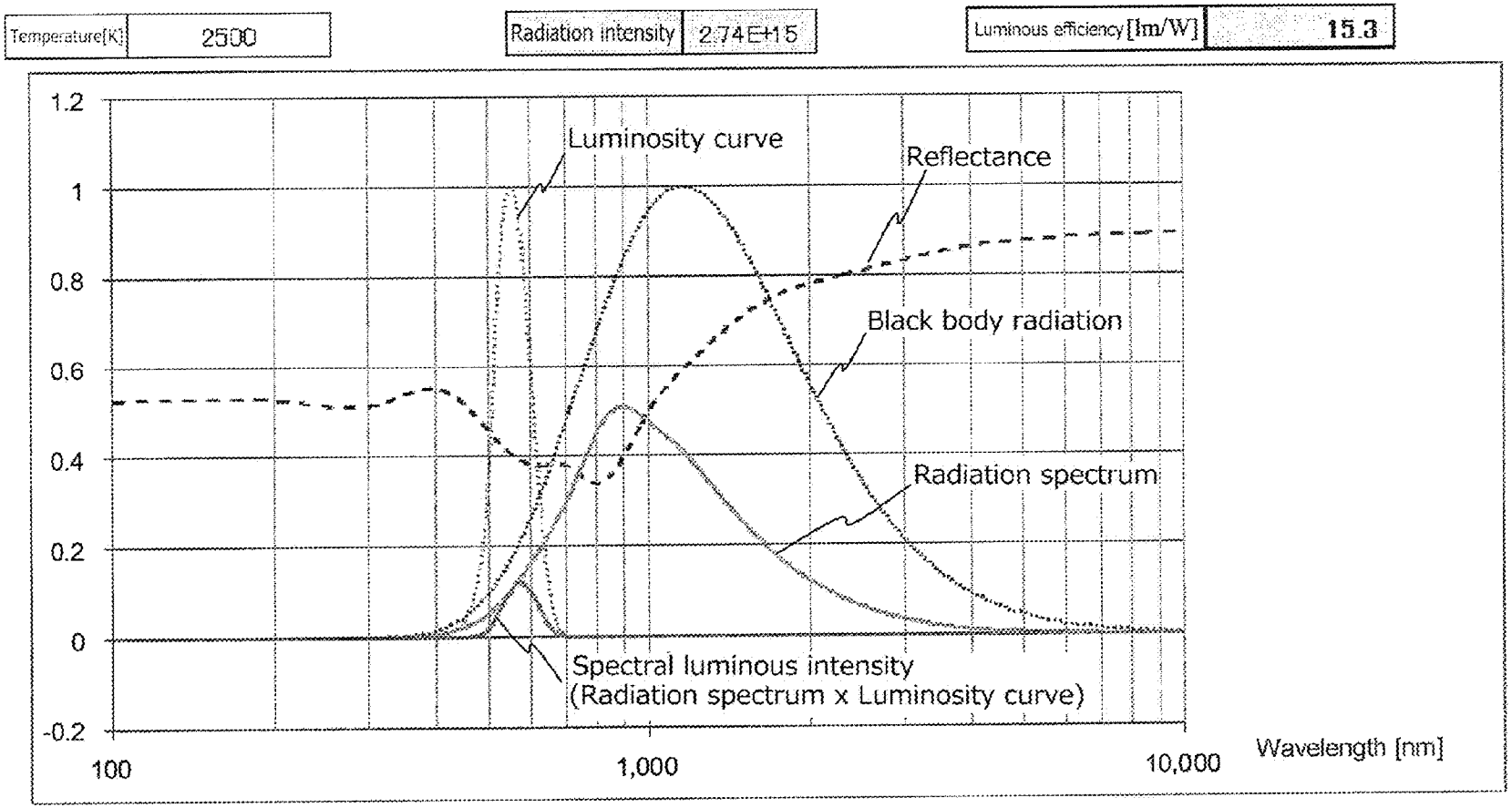
FIG. 18 is a graph showing the wavelength dependency of the reflectance, obtained radiation spectrum, and spectral luminous intensity observed for the Os substrate used in Example 2 before polishing.
Figure 19:
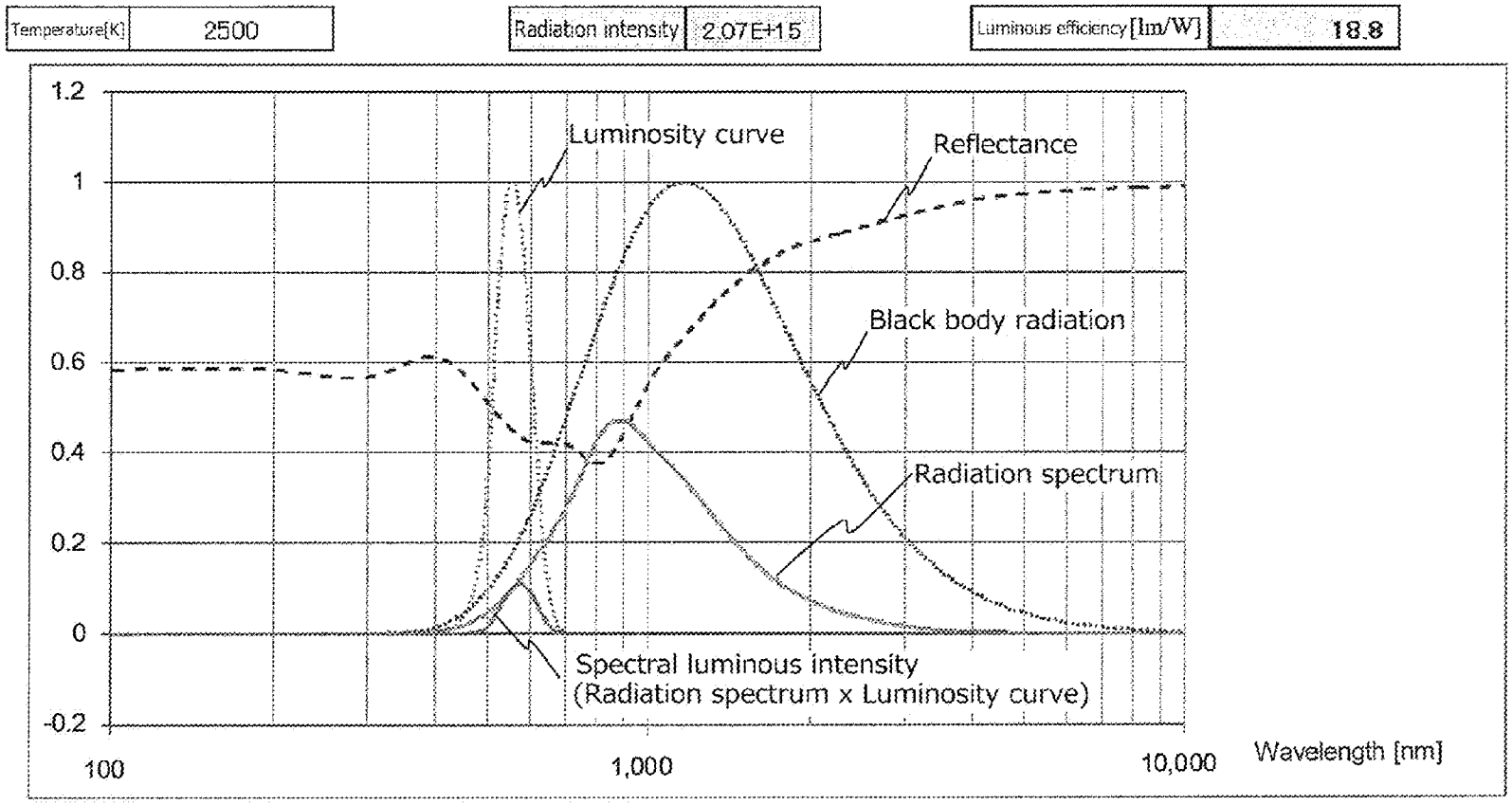
FIG. 19 is a graph showing the wavelength dependency of the reflectance, obtained radiation spectrum, and spectral luminous intensity observed for the Os substrate used in Example 2 after polishing.

FIGS. 18 and 19 show the reflectance, radiation spectra and spectral luminosity intensity of the substrates in the range where luminosity is obtained, which are for an Os substrate not polished and having a rough surface and the mirror-polished Os substrate, respectively, and were obtained by simulation and experiments. They also show black body radiation spectra and luminosity curves. The both are for a temperature of 2500K.

As shown in FIG. 19, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 18. The emissivity for the infrared wavelength region was suppressed correspondingly to the improvement of the reflectance. As a result, the luminous efficiency (radiation efficiency for visible lights) was increased from 15.3 lm/W to 18.8 lm/W, i.e., improved by 23%.

Figure 20:
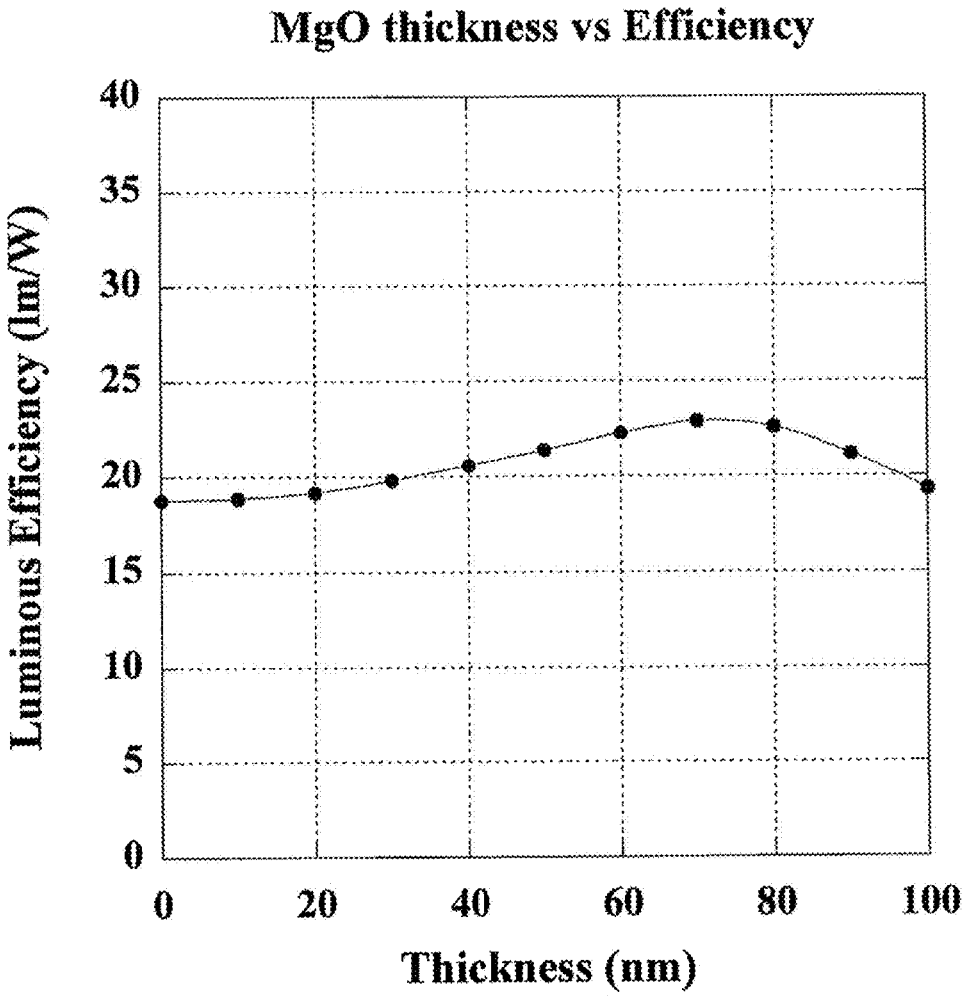
FIG. 20 is a graph showing the film thickness dependency of the luminous efficiency of the filament of Example 2-1 comprising an Os substrate and a visible light reflectance-reducing film (MgO film).

According to the presently disclosed subject matter, a visible light reflectance-reducing film is formed on the surface of the mirror-polished substrate to reduce the visible light reflectance. In Example 2-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 20. From the results shown in FIG. 20, the optimal thickness of the MgO film was determined to be 70 nm. The luminous efficiency for visible lights of the filament coated with the MgO film having the optimal thickness of 70 nm was 22.9 lm/W.

Figure 21:
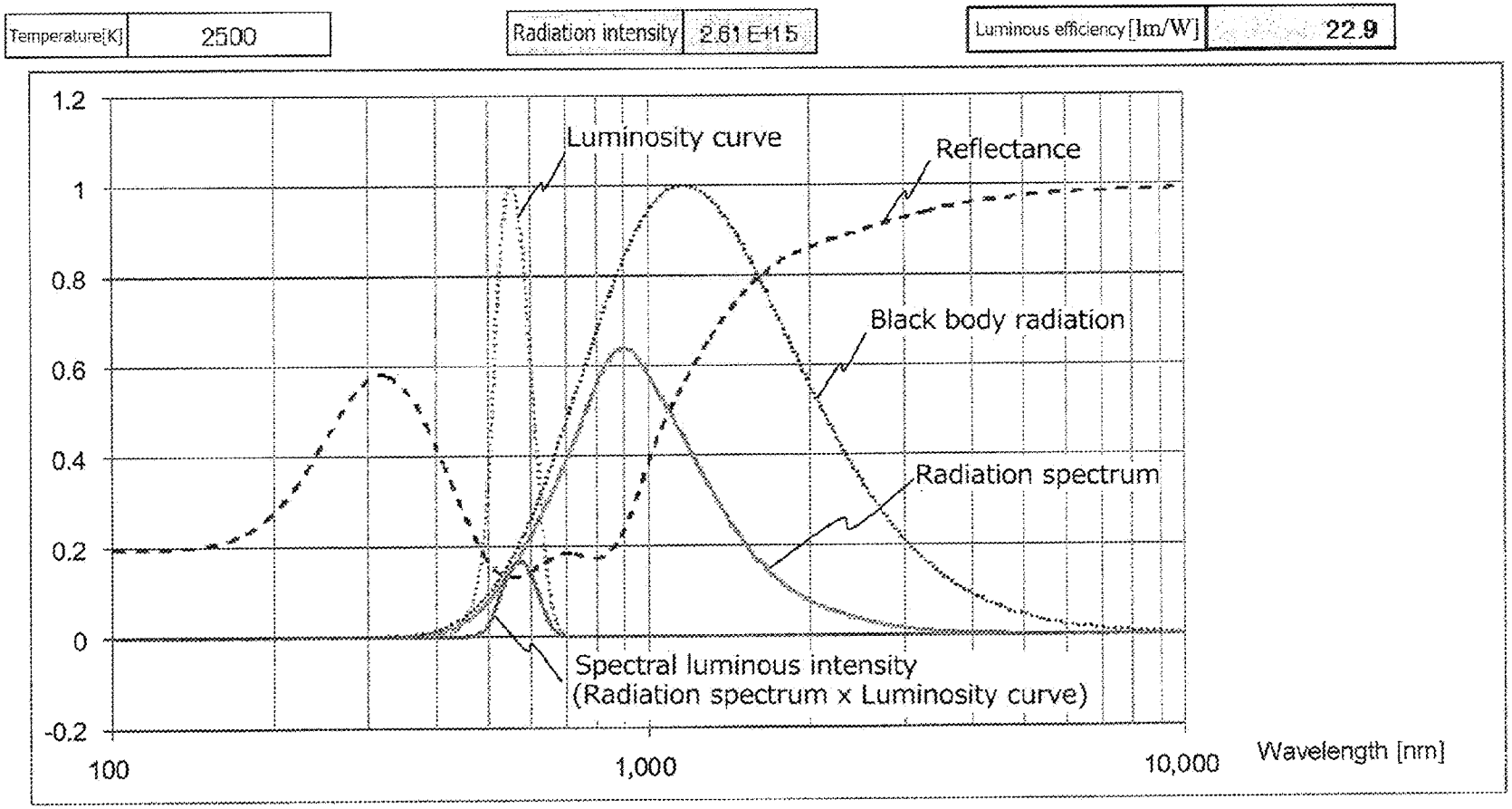
FIG. 21 is a graph showing the wavelength dependency of the reflectance, obtained radiation spectrum, and spectral luminous intensity of the filament of Example 2-1 comprising an Os substrate and a visible light reflectance-reducing film (MgO film).

FIG. 21 shows the reflectance, radiation spectrum, and spectral luminous intensity of the substrate in the range where luminosity is obtained, which were obtained for the Os substrate (filament) coated with an MgO film of 70 nm thickness by simulation and experiments. From comparison of the reflectance shown in FIG. 21 with the reflectance shown in FIG. 19 observed before forming the MgO film, it can be seen that the reflectance for the visible region was markedly reduced by the formation of the MgO film, i.e., around 40% of the reflectance of the Os substrate observed before the formation of the MgO film was decreased to about 15% by the coating with the MgO film. As a result, the visible luminous efficiency of 18.8 lm/W could be improved to 22.9 lm/W, i.e., improved by 22%.

As described above, in this example, by coating the Os substrate with a visible light reflectance-reducing film (MgO film), a filament for light sources and light source device showing an efficiency of about 23 lm/W at 2500K could be provided.

Examples 2-2 to 2-11

In Examples 2-2 to 2-11, the substrate was constituted with Os, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 2-2 to 2-11, the methods described in Example 2-1 can be used likewise.

Changes of the visible luminous efficiency of the filaments of Examples 2-2 to 2-11 to be observed when the thickness of the visible light reflectance-reducing film is variously changed were obtained by simulation. The results are shown in FIGS. 22 to 31, respectively.

Figure 22:
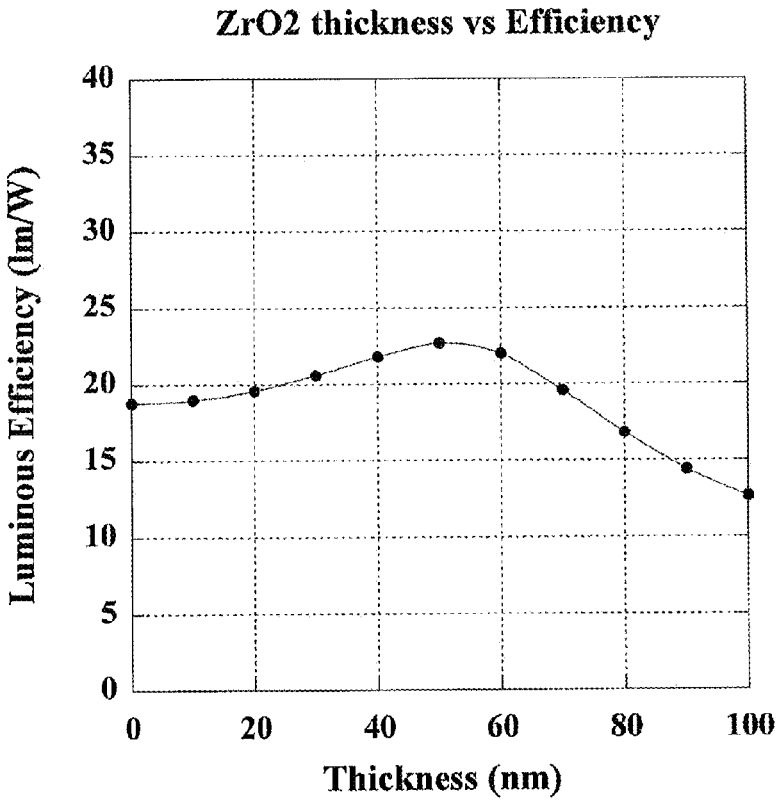
FIG. 22 is a graph showing the film thickness dependency of the luminous efficiency of the filament of Example 2-2 comprising an Os substrate and a visible light reflectance-reducing film ($ZrO_2$ film).

FIG. 22 shows the visible luminous efficiency observed in Example 2-2 using an Os substrate and a $ZrO_2$ film as the visible light reflectance-reducing film. As shown in FIG. 22, it can be seen that the maximum visible luminous efficiency of 22.7 lm/W was attained with a film thickness of 50 nm.

Figure 23:
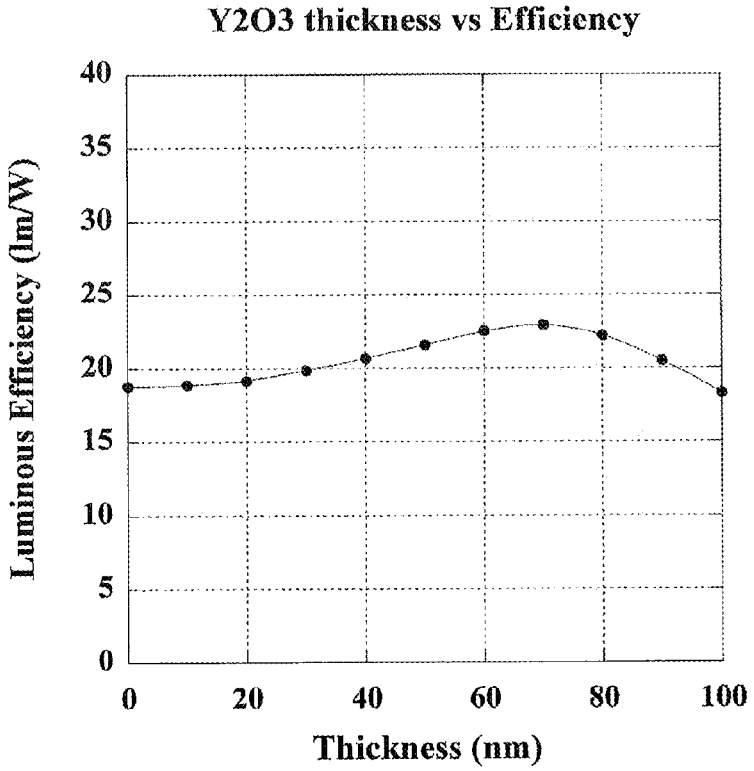
FIG. 23 is a graph showing the film thickness dependency of the luminous efficiency of the filament of Example 2-3 comprising an Os substrate and a visible light reflectance-reducing film ($Y_2O_3$ film).

FIG. 23 shows the visible luminous efficiency observed in Example 2-3 using an Os substrate and a $Y_2O_3$ film as the visible light reflectance-reducing film. As shown in FIG. 23, it can be seen that the maximum visible luminous efficiency of 22.9 lm/W was attained with a film thickness of 70 nm.

Figure 24:
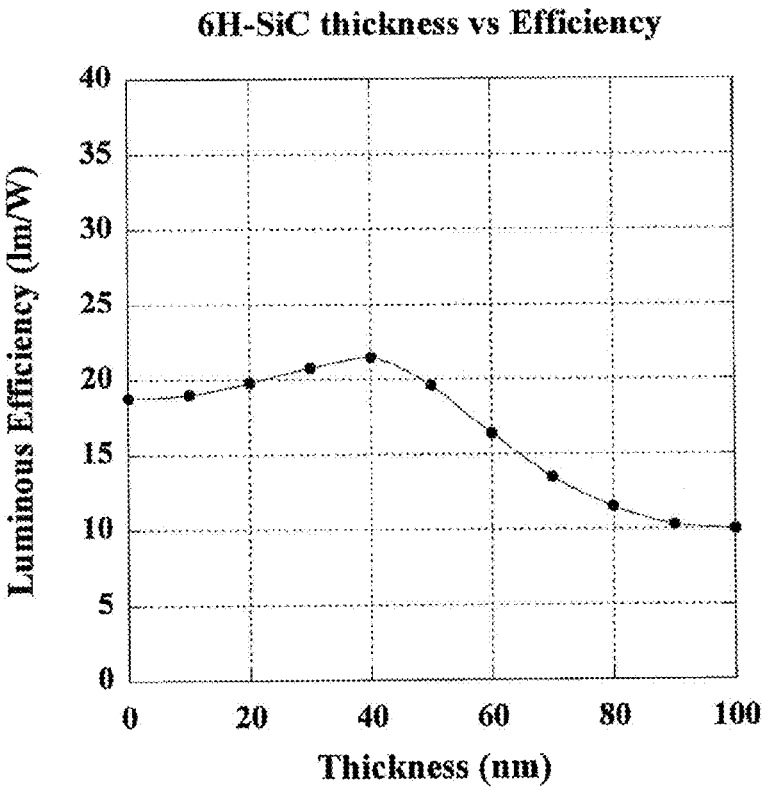
FIG. 24 is a graph showing the film thickness dependency of the luminous efficiency of the filament of Example 2-4 comprising an Os substrate and a visible light reflectance-reducing film (6H-SiC (hexagonal SiC) film).

FIG. 24 shows the visible luminous efficiency observed in Example 2-4 using an Os substrate and a 6H-SiC (hexagonal SiC) film as the visible light reflectance-reducing film. As shown in FIG. 24, it can be seen that the maximum visible luminous efficiency of 21.5 lm/W was attained with a film thickness of 40 nm.

Figure 25:
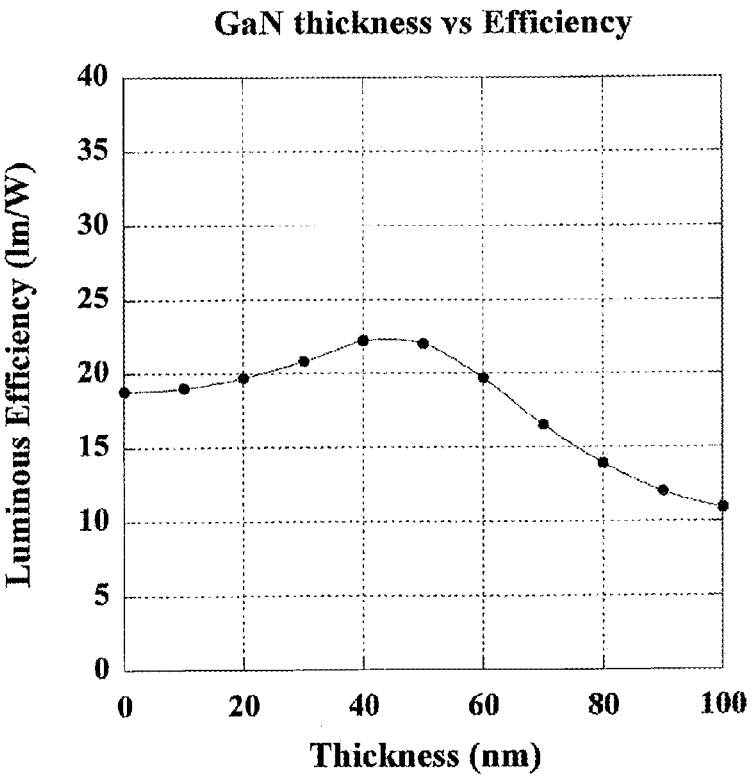
FIG. 25 is a graph showing the film thickness dependency of the luminous efficiency of the filament of Example 2-5 comprising an Os substrate and a visible light reflectance-reducing film (GaN film).

FIG. 25 shows the visible luminous efficiency observed in Example 2-5 using an Os substrate and a GaN film as the visible light reflectance-reducing film. As shown in FIG. 25, it can be seen that the maximum visible luminous efficiency of 22.2 lm/W was attained with a film thickness of 40 nm.

Figure 26:
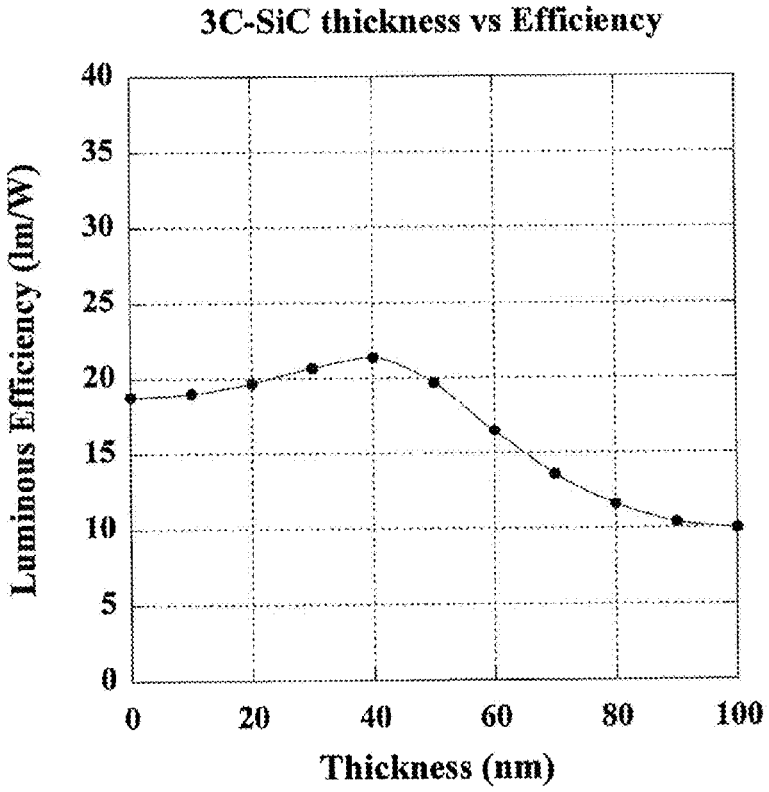
FIG. 26 is a graph showing the film thickness dependency of the luminous efficiency of the filament of Example 2-6 comprising an Os substrate and a visible light reflectance-reducing film (3C-SiC (cubic SiC) film).

FIG. 26 shows the visible luminous efficiency observed in Example 2-6 using an Os substrate and a 3C-SiC (cubic SiC) film as the visible light reflectance-reducing film. As shown in FIG. 26, it can be seen that the maximum visible luminous efficiency of 21.4 lm/W was attained with a film thickness of 40 nm.

Figure 27:
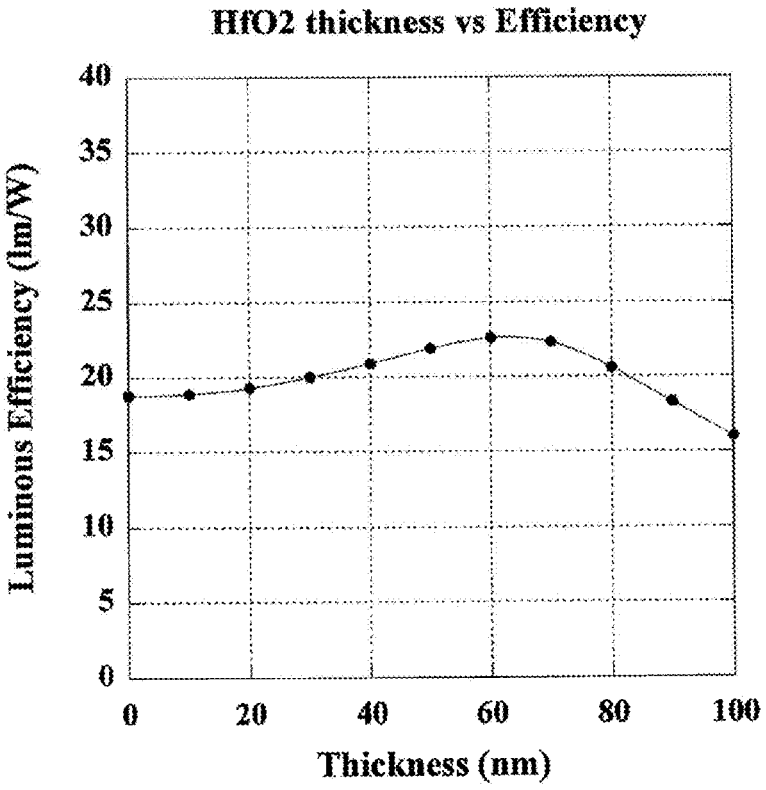
FIG. 27 is a graph showing the film thickness dependency of the luminous efficiency of the filament of Example 2-7 comprising an Os substrate and a visible light reflectance-reducing film ($HfO_2$ film).

FIG. 27 shows the visible luminous efficiency observed in Example 2-7 using an Os substrate and an $HfO_2$ film as the visible light reflectance-reducing film. As shown in FIG. 27, it can be seen that the maximum visible luminous efficiency of 22.6 lm/W was attained with a film thickness of 60 nm.

Figure 28:
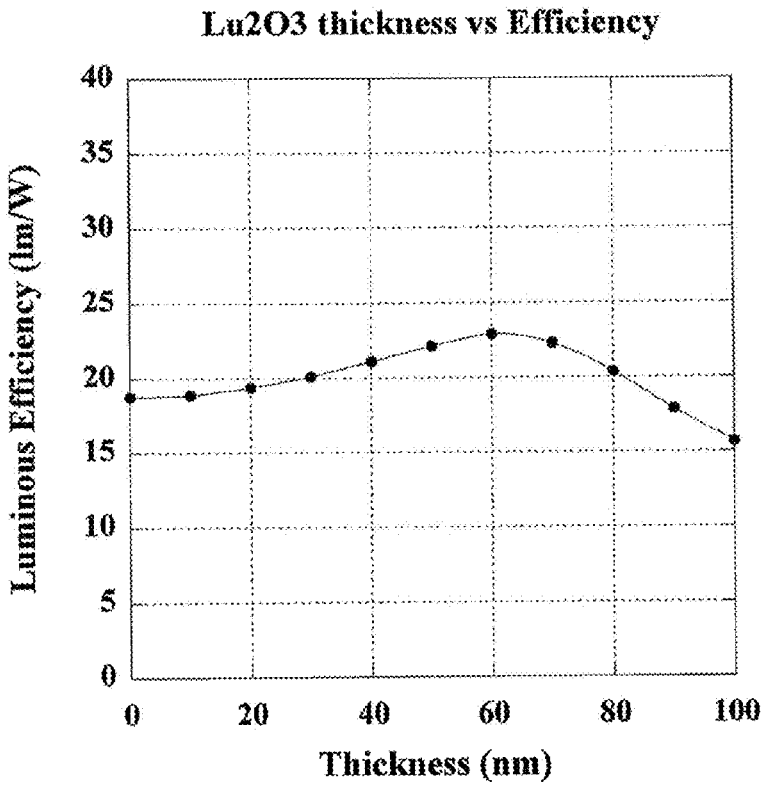
FIG. 28 is a graph showing the film thickness dependency of the luminous efficiency of the filament of Example 2-8 comprising an Os substrate and a visible light reflectance-reducing film ($Lu_2O_3$ film).

FIG. 28 shows the visible luminous efficiency observed in Example 2-8 using an Os substrate and an $Lu_2O_3$ film as the visible light reflectance-reducing film. As shown in FIG. 28, it can be seen that the maximum visible luminous efficiency of 22.9 lm/W was attained with a film thickness of 60 nm.

Figure 29:
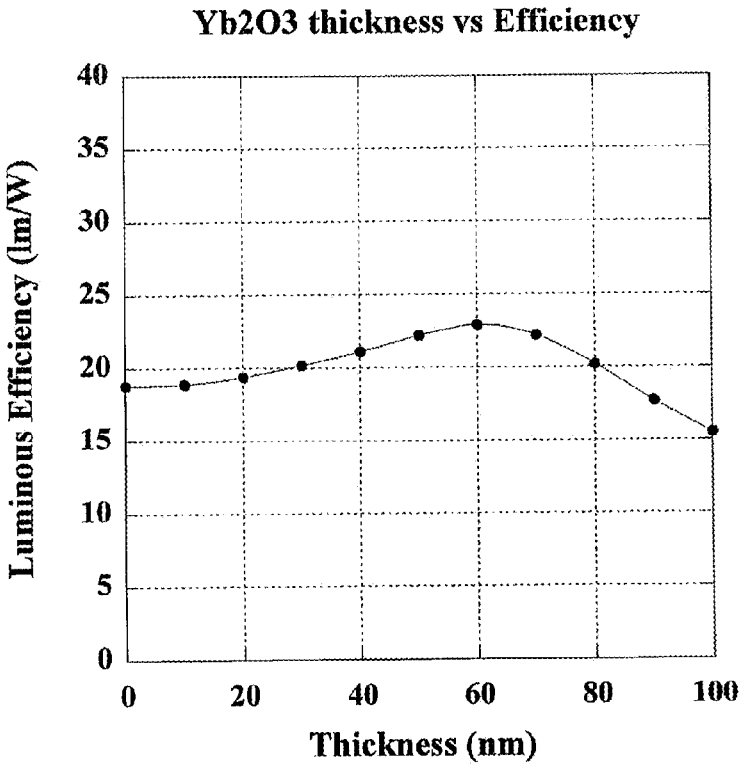
FIG. 29 is a graph showing the film thickness dependency of the luminous efficiency of the filament of Example 2-9 comprising an Os substrate and a visible light reflectance-reducing film ($Yb_2O_3$ film).

FIG. 29 shows the visible luminous efficiency observed in Example 2-9 using an Os substrate and a $Yb_2O_3$ film as the visible light reflectance-reducing film. As shown in FIG. 29, it can be seen that the maximum visible luminous efficiency of 22.9 lm/W was attained with a film thickness of 60 nm.

Figure 30:
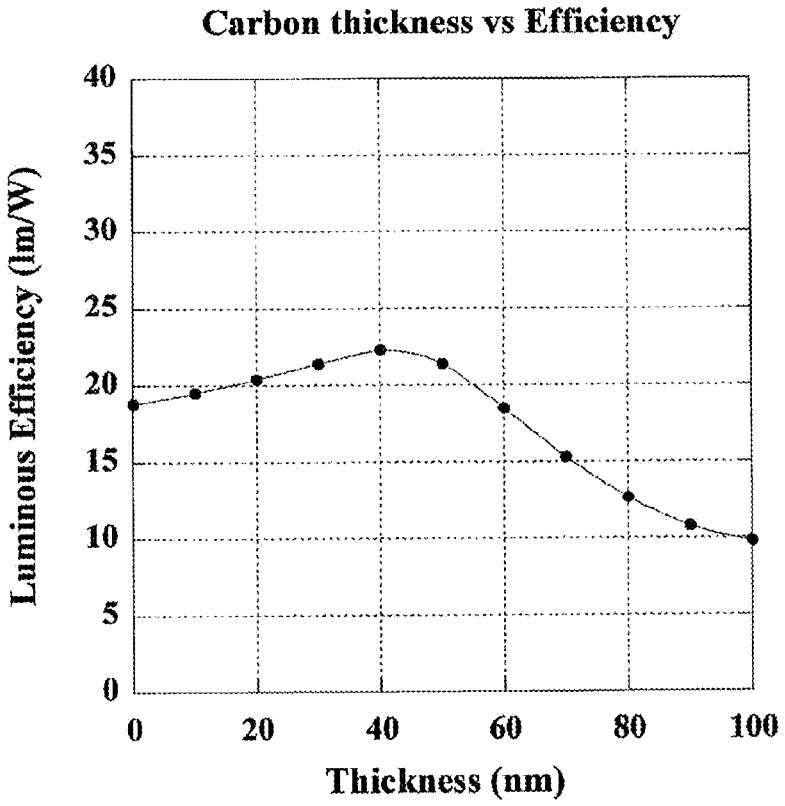
FIG. 30 is a graph showing the film thickness dependency of the luminous efficiency of the filament of Example 2-10 comprising an Os substrate and a visible light reflectance-reducing film (graphite film).

FIG. 30 shows the visible luminous efficiency observed in Example 2-10 using an Os substrate and a carbon (graphite) film as the visible light reflectance-reducing film. As shown in FIG. 30, it can be seen that the maximum visible luminous efficiency of 22.3 lm/W was attained with a film thickness of 40 nm.

Figure 31:
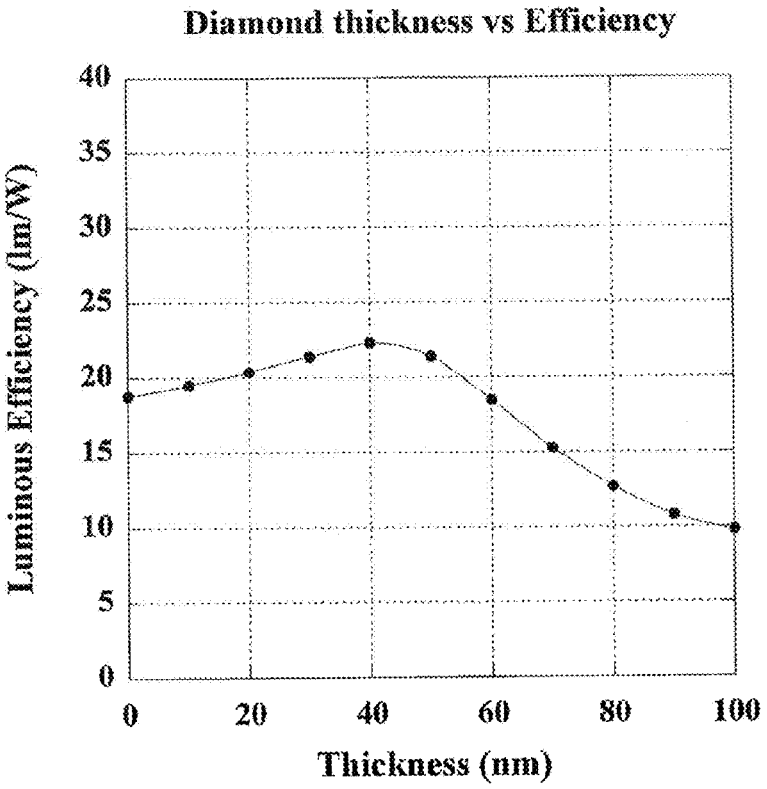
FIG. 31 is a graph showing the film thickness dependency of the luminous efficiency of the filament of Example 2-11 comprising an Os substrate and a visible light reflectance-reducing film (diamond film).

FIG. 31 shows the visible luminous efficiency observed in Example 2-11 using an Os substrate and a diamond film as the visible light reflectance-reducing film. As shown in FIG. 31, it can be seen that the maximum visible luminous efficiency of 22.3 lm/W was attained with a film thickness of 40 nm.

The results of Examples 2-1 to 2-11 are summarized as shown in FIG. 32. The values of the visible luminous efficiency of the filaments of Example 2-2 to 2-12 having the visible light reflectance-reducing film shown in FIGS. 22 to 31 are 21.5 lm/W or larger, and they were increased compared with the visible luminous efficiency of 18.8 lm/W of the mirror-polished Os substrate not having the visible light reflectance-reducing film. Therefore, the values of the visible luminous efficiency of the filaments of Example 2-2 to 2-12 could be improved by providing the visible light reflectance-reducing film, as in Example 2-1.

Example 3

Substrate: Ir

Examples 3-1 to 3-11 mentioned below are examples of constituting the substrate with Ir.

Example 3-1

In Example 3-1, there is explained a filament in which the substrate is constituted with Ir, and an MgO film is provided as a visible light reflectance-reducing film on the surface of the substrate.

The Ir substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 33:
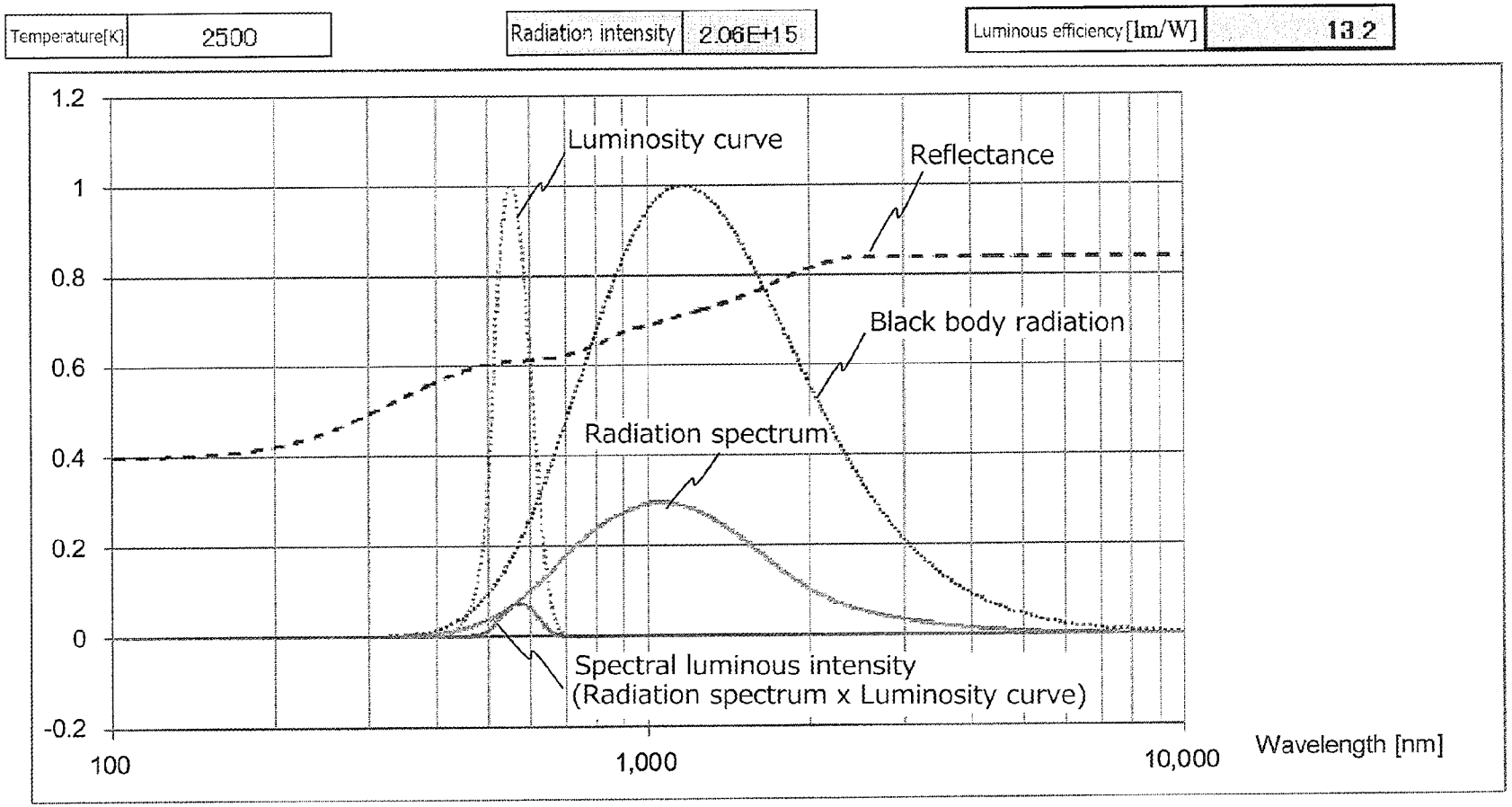
FIG. 33 is a graph showing the wavelength dependency of the reflectance, obtained radiation spectrum, and spectral luminous intensity observed for the Ir substrate used in Example 3 before polishing.
Figure 34:
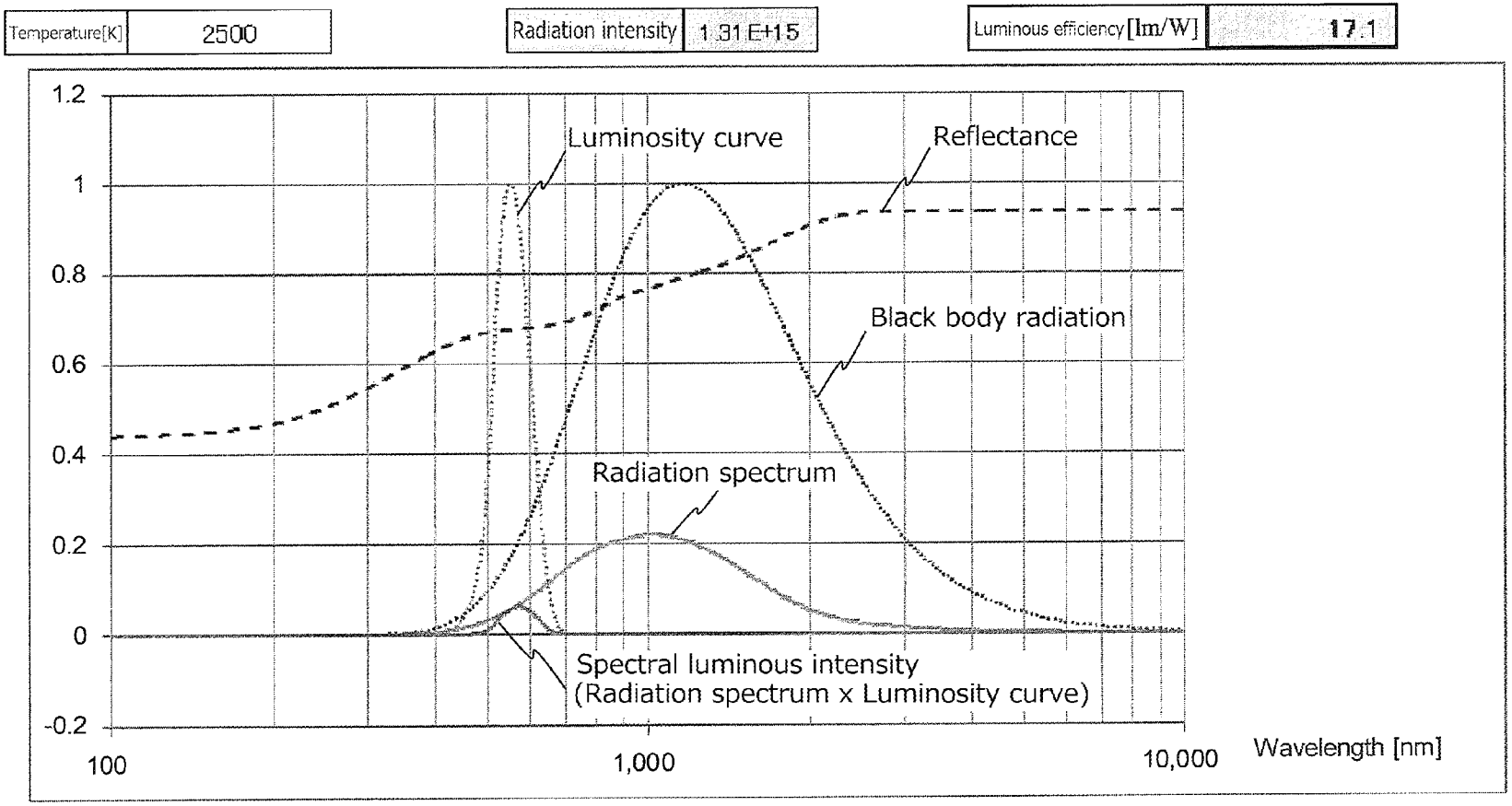
FIG. 34 is a graph showing the wavelength dependency of the reflectance, obtained radiation spectrum, and spectral luminous intensity observed for the Ir substrate used in Example 3 after polishing.

FIGS. 33 and 34 show the reflectance, radiation spectra and spectral luminosity intensity of the substrates in the range where luminosity is obtained, which are for an Ir substrate not polished and having a rough surface and the mirror-polished Ir substrate, respectively, and were obtained by simulation and experiments. They also show black body radiation spectra and luminosity curves. The both are for a temperature of 2500K.

As shown in FIG. 34, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 33. The emissivity for the infrared wavelength region was suppressed correspondingly to the improvement of the reflectance. As a result, the luminous efficiency (radiation efficiency for visible lights) was increased from 13.2 lm/W to 17.1 lm/W, i.e., improved by 30%.

Figure 35:
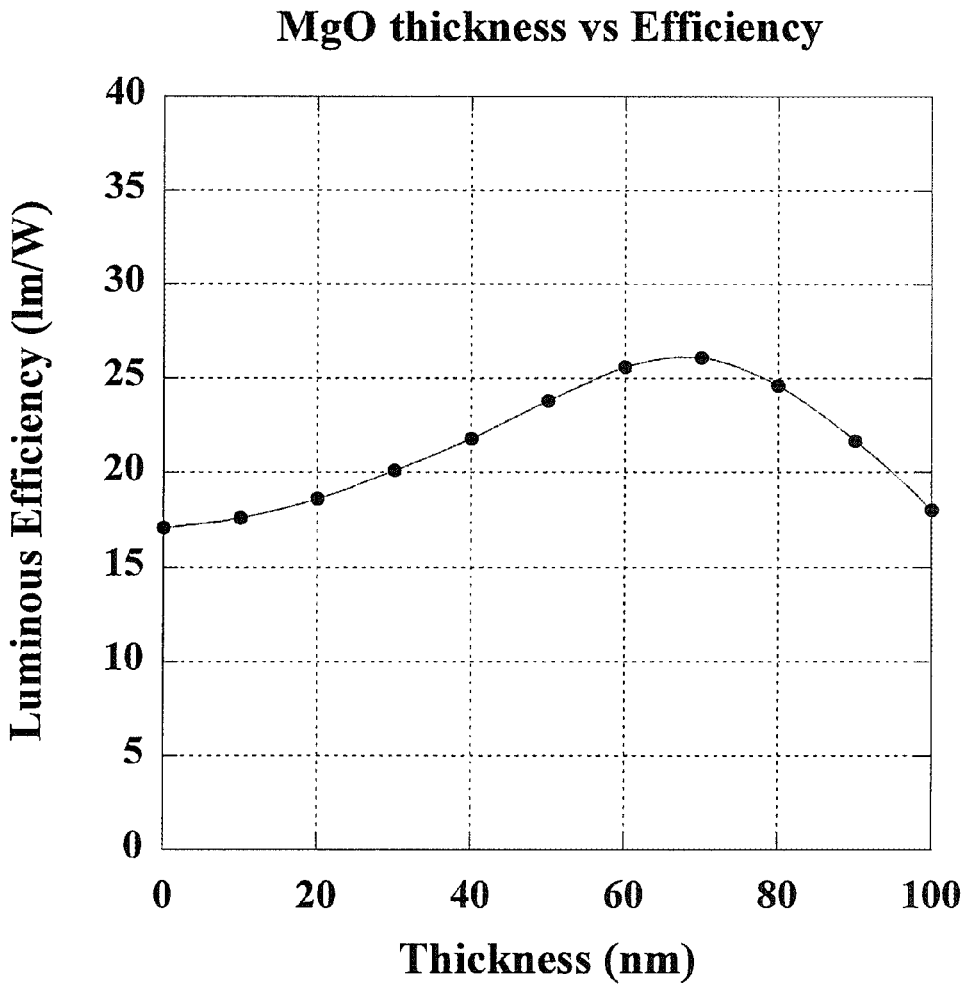
FIG. 35 is a graph showing the film thickness dependency of the luminous efficiency of the filament of Example 3-1 comprising an Ir substrate and a visible light reflectance-reducing film (MgO film).

According to the presently disclosed subject matter, a visible light reflectance-reducing film is formed on the surface of the mirror-polished substrate to reduce the visible light reflectance. In Example 3-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 35. From the results shown in FIG. 35, the optimal thickness of the MgO film was determined to be 70 nm. The luminous efficiency for visible lights of the filament coated with the MgO film having the optimal thickness of 70 nm was 26.1 lm/W.

Figure 36:
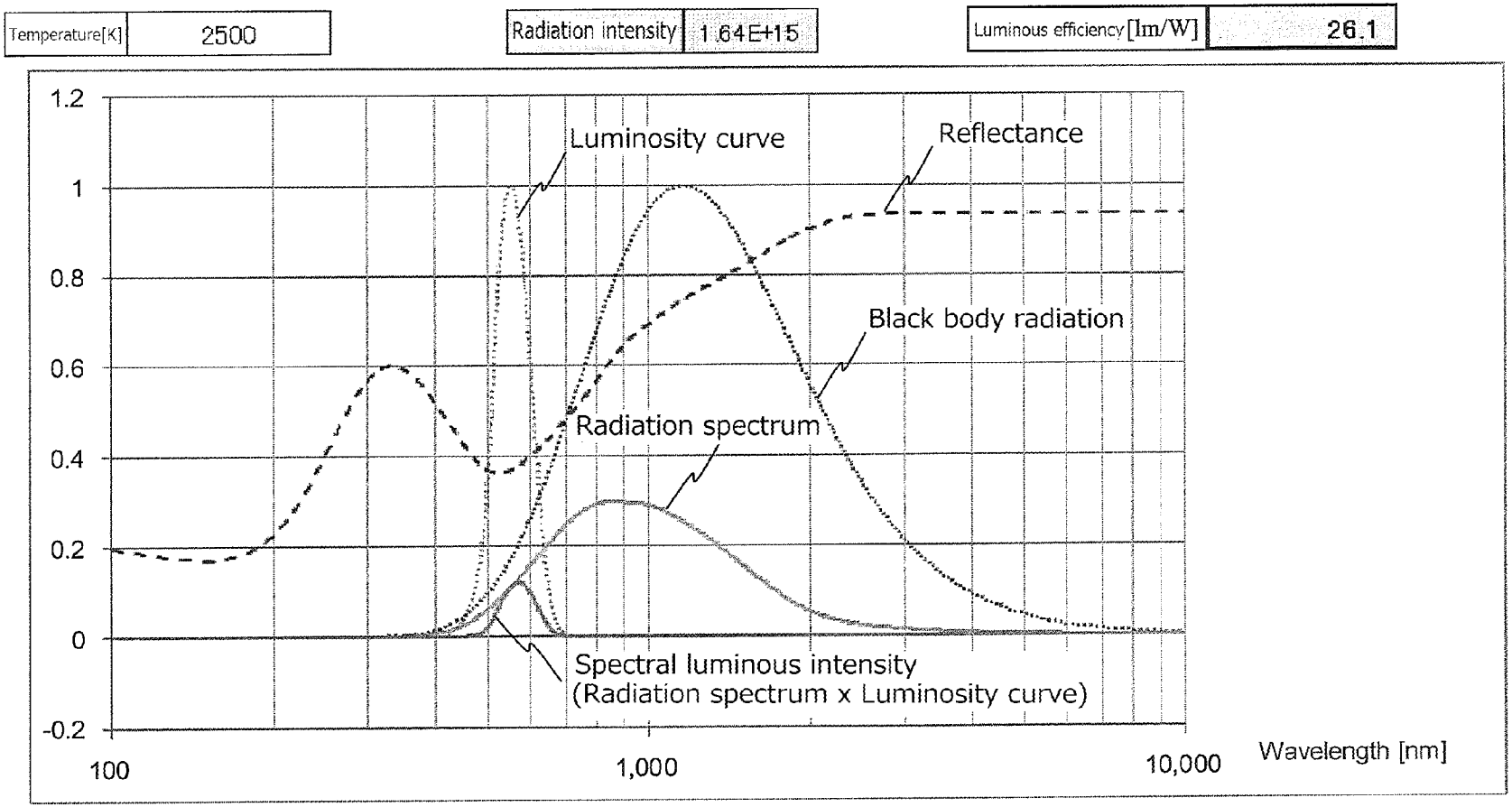
FIG. 36 is a graph showing the wavelength dependency of the reflectance, obtained radiation spectrum, and spectral luminous intensity of the filament of Example 3-1 comprising an Ir substrate and a visible light reflectance-reducing film (MgO film).

FIG. 36 shows the reflectance, radiation spectrum, and spectral luminous intensity of the substrate in the range where luminosity is obtained, which were obtained for the Ir substrate (filament) coated with an MgO film of 70 nm thickness by simulation and experiments. From comparison of the reflectance shown in FIG. 36 with the reflectance shown in FIG. 34 observed before forming the MgO film, it can be seen that the reflectance for the visible region was markedly reduced by the formation of the MgO film, i.e., around 70% of the reflectance of the Ir substrate observed before the formation of the MgO film was decreased to about 35% by the coating with the MgO film. As a result, the visible luminous efficiency of 17.1 lm/W could be improved to 26.1 lm/W, i.e., improved by 53%.

As described above, in this example, by coating the Ir substrate with a visible light reflectance-reducing film (MgO film), a filament for light sources and light source device showing an efficiency of about 26 lm/W at 2500K could be provided.

Examples 3-2 to 3-11

In Examples 3-2 to 3-11, the substrate was constituted with Ir, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 3-2 to 3-11, the methods described in Example 3-1 can be used likewise.

Changes of the visible luminous efficiency of the filaments of Examples 3-2 to 3-11 to be observed when the thickness of the visible light reflectance-reducing film is variously changed were obtained by simulation. The results are shown in FIGS. 37 to 46, respectively.

Figure 37:
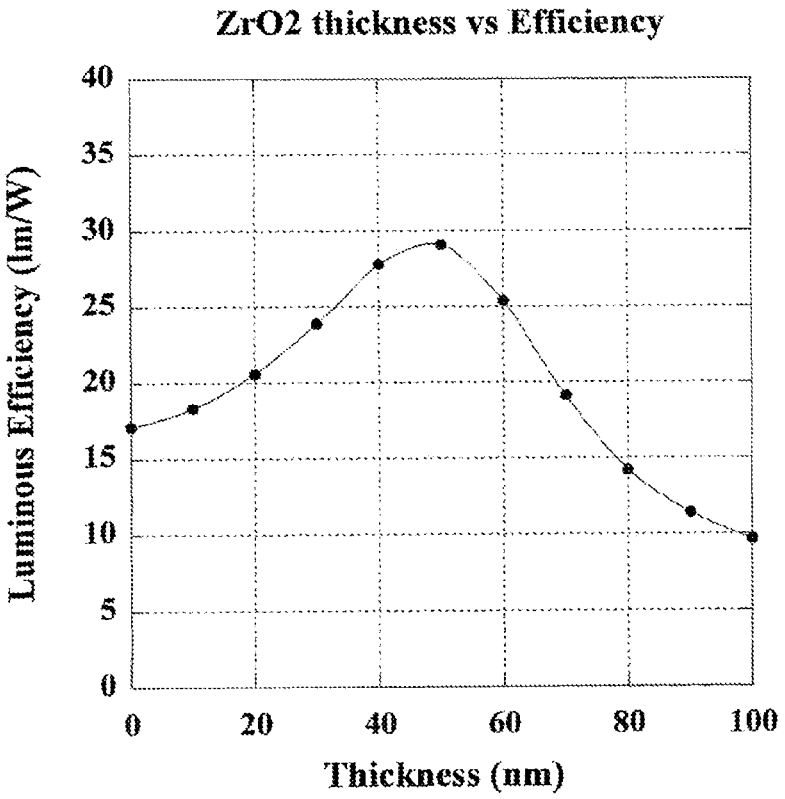
FIG. 37 is a graph showing the film thickness dependency of the luminous efficiency of the filament of Example 3-2 comprising an Ir substrate and a visible light reflectance-reducing film ($ZrO_2$ film).

FIG. 37 shows the visible luminous efficiency observed in Example 3-2 using an Ir substrate and a $ZrO_2$ film as the visible light reflectance-reducing film. As shown in FIG. 37, it can be seen that the maximum visible luminous efficiency of 29.1 lm/W was attained with a film thickness of 50 nm.

Figure 38:
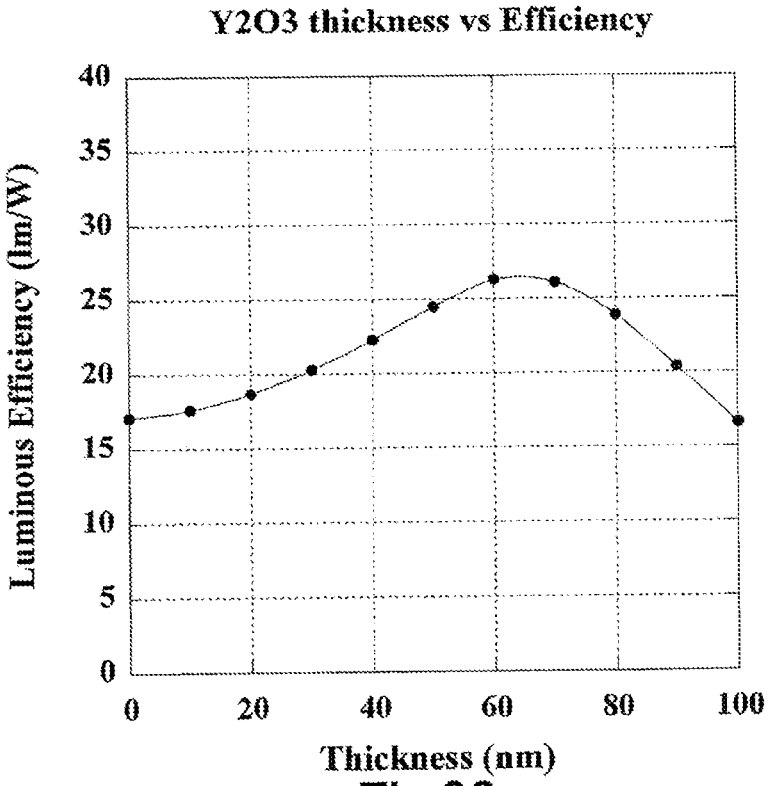
FIG. 38 is a graph showing the film thickness dependency of the luminous efficiency of the filament of Example 3-3 comprising an Ir substrate and a visible light reflectance-reducing film ($Y_2O_3$ film).

FIG. 38 shows the visible luminous efficiency observed in Example 3-3 using an Ir substrate and a $Y_2O_3$ film as the visible light reflectance-reducing film. As shown in FIG. 38, it can be seen that the maximum visible luminous efficiency of 26.3 lm/W was attained with a film thickness of 60 nm.

Figure 39:
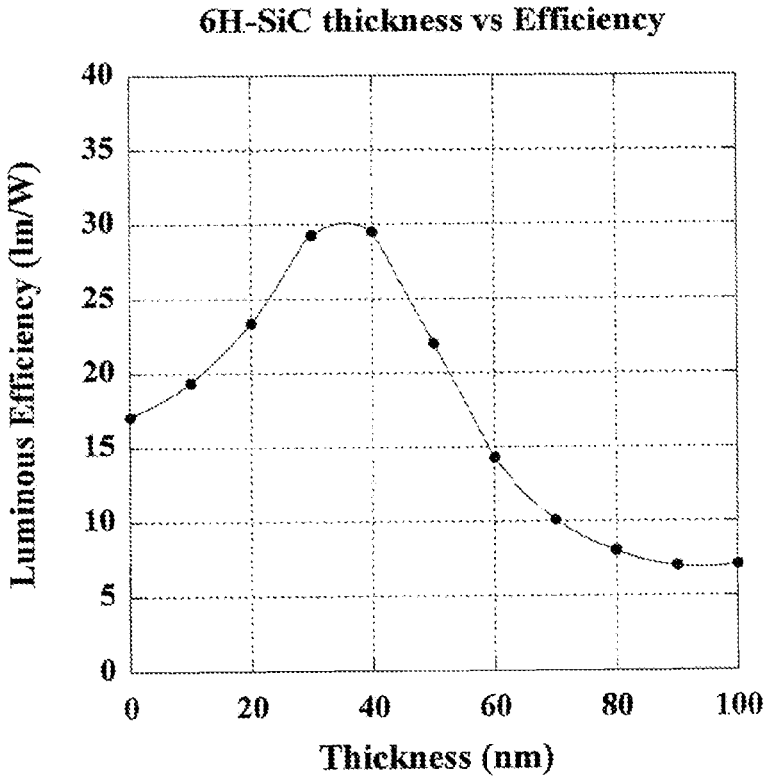
FIG. 39 is a graph showing the film thickness dependency of the luminous efficiency of the filament of Example 3-4 comprising an Ir substrate and a visible light reflectance-reducing film (6H-SiC (hexagonal SiC) film).

FIG. 39 shows the visible luminous efficiency observed in Example 3-4 using an Ir substrate and a 6H-SiC (hexagonal SiC) film as the visible light reflectance-reducing film. As shown in FIG. 39, it can be seen that the maximum visible luminous efficiency of 29.5 lm/W was attained with a film thickness of 40 nm.

Figure 40:
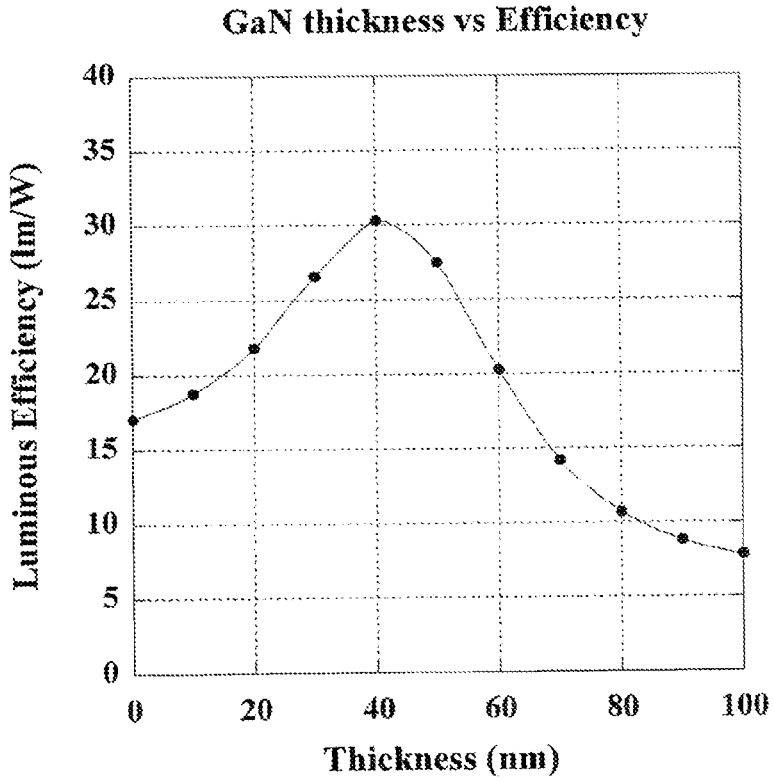
FIG. 40 is a graph showing the film thickness dependency of the luminous efficiency of the filament of Example 3-5 comprising an Ir substrate and a visible light reflectance-reducing film (GaN film).

FIG. 40 shows the visible luminous efficiency observed in Example 3-5 using an Ir substrate and a GaN film as the visible light reflectance-reducing film. As shown in FIG. 40, it can be seen that the maximum visible luminous efficiency of 30.3 lm/W was attained with a film thickness of 40 nm.

Figure 41:
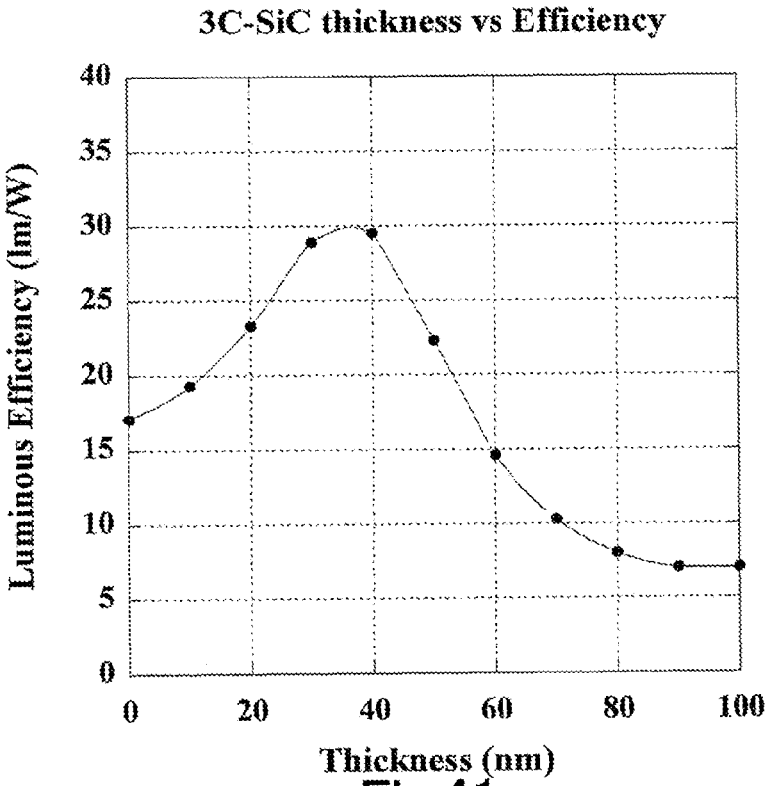
FIG. 41 is a graph showing the film thickness dependency of the luminous efficiency of the filament of Example 3-6 comprising an Ir substrate and a visible light reflectance-reducing film (3C-SiC (cubic SiC) film).

FIG. 41 shows the visible luminous efficiency observed in Example 3-6 using an Ir substrate and a 3C-SiC (cubic SiC) film as the visible light reflectance-reducing film. As shown in FIG. 41, it can be seen that the maximum visible luminous efficiency of 29.5 lm/W was attained with a film thickness of 40 nm.

Figure 42:
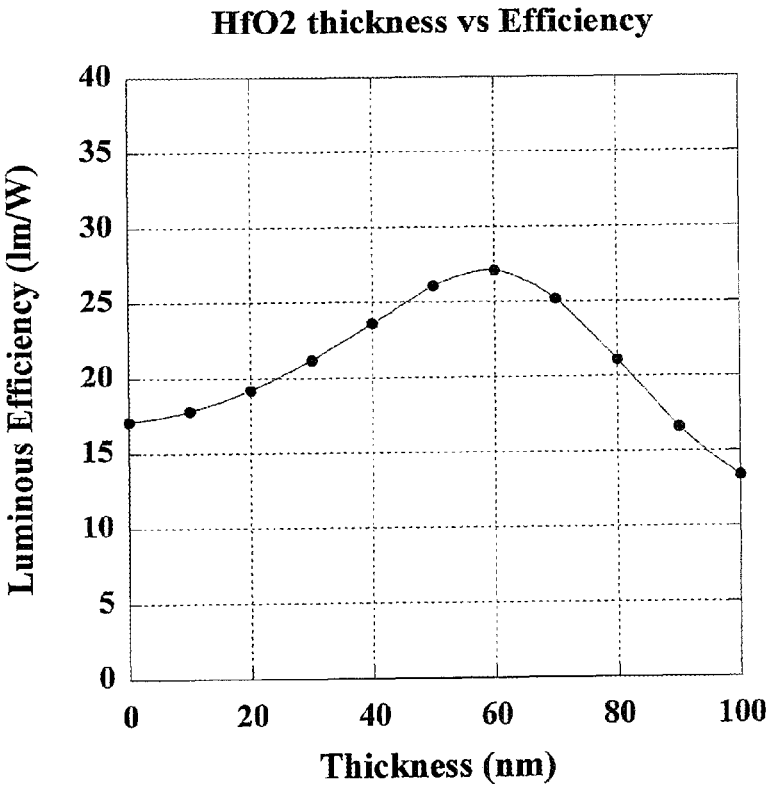
FIG. 42 is a graph showing the film thickness dependency of the luminous efficiency of the filament of Example 3-7 comprising an Ir substrate and a visible light reflectance-reducing film ($HfO_2$ film).

FIG. 42 shows the visible luminous efficiency observed in Example 3-7 using an Ir substrate and an $HfO_2$ film as the visible light reflectance-reducing film. As shown in FIG. 42, it can be seen that the maximum visible luminous efficiency of 27.1 lm/W was attained with a film thickness of 60 nm.

Figure 43:
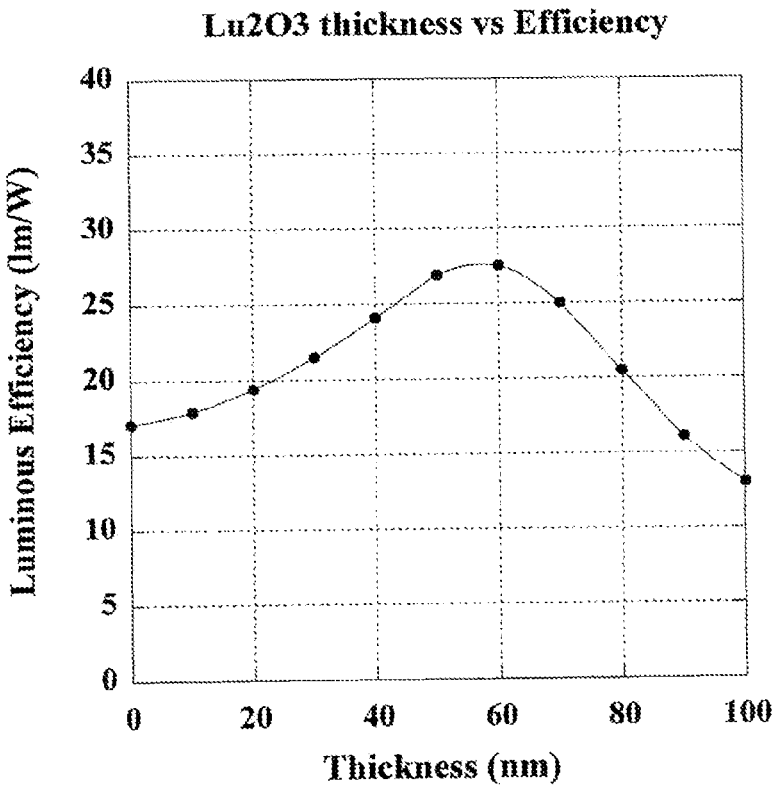
FIG. 43 is a graph showing the film thickness dependency of the luminous efficiency of the filament of Example 3-8 comprising an Ir substrate and a visible light reflectance-reducing film ($Lu_2O_3$ film).

FIG. 43 shows the visible luminous efficiency observed in Example 3-8 using an Ir substrate and an $Lu_2O_3$ film as the visible light reflectance-reducing film. As shown in FIG. 43, it can be seen that the maximum visible luminous efficiency of 27.5 lm/W was attained with a film thickness of 60 nm.

Figure 44:
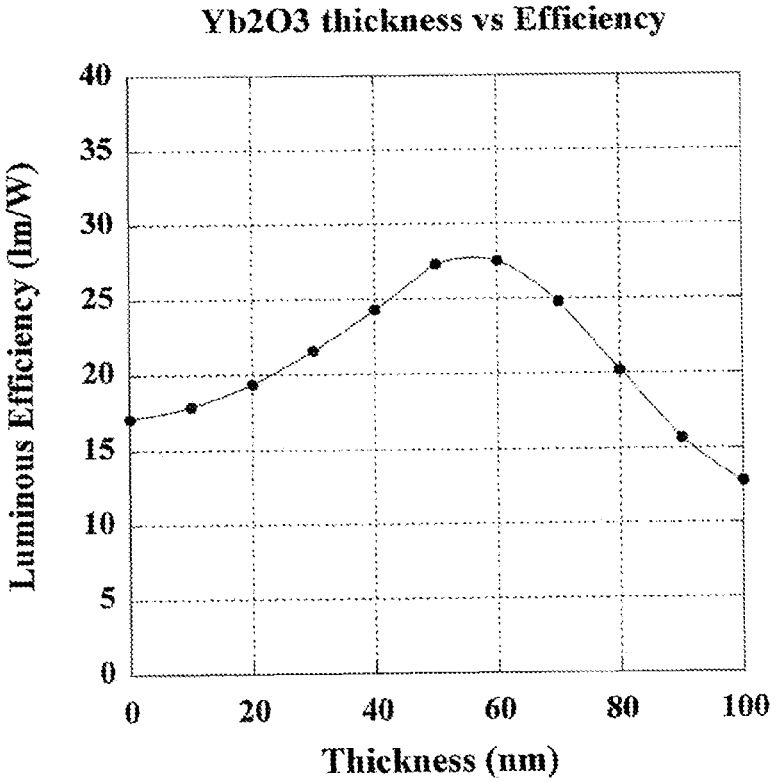
FIG. 44 is a graph showing the film thickness dependency of the luminous efficiency of the filament of Example 3-9 comprising an Ir substrate and a visible light reflectance-reducing film ($Yb_2O_3$ film).

FIG. 44 shows the visible luminous efficiency observed in Example 3-9 using an Ir substrate and a $Yb_2O_3$ film as the visible light reflectance-reducing film. As shown in FIG. 44, it can be seen that the maximum visible luminous efficiency of 27.5 lm/W was attained with a film thickness of 60 nm.

Figure 45:
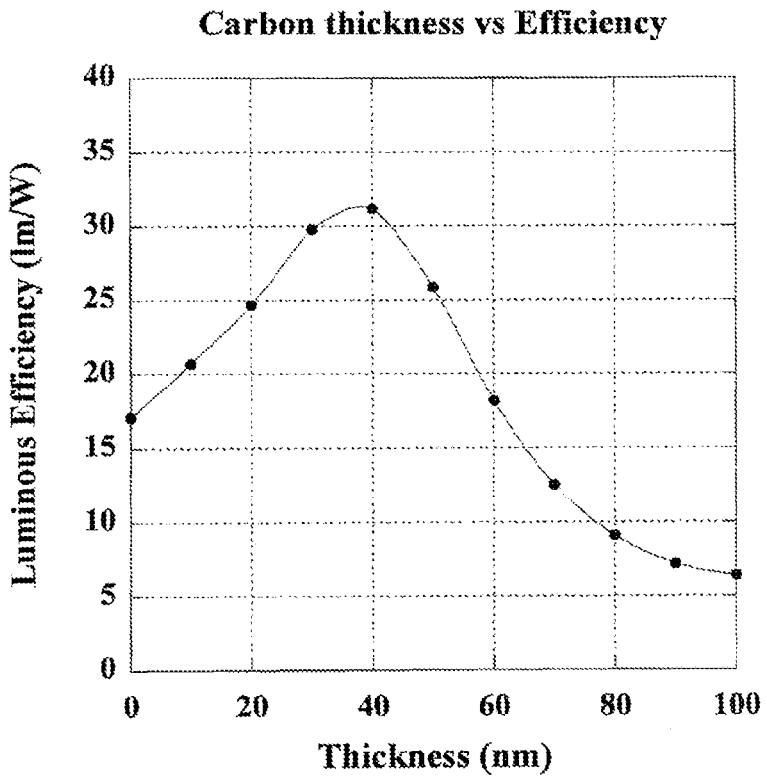
FIG. 45 is a graph showing the film thickness dependency of the luminous efficiency of the filament of Example 3-10 comprising an Ir substrate and a visible light reflectance-reducing film (graphite film).

FIG. 45 shows the visible luminous efficiency observed in Example 3-10 using an Ir substrate and a carbon (graphite) film as the visible light reflectance-reducing film. As shown in FIG. 45, it can be seen that the maximum visible luminous efficiency of 31.2 lm/W was attained with a film thickness of 40 nm.

Figure 46:
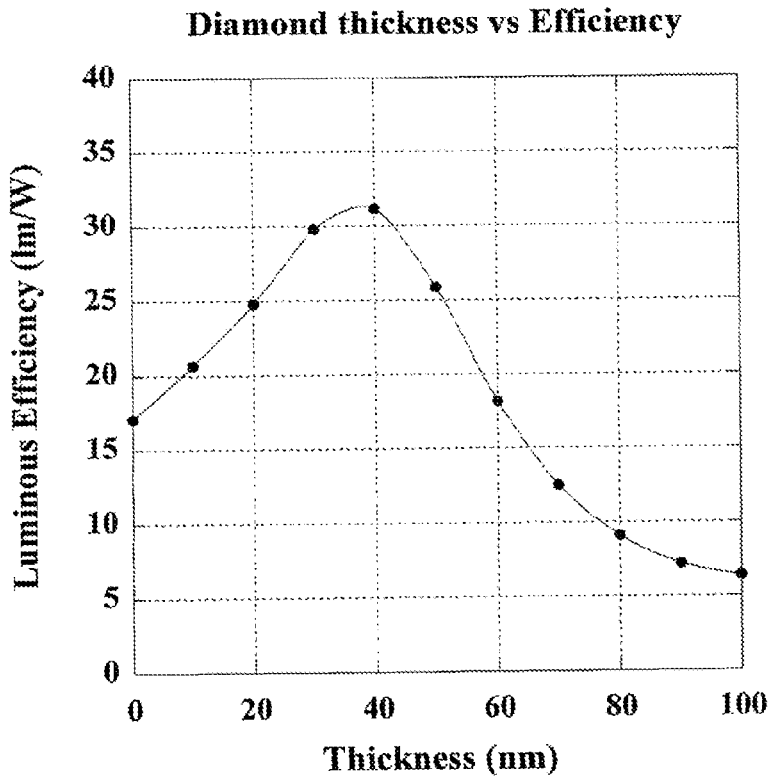
FIG. 46 is a graph showing the film thickness dependency of the luminous efficiency of the filament of Example 3-11 comprising an Ir substrate and a visible light reflectance-reducing film (diamond film).

FIG. 46 shows the visible luminous efficiency observed in Example 3-11 using an Os substrate and a diamond film as the visible light reflectance-reducing film. As shown in FIG. 46, it can be seen that the maximum visible luminous efficiency of 31.2 lm/W was attained with a film thickness of 40 nm.

The results of Examples 3-1 to 3-11 are summarized as shown in FIG. 47. The values of the visible luminous efficiency of the filaments of Example 3-2 to 3-12 having the visible light reflectance-reducing film shown in FIGS. 37 to 46 are 26.1 lm/W or larger, and they were increased compared with the visible luminous efficiency 17.1 lm/W of the mirror-polished Ir substrate not having the visible light reflectance-reducing film. Therefore, the values of the visible luminous efficiency of the filaments of Example 3-2 to 3-12 could be improved by providing the visible light reflectance-reducing film, as in Example 3-1.

Example 4

Substrate: Mo

Examples 4-1 to 4-11 mentioned below are examples of constituting the substrate with Mo.

Example 4-1

In Example 4-1, there is explained a filament in which the substrate is constituted with Mo, and an MgO film is provided as a visible light reflectance-reducing film on the surface of the substrate.

The Mo substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 48:
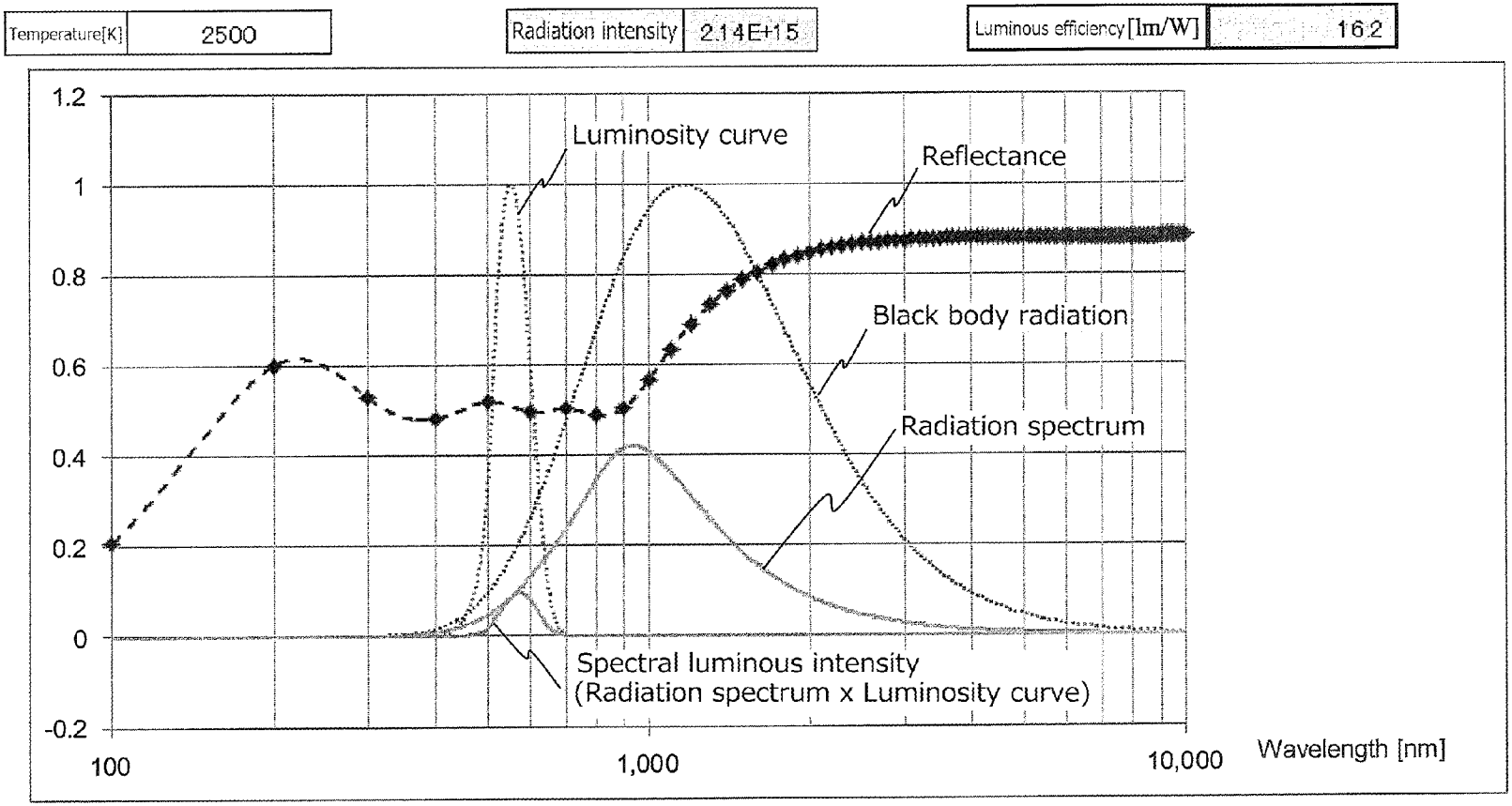
FIG. 48 is a graph showing the wavelength dependency of the reflectance, obtained radiation spectrum, and spectral luminous intensity observed for the Mo substrate used in Example 4 before polishing.
Figure 49:
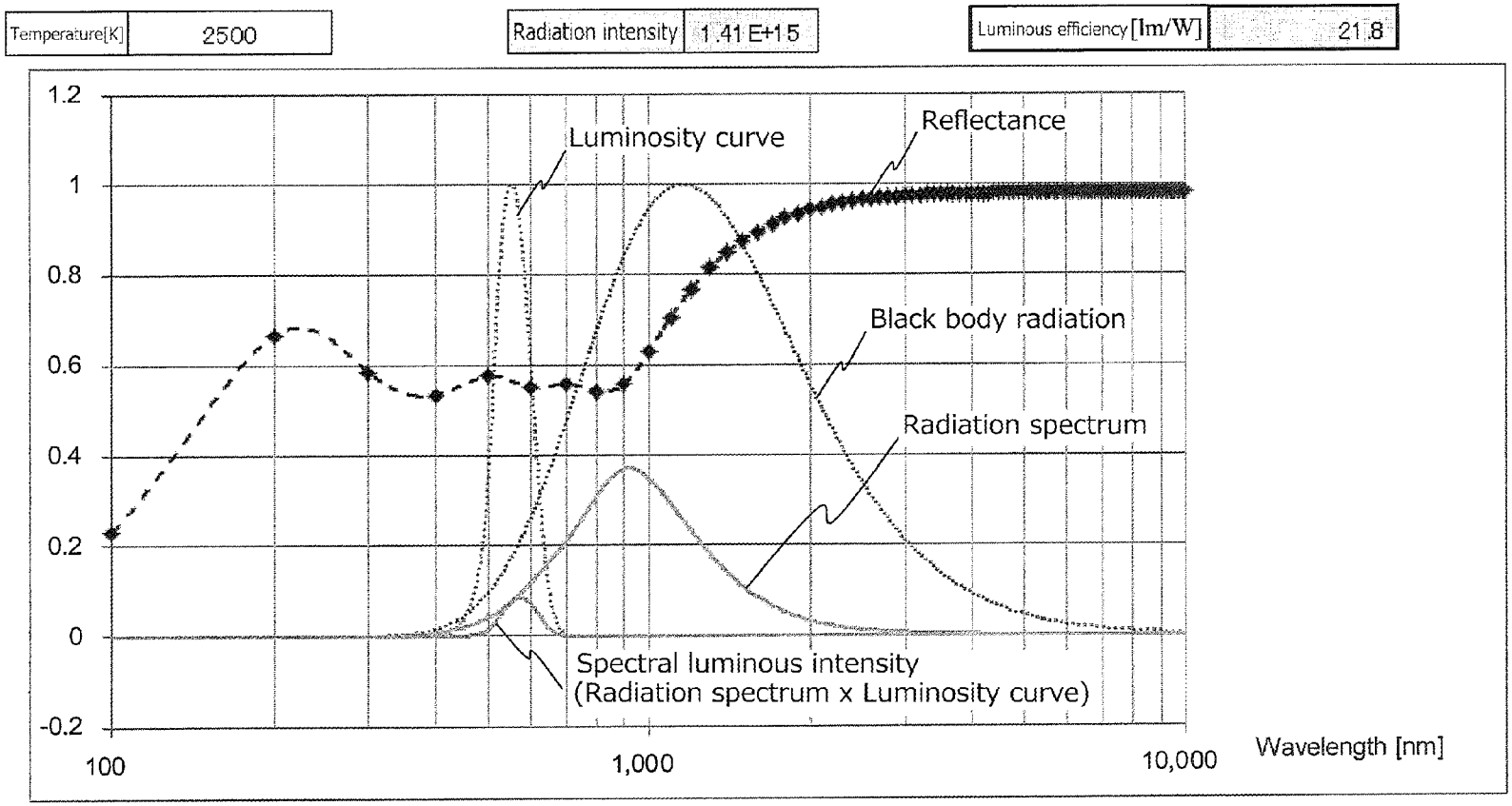
FIG. 49 is a graph showing the wavelength dependency of the reflectance, obtained radiation spectrum, and spectral luminous intensity observed for the Mo substrate used in Example 4 after polishing.

FIGS. 48 and 49 show the reflectance, radiation spectra and spectral luminosity intensity of the substrates in the range where luminosity is obtained, which are for an Mo substrate not polished and having a rough surface and the mirror-polished Mo substrate, respectively, and were obtained by simulation and experiments. The both are for a temperature of 2500K.

As shown in FIG. 49, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 48. The emissivity for the infrared wavelength region was suppressed correspondingly to the improvement of the reflectance. As a result, the luminous efficiency (radiation efficiency for visible lights) was increased from 16.2 lm/W to 21.8 lm/W, i.e., improved by 35%.

Figure 50:
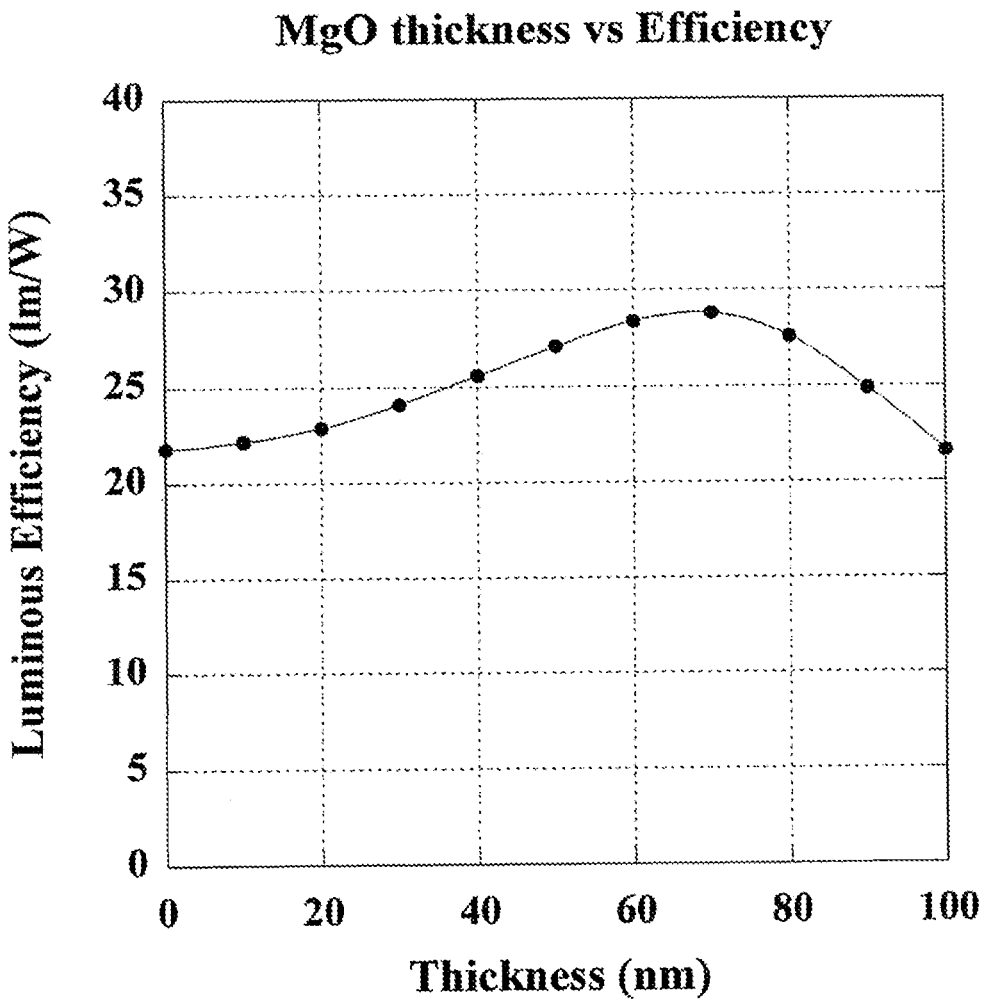
FIG. 50 is a graph showing the film thickness dependency of the luminous efficiency of the filament of Example 4-1 comprising an Mo substrate and a visible light reflectance-reducing film (MgO film).

According to the presently disclosed subject matter, a visible light reflectance-reducing film is formed on the surface of the mirror-polished substrate to reduce the visible light reflectance. In Example 4-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 50. From the results shown in FIG. 50, the optimal thickness of the MgO film was determined to be 70 nm. The luminous efficiency for visible lights of the filament coated with the MgO film having the optimal thickness of 70 nm was 28.8 lm/W.

Figure 51:
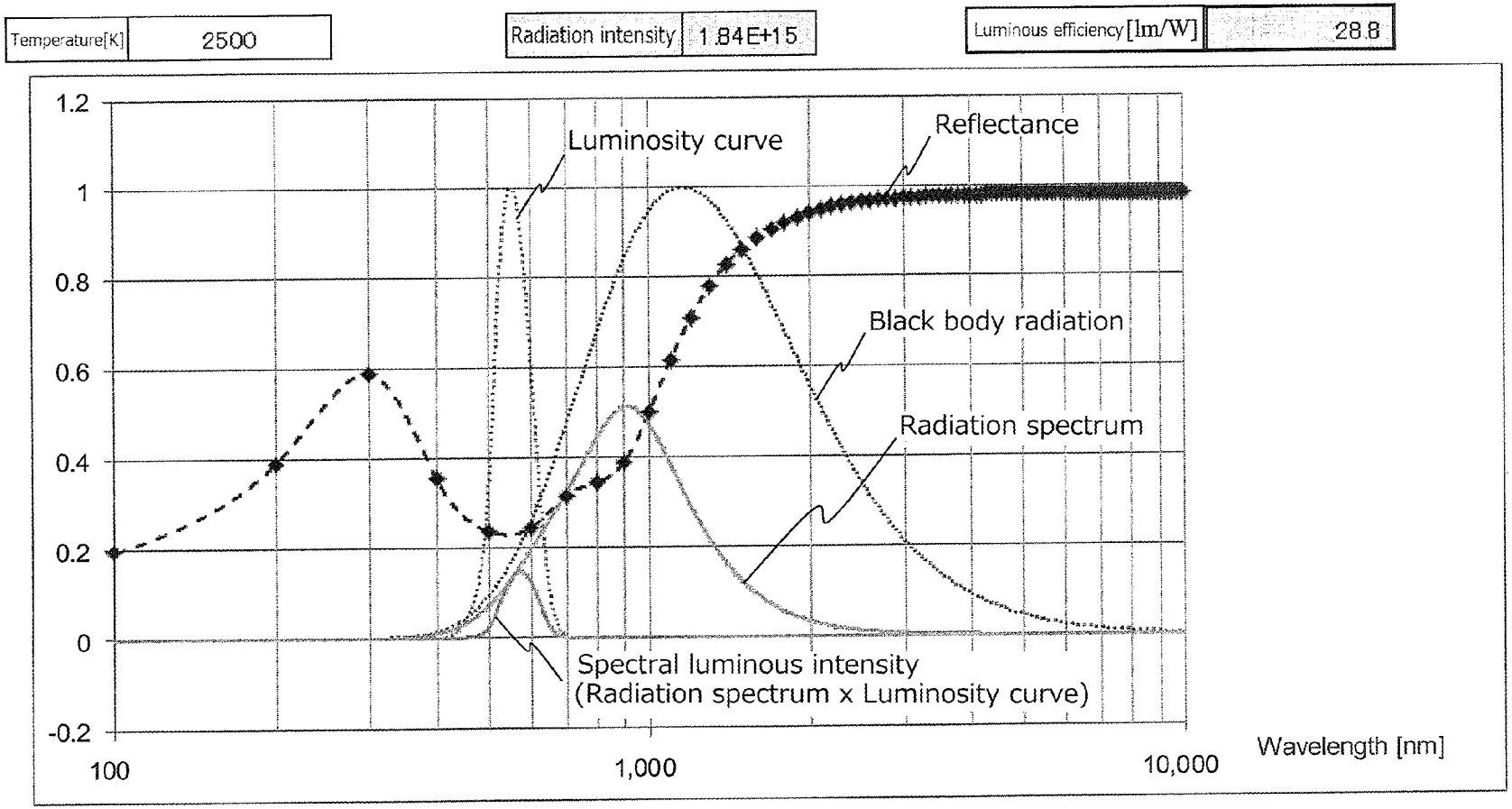
FIG. 51 is a graph showing the wavelength dependency of the reflectance, obtained radiation spectrum, and spectral luminous intensity of the filament of Example 4-1 comprising an Mo substrate and a visible light reflectance-reducing film (MgO film).

FIG. 51 shows the reflectance, radiation spectrum, and spectral luminous intensity of the substrate in the range where luminosity is obtained, which were obtained for the Mo substrate (filament) coated with an MgO film of 70 nm thickness by simulation and experiments. From comparison of the reflectance shown in FIG. 51 with the reflectance shown in FIG. 49 observed before forming the MgO film, it can be seen that the reflectance for the visible region was markedly reduced by the formation of the MgO film, i.e., around 55% of the reflectance of the Mo substrate observed before the formation of the MgO film was decreased to about 25% by the coating with the MgO film. As a result, the visible luminous efficiency of 21.8 lm/W could be improved to 28.8 lm/W, i.e., improved by 32%.

As described above, in this example, by coating the Mo substrate with a visible light reflectance-reducing film (MgO film), a filament for light sources and light source device showing an efficiency of about 29 lm/W at 2500K could be provided.

Examples 4-2 to 4-11

In Examples 4-2 to 4-11, the substrate was constituted with Mo, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 4-2 to 4-11, the methods described in Example 4-1 can be used likewise.

Changes of the visible luminous efficiency of the filaments of Examples 4-2 to 4-11 to be observed when the thickness of the visible light reflectance-reducing film is variously changed were obtained by simulation. The results are shown in FIGS. 52 to 61, respectively.

Figure 52:
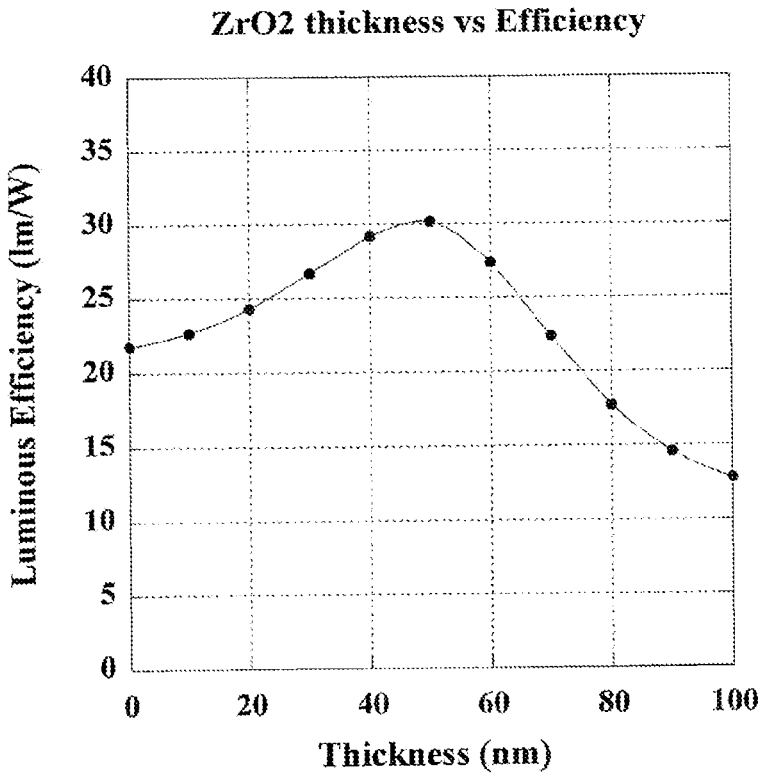
FIG. 52 is a graph showing the film thickness dependency of the luminous efficiency of the filament of Example 4-2 comprising an Mo substrate and a visible light reflectance-reducing film ($ZrO_2$ film).

FIG. 52 shows the visible luminous efficiency observed in Example 4-2 using an Mo substrate and a $ZrO_2$ film as the visible light reflectance-reducing film. As shown in FIG. 52, it can be seen that the maximum visible luminous efficiency of 30.2 lm/W was attained with a film thickness of 50 nm.

Figure 53:
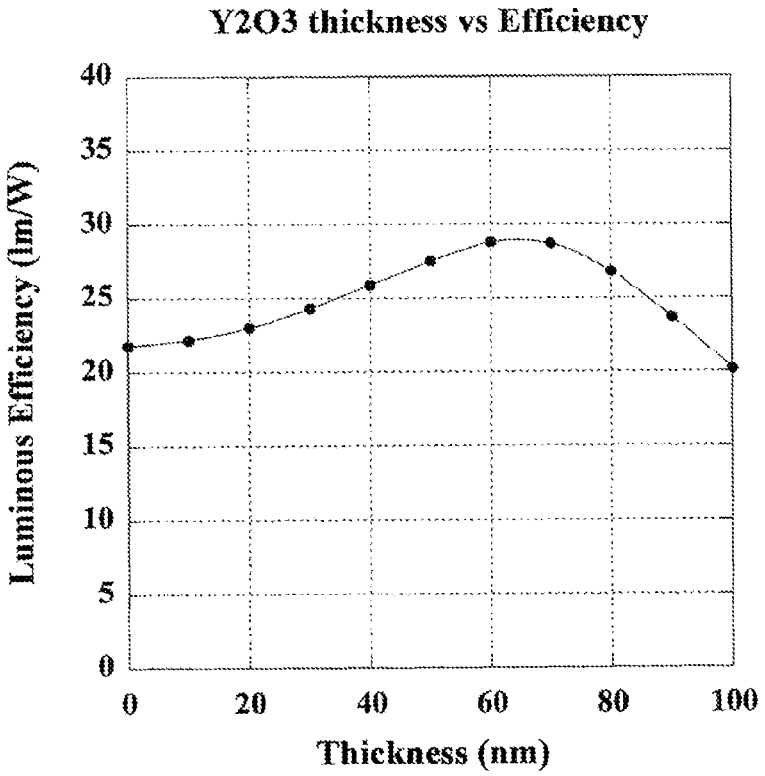
FIG. 53 is a graph showing the film thickness dependency of the luminous efficiency of the filament of Example 4-3 comprising an Mo substrate and a visible light reflectance-reducing film ($Y_2O_3$ film).

FIG. 53 shows the visible luminous efficiency observed in Example 4-3 using an Mo substrate and a $Y_2O_3$ film as the visible light reflectance-reducing film. As shown in FIG. 53, it can be seen that the maximum visible luminous efficiency of 28.8 lm/W was attained with a film thickness of 60 nm.

Figure 54:
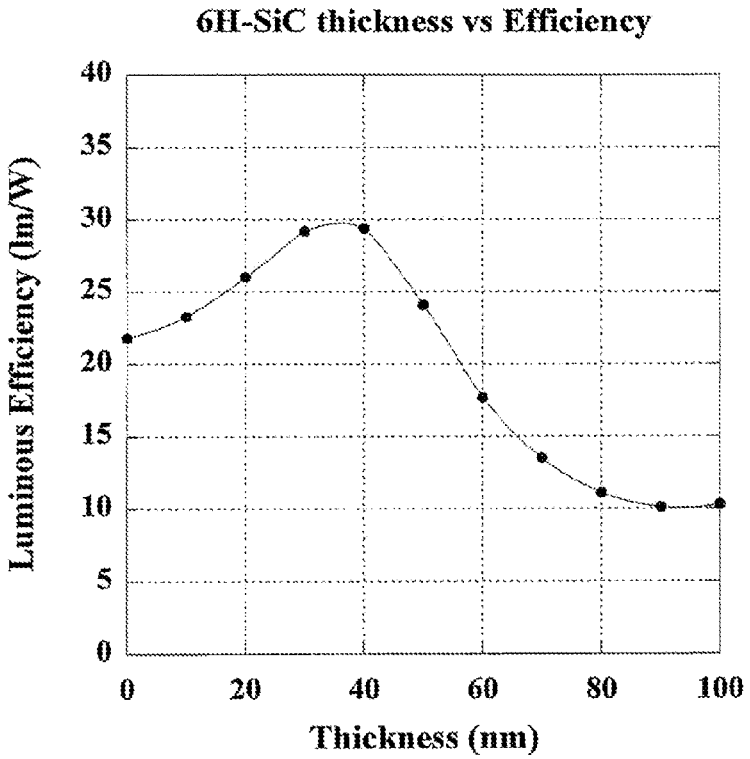
FIG. 54 is a graph showing the film thickness dependency of the luminous efficiency of the filament of Example 4-4 comprising an Mo substrate and a visible light reflectance-reducing film (6H-SiC (hexagonal SiC) film).

FIG. 54 shows the visible luminous efficiency observed in Example 4-4 using an Mo substrate and a 6H-SiC (hexagonal SiC) film as the visible light reflectance-reducing film. As shown in FIG. 54, it can be seen that the maximum visible luminous efficiency of 29.4 lm/W was attained with a film thickness of 40 nm.

Figure 55:
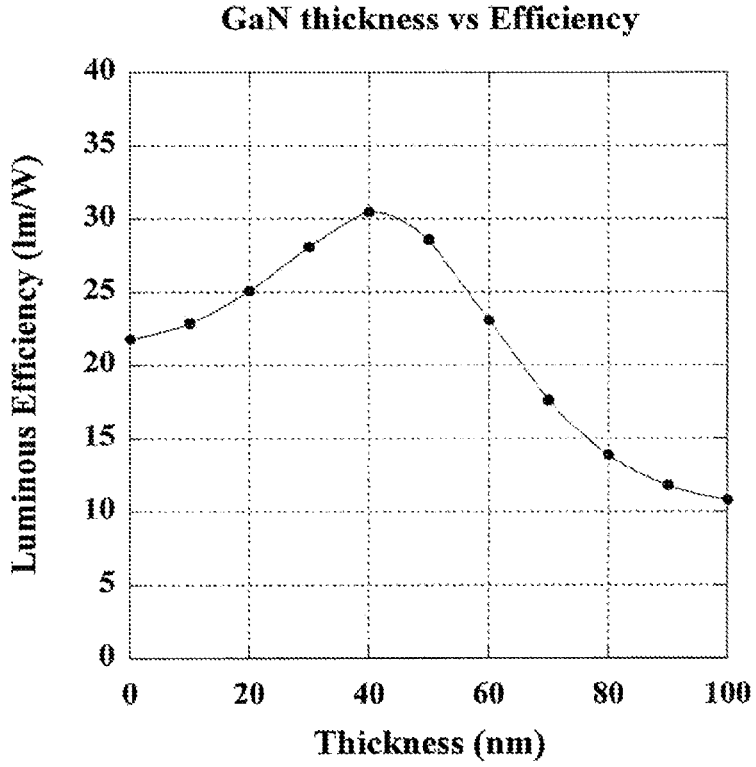
FIG. 55 is a graph showing the film thickness dependency of the luminous efficiency of the filament of Example 4-5 comprising an Mo substrate and a visible light reflectance-reducing film (GaN film).

FIG. 55 shows the visible luminous efficiency observed in Example 4-5 using an Mo substrate and a GaN film as the visible light reflectance-reducing film. As shown in FIG. 55, it can be seen that the maximum visible luminous efficiency of 30.5 lm/W was attained with a film thickness of 40 nm.

Figure 56:
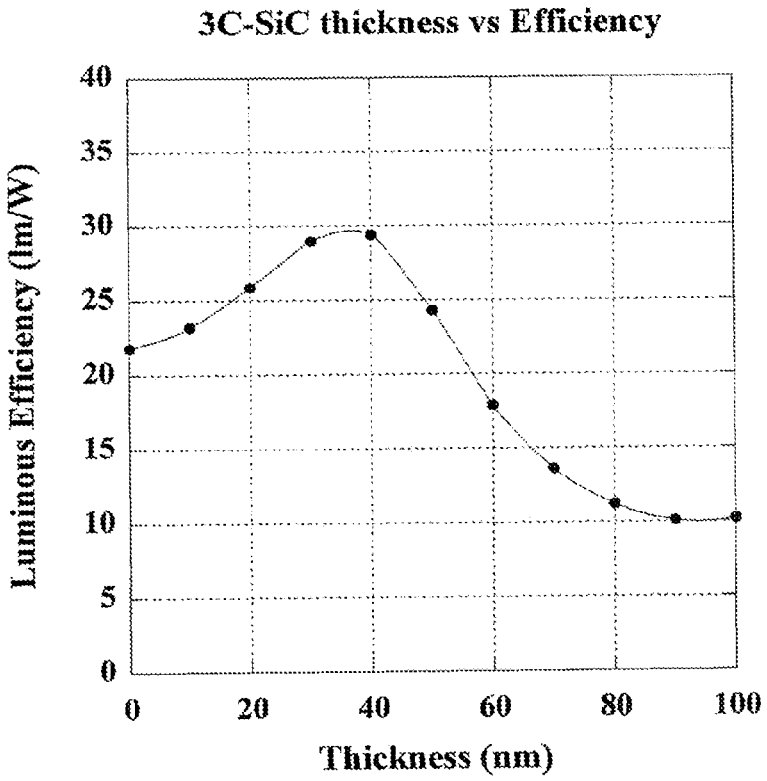
FIG. 56 is a graph showing the film thickness dependency of the luminous efficiency of the filament of Example 4-6 comprising an Mo substrate and a visible light reflectance-reducing film (3C-SiC (cubic SiC) film).

FIG. 56 shows the visible luminous efficiency observed in Example 4-6 using Mo substrate and a 3C-SiC (cubic SiC) film as the visible light reflectance-reducing film. As shown in FIG. 56, it can be seen that the maximum visible luminous efficiency of 29.4 lm/W was attained with a film thickness of 40 nm.

Figure 57:
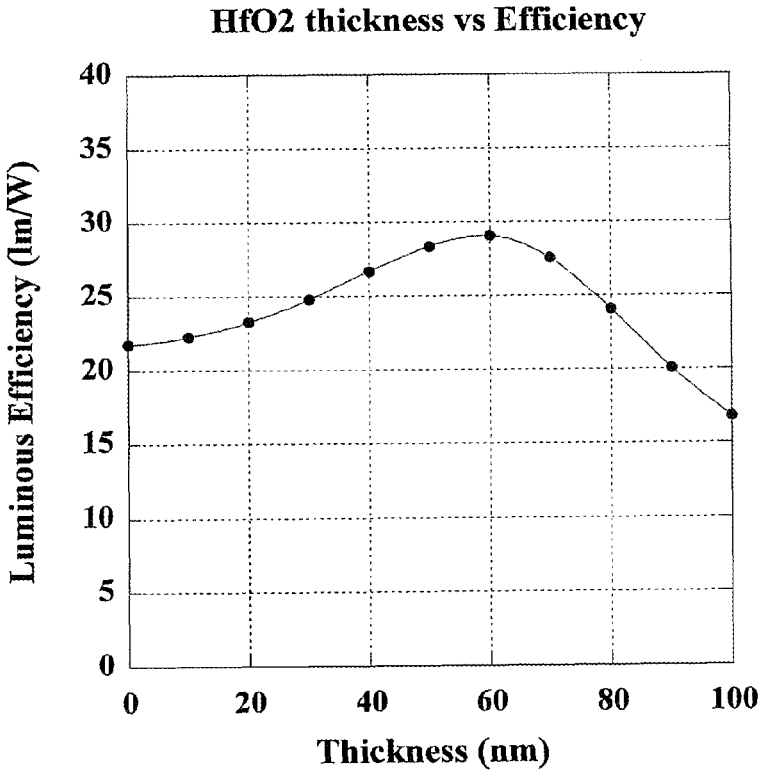
FIG. 57 is a graph showing the film thickness dependency of the luminous efficiency of the filament of Example 4-7 comprising an Mo substrate and a visible light reflectance-reducing film ($HfO_2$ film).

FIG. 57 shows the visible luminous efficiency observed in Example 4-7 using an Mo substrate and an $HfO_2$ film as the visible light reflectance-reducing film. As shown in FIG. 57, it can be seen that the maximum visible luminous efficiency of 29.1 lm/W was attained with a film thickness of 60 nm.

Figure 58:
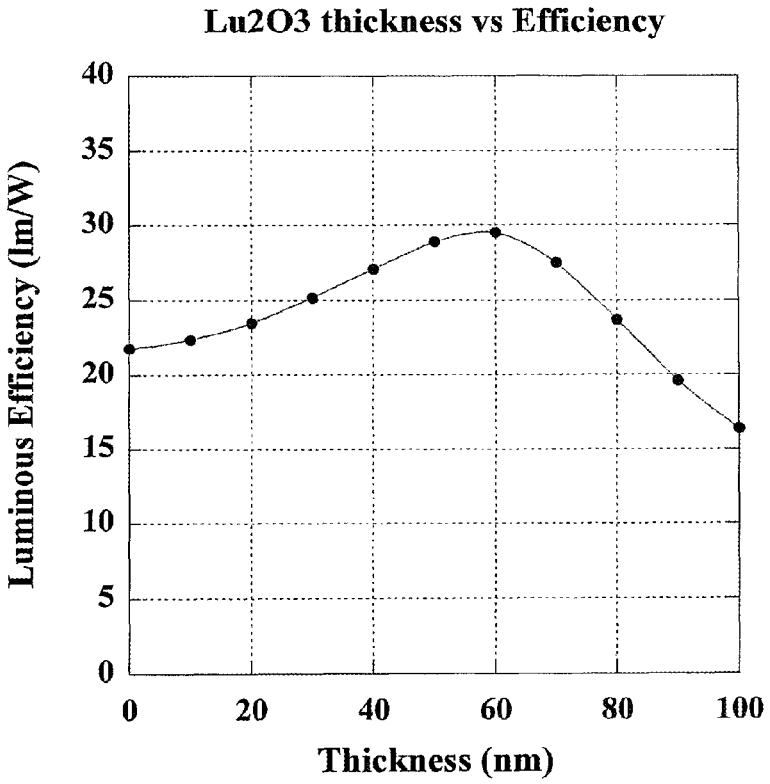
FIG. 58 is a graph showing the film thickness dependency of the luminous efficiency of the filament of Example 4-8 comprising an Mo substrate and a visible light reflectance-reducing film ($Lu_2O_3$ film).

FIG. 58 shows the visible luminous efficiency observed in Example 4-8 using an Mo substrate and an $Lu_2O_3$ film as the visible light reflectance-reducing film. As shown in FIG. 58, it can be seen that the maximum visible luminous efficiency of 29.5 lm/W was attained with a film thickness of 60 nm.

Figure 59:
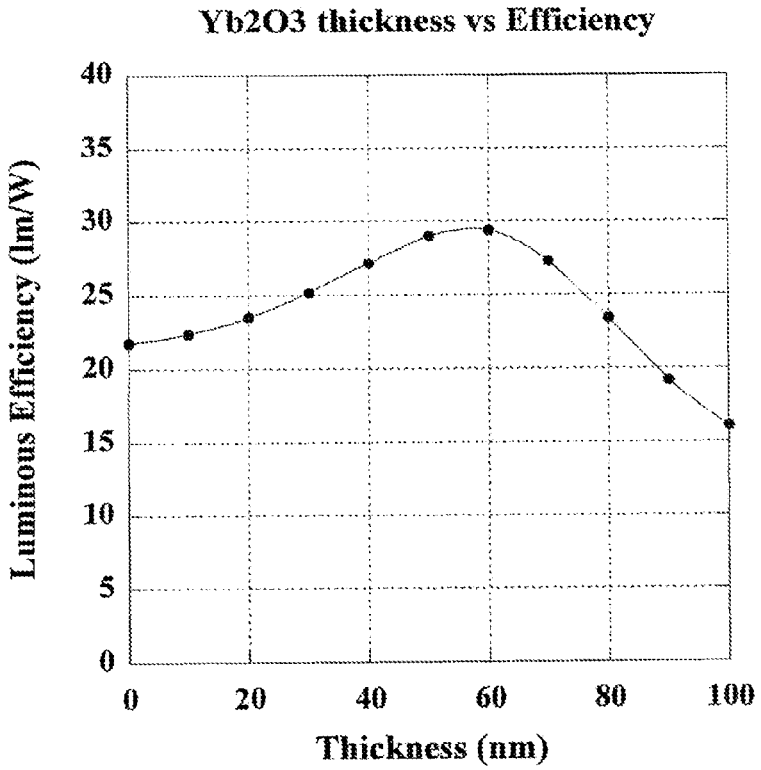
FIG. 59 is a graph showing the film thickness dependency of the luminous efficiency of the filament of Example 4-9 comprising an Mo substrate and a visible light reflectance-reducing film ($Yb_2O_3$ film).

FIG. 59 shows the visible luminous efficiency observed in Example 4-9 using an Mo substrate and a $Yb_2O_3$ film as the visible light reflectance-reducing film. As shown in FIG. 59, it can be seen that the maximum visible luminous efficiency of 29.4 lm/W was attained with a film thickness of 60 nm.

Figure 60:
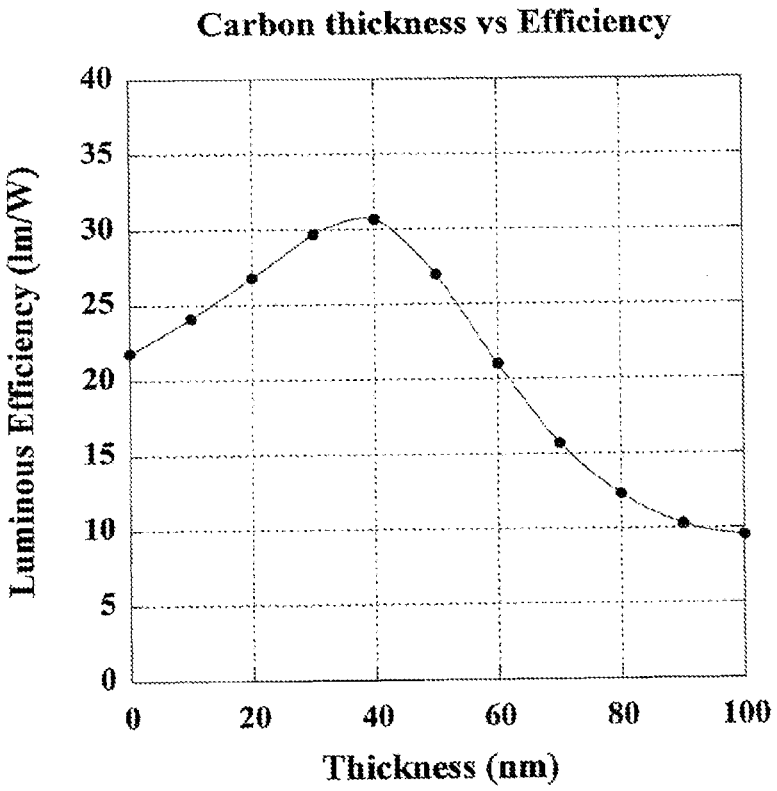
FIG. 60 is a graph showing the film thickness dependency of the luminous efficiency of the filament of Example 4-10 comprising an Mo substrate and a visible light reflectance-reducing film (graphite film).

FIG. 60 shows the visible luminous efficiency observed in Example 4-10 using an Mo substrate and a carbon (graphite) film as the visible light reflectance-reducing film. As shown in FIG. 60, it can be seen that the maximum visible luminous efficiency of 30.7 lm/W was attained with a film thickness of 40 nm.

Figure 61:
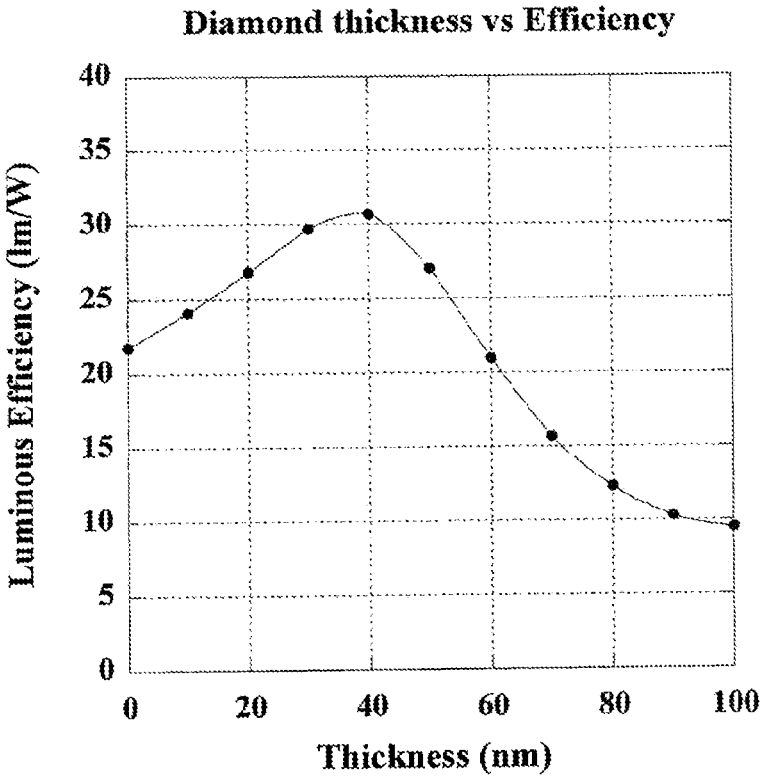
FIG. 61 is a graph showing the film thickness dependency of the luminous efficiency of the filament of Example 4-11 comprising an Mo substrate and a visible light reflectance-reducing film (diamond film).

FIG. 61 shows the visible luminous efficiency observed in Example 4-11 using an Mo substrate and a diamond film as the visible light reflectance-reducing film. As shown in FIG. 61, it can be seen that the maximum visible luminous efficiency of 30.7 lm/W was attained with a film thickness of 40 nm.

The results of Examples 4-1 to 4-11 are summarized as shown in FIG. 62. The values of the visible luminous efficiency of the filaments of Example 4-2 to 4-12 having the visible light reflectance-reducing film shown in FIGS. 52 to 61 are 28.8 lm/W or larger, and they were increased compared with the visible luminous efficiency 21.8 lm/W of the mirror-polished Mo substrate not having the visible light reflectance-reducing film. Therefore, the values of the visible luminous efficiency of the filaments of Example 4-2 to 4-12 could be improved by providing the visible light reflectance-reducing film, as in Example 4-1.

Example 5

Substrate: Re

Examples 5-1 to 5-11 mentioned below are examples of constituting the substrate with Re.

Example 5-1

In Example 5-1, there is explained a filament in which the substrate is constituted with Re, and an MgO film is provided as a visible light reflectance-reducing film on the surface of the substrate.

The Re substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 63:
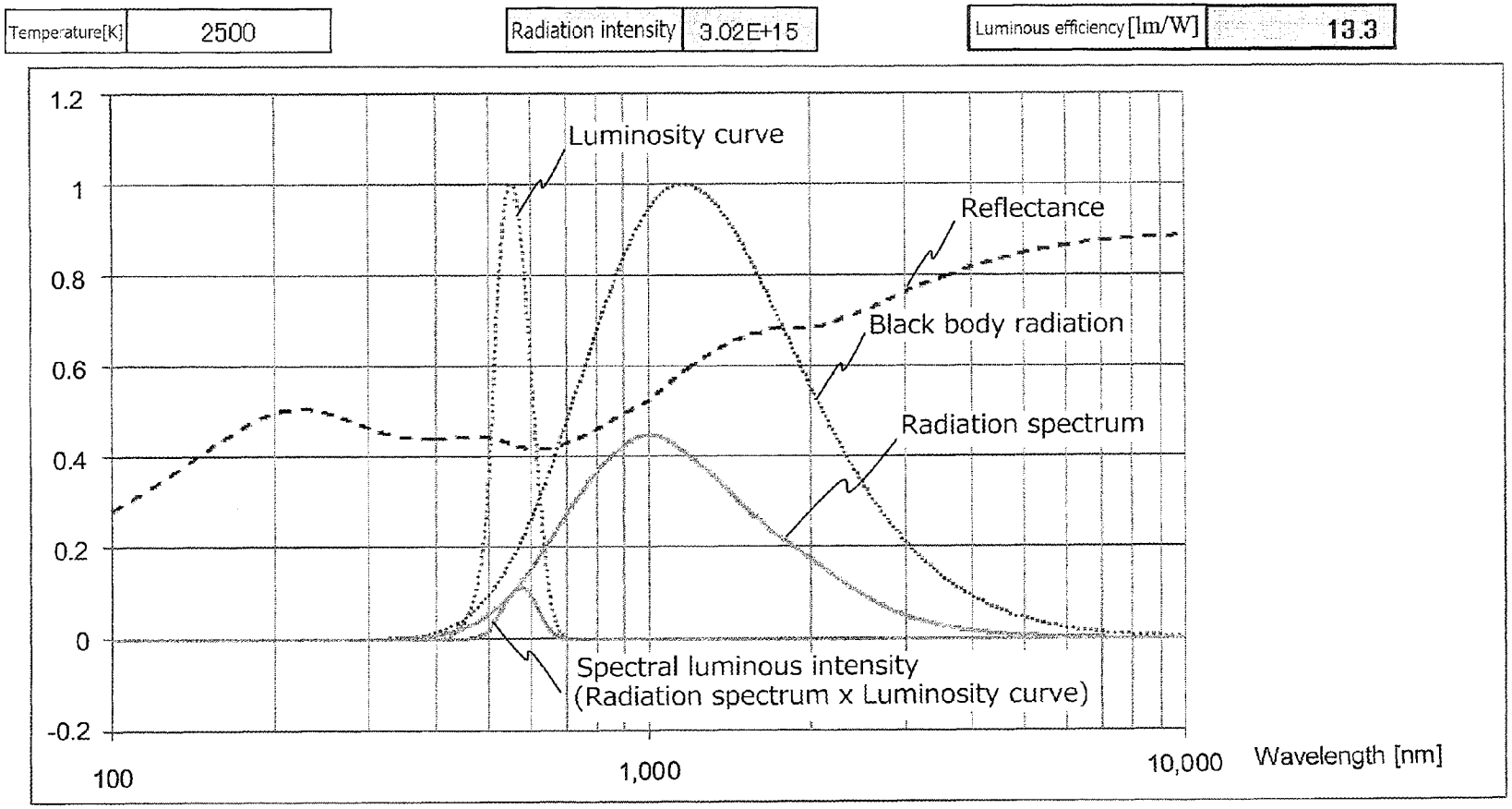
FIG. 63 is a graph showing the wavelength dependency of the reflectance, obtained radiation spectrum, and spectral luminous intensity observed for the Re substrate used in Example 5 before polishing.
Figure 64:
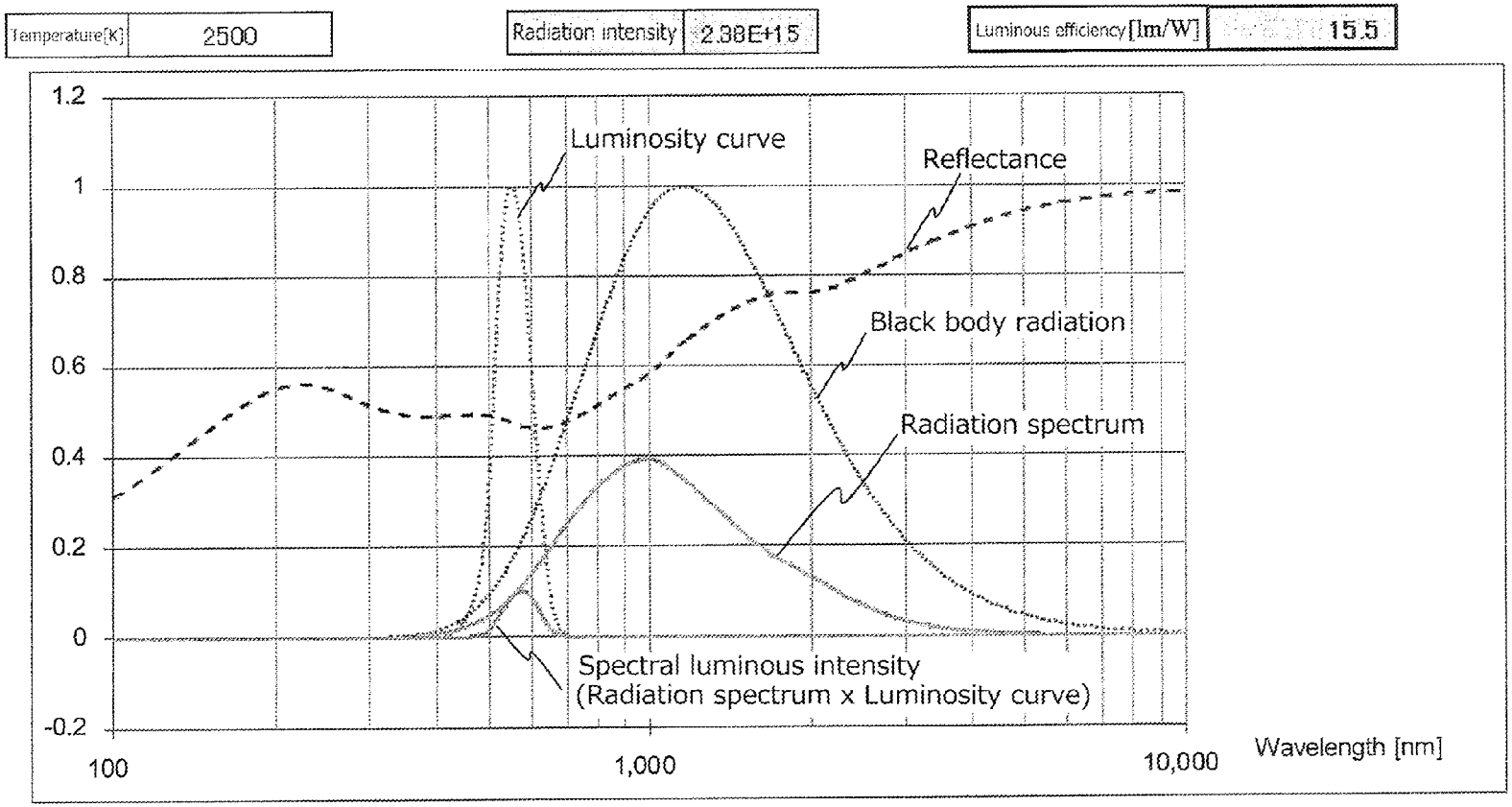
FIG. 64 is a graph showing the wavelength dependency of the reflectance, obtained radiation spectrum, and spectral luminous intensity observed for the Re substrate used in Example 5 after polishing.

FIGS. 63 and 64 show the reflectance, radiation spectra and spectral luminosity intensity of the substrates in the range where luminosity is obtained, which are for an Re substrate not polished and having a rough surface and the mirror-polished Re substrate, respectively, and were obtained by simulation and experiments. The both are for a temperature of 2500K.

As shown in FIG. 64, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 63. The emissivity for the infrared wavelength region was suppressed correspondingly to the improvement of the reflectance. As a result, the luminous efficiency (radiation efficiency for visible lights) was increased from 13.3 lm/W to 15.5 lm/W, i.e., improved by 17%.

Figure 65:
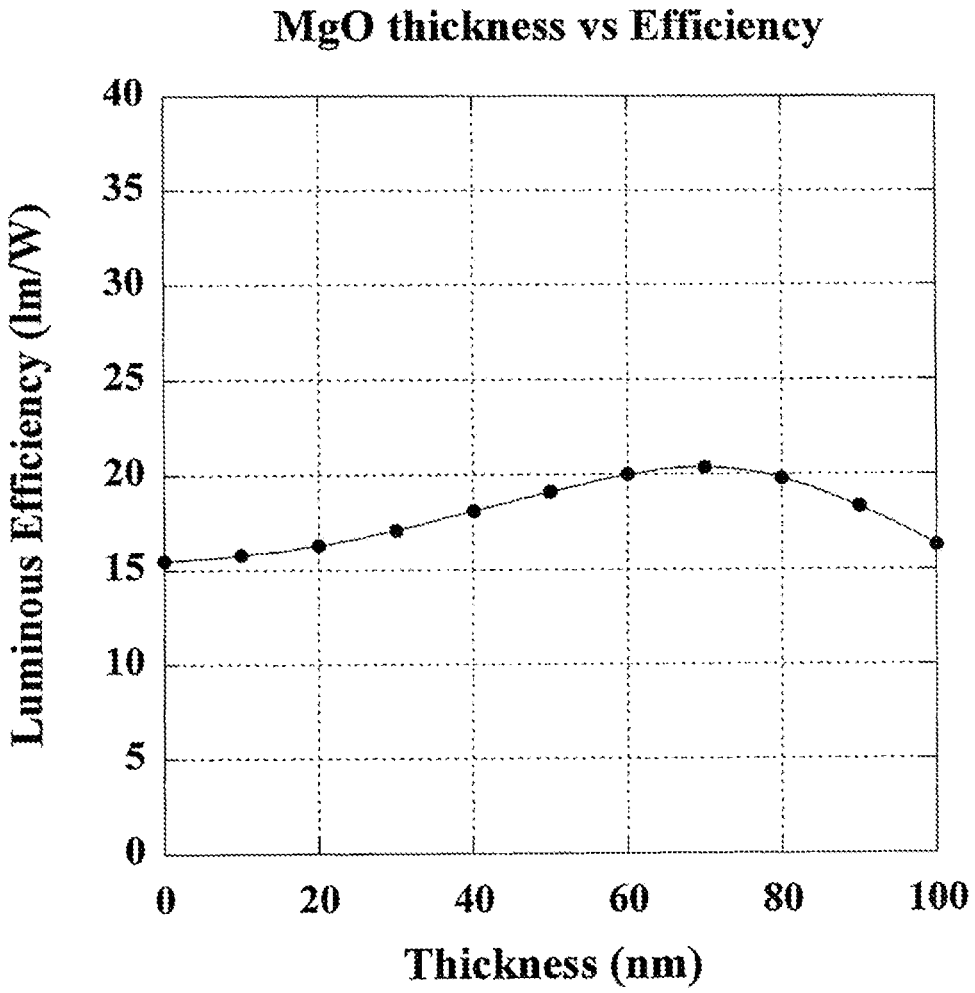
FIG. 65 is a graph showing the film thickness dependency of the luminous efficiency of the filament of Example 5-1 comprising an Re substrate and a visible light reflectance-reducing film (MgO film).

According to the presently disclosed subject matter, a visible light reflectance-reducing film is formed on the surface of the mirror-polished substrate to reduce the visible light reflectance. In Example 5-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 65. From the results shown in FIG. 65, the optimal thickness of the MgO film was determined to be 70 nm. The luminous efficiency for visible lights of the filament coated with the MgO film having the optimal thickness of 70 nm was 20.4 lm/W.

Figure 66:
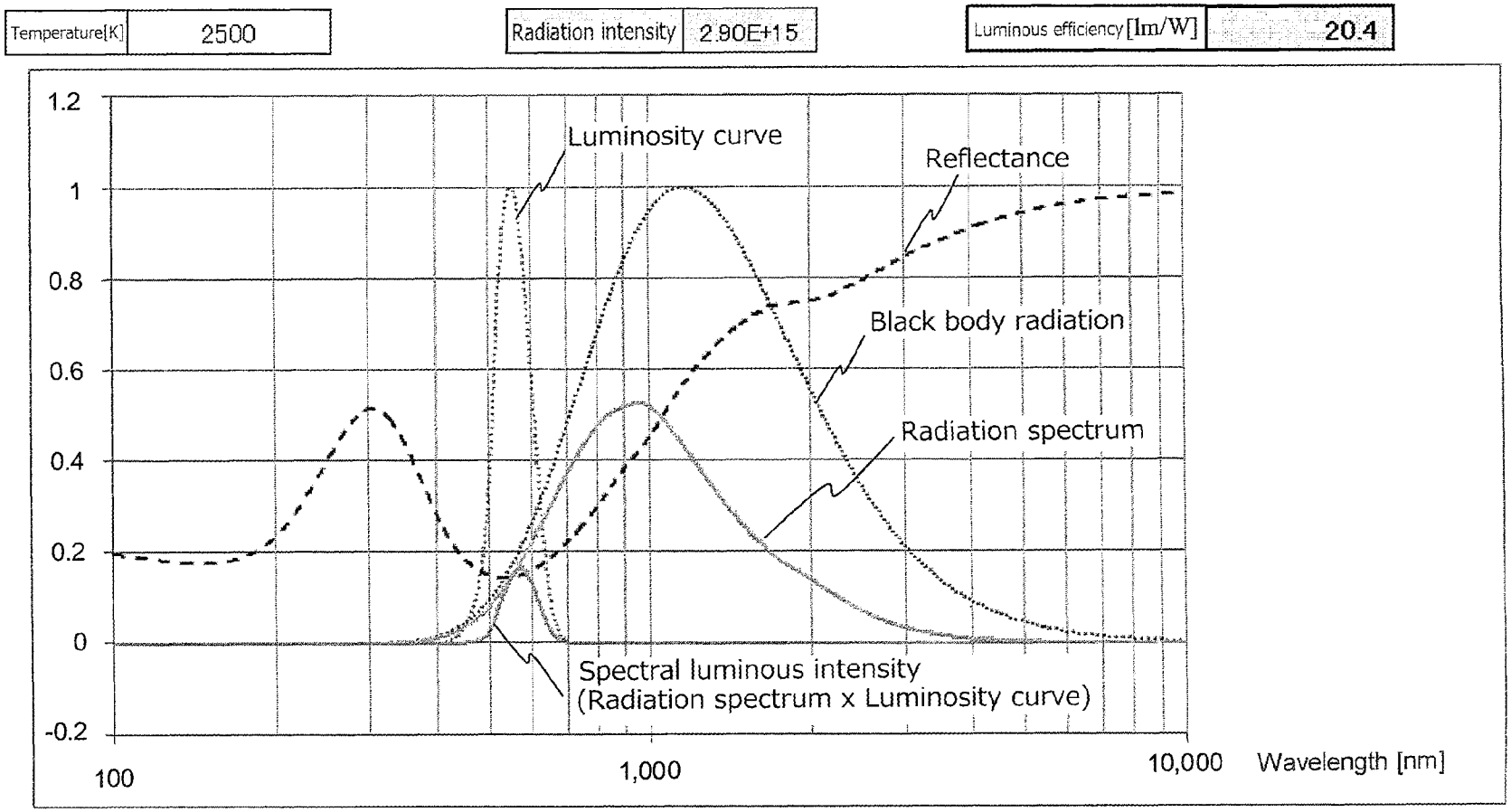
FIG. 66 is a graph showing the wavelength dependency of the reflectance, obtained radiation spectrum, and spectral luminous intensity of the filament of Example 5-1 comprising an Re substrate and a visible light reflectance-reducing film (MgO film).

FIG. 66 shows the reflectance, radiation spectrum, and spectral luminous intensity of the substrate in the range where luminosity is obtained, which were obtained for the Re substrate (filament) coated with an MgO film of 70 nm thickness by simulation and experiments. From comparison of the reflectance shown in FIG. 66 with the reflectance shown in FIG. 64 observed before forming the MgO film, it can be seen that the reflectance for the visible region was markedly reduced by the formation of the MgO film, i.e., around 50% of the reflectance of the Re substrate observed before the formation of the MgO film was decreased to about 15% by the coating with the MgO film. As a result, the visible luminous efficiency of 15.5 lm/W could be improved to 20.4 lm/W, i.e., improved by 32%.

As described above, in this example, by coating the Re substrate with a visible light reflectance-reducing film (MgO film), a filament for light sources and light source device showing an efficiency of about 29 lm/W at 2500K could be provided.

Examples 5-2 to 5-11

In Examples 5-2 to 5-11, the substrate was constituted with Re, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 5-2 to 5-11, the methods described in Example 5-1 can be used likewise.

Changes of the visible luminous efficiency of the filaments of Examples 5-2 to 5-11 to be observed when the thickness of the visible light reflectance-reducing film is variously changed were obtained by simulation. The results are shown in FIGS. 67 to 76, respectively.

Figure 67:
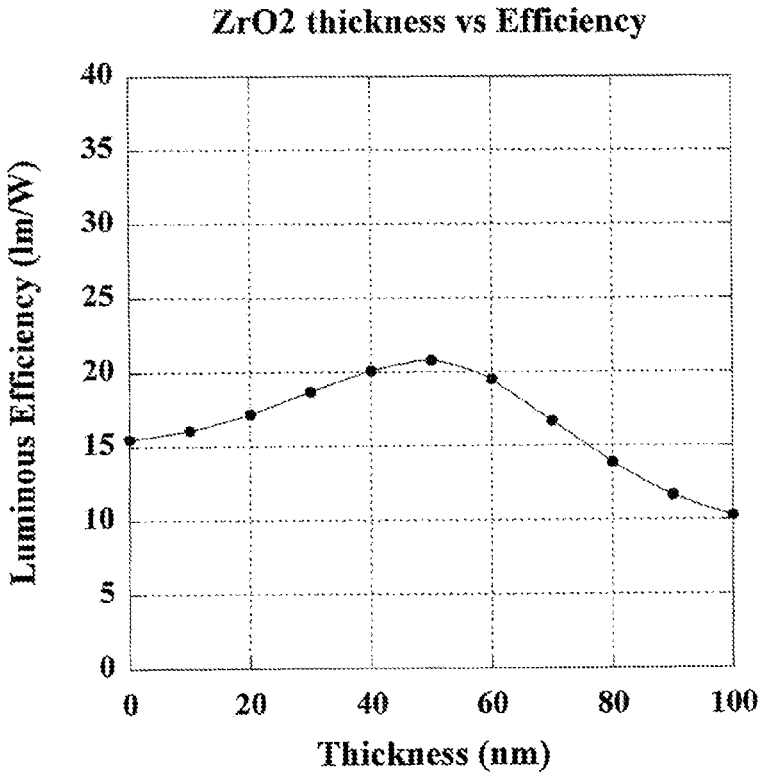
FIG. 67 is a graph showing the film thickness dependency of the luminous efficiency of the filament of Example 5-2 comprising an Re substrate and a visible light reflectance-reducing film ($ZrO_2$ film).

FIG. 67 shows the visible luminous efficiency observed in Example 5-2 using an Re substrate and a $ZrO_2$ film as the visible light reflectance-reducing film. As shown in FIG. 67, it can be seen that the maximum visible luminous efficiency of 20.8 lm/W was attained with a film thickness of 50 nm.

Figure 68:
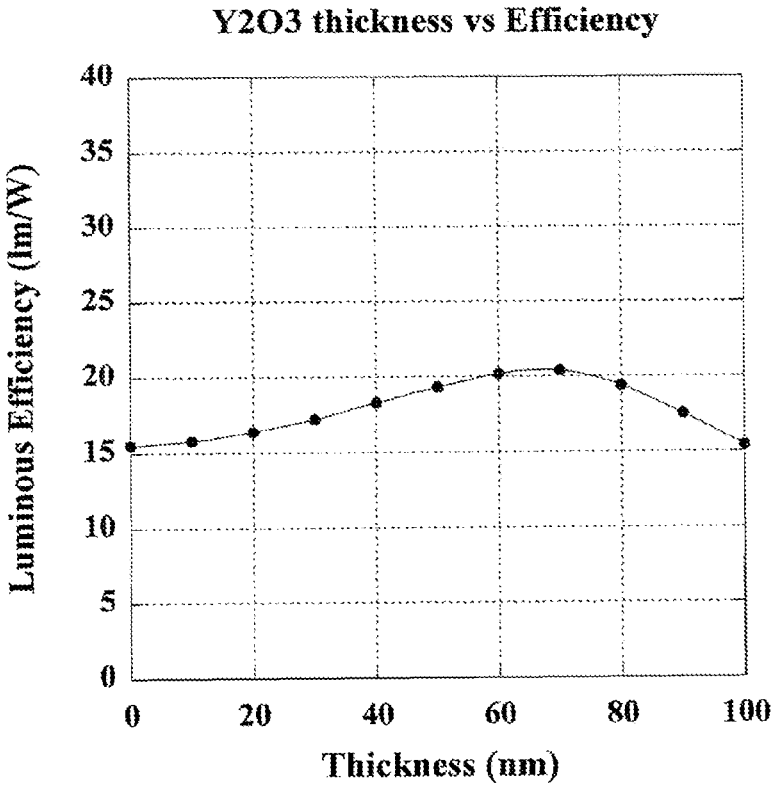
FIG. 68 is a graph showing the film thickness dependency of the luminous efficiency of the filament of Example 5-3 comprising an Re substrate and a visible light reflectance-reducing film ($Y_2O_3$ film).

FIG. 68 shows the visible luminous efficiency observed in Example 5-3 using an Re substrate and a $Y_2O_3$ film as the visible light reflectance-reducing film. As shown in FIG. 68, it can be seen that the maximum visible luminous efficiency of 20.4 lm/W was attained with a film thickness of 70 nm.

Figure 69:
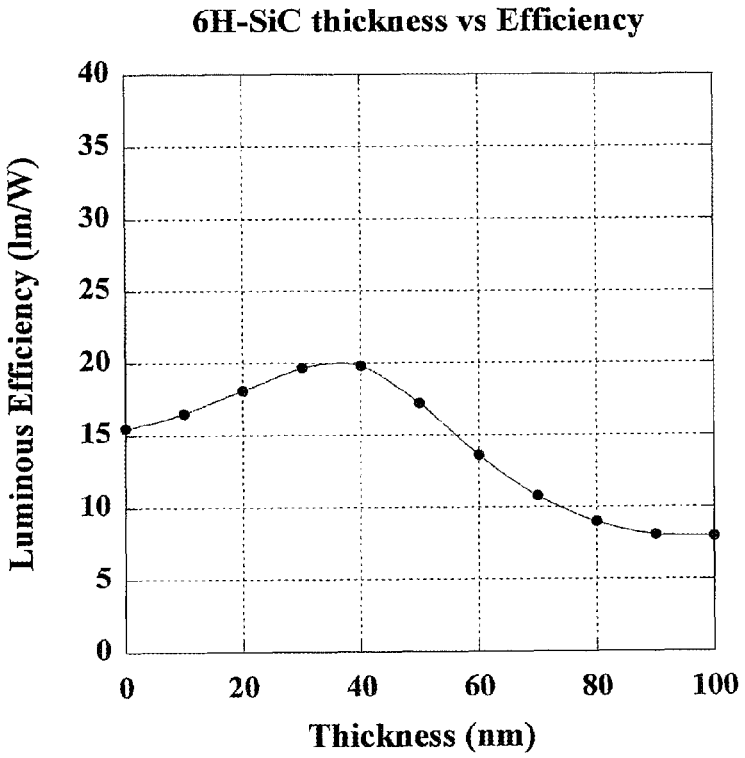
FIG. 69 is a graph showing the film thickness dependency of the luminous efficiency of the filament of Example 5-4 comprising an Re substrate and a visible light reflectance-reducing film (6H-SiC (hexagonal SiC) film).

FIG. 69 shows the visible luminous efficiency observed in Example 5-4 using an Re substrate and a 6H-SiC (hexagonal SiC) film as the visible light reflectance-reducing film. As shown in FIG. 69, it can be seen that the maximum visible luminous efficiency of 19.8 lm/W was attained with a film thickness of 40 nm.

Figure 70:
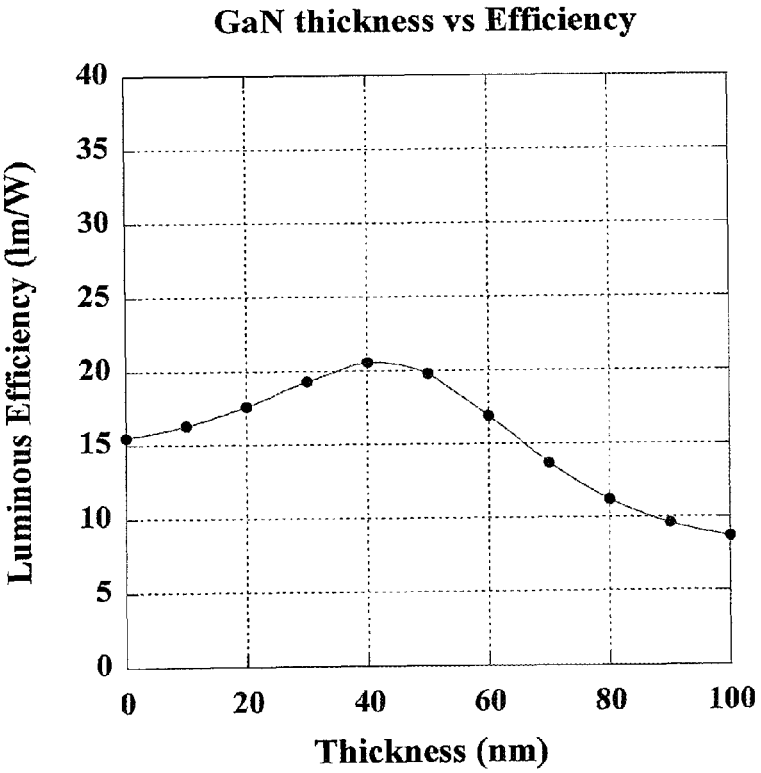
FIG. 70 is a graph showing the film thickness dependency of the luminous efficiency of the filament of Example 5-5 comprising an Re substrate and a visible light reflectance-reducing film (GaN film).

FIG. 70 shows the visible luminous efficiency observed in Example 5-5 using an Re substrate and a GaN film as the visible light reflectance-reducing film. As shown in FIG. 70, it can be seen that the maximum visible luminous efficiency of 20.6 lm/W was attained with a film thickness of 40 nm.

Figure 71:
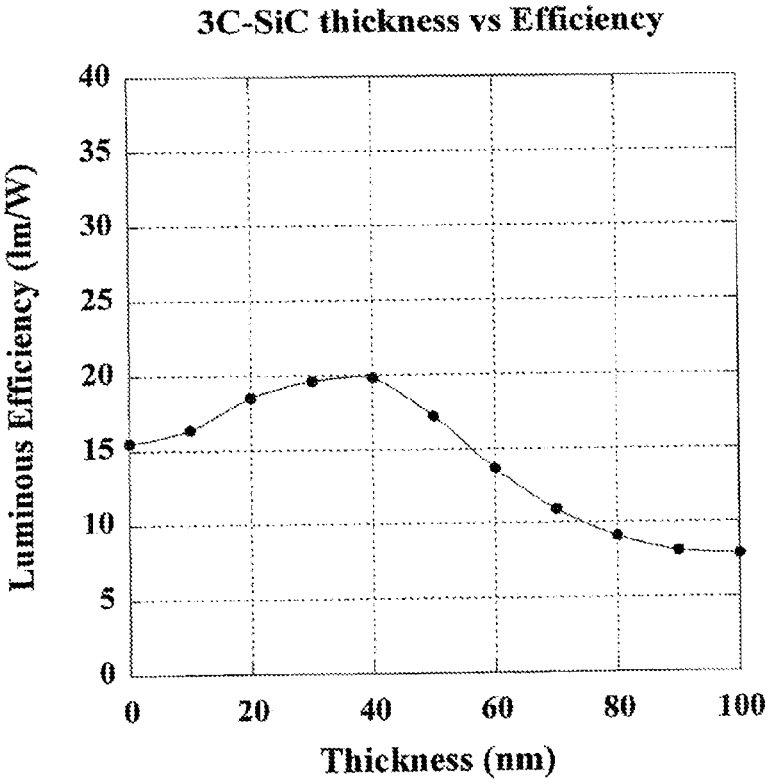
FIG. 71 is a graph showing the film thickness dependency of the luminous efficiency of the filament of Example 5-6 comprising an Re substrate and a visible light reflectance-reducing film (3C-SiC (cubic SiC) film).

FIG. 71 shows the visible luminous efficiency observed in Example 5-6 using an Re substrate and a 3C-SiC (cubic SiC) film as the visible light reflectance-reducing film. As shown in FIG. 71, it can be seen that the maximum visible luminous efficiency of 19.8 lm/W was attained with a film thickness of 40 nm.

Figure 72:
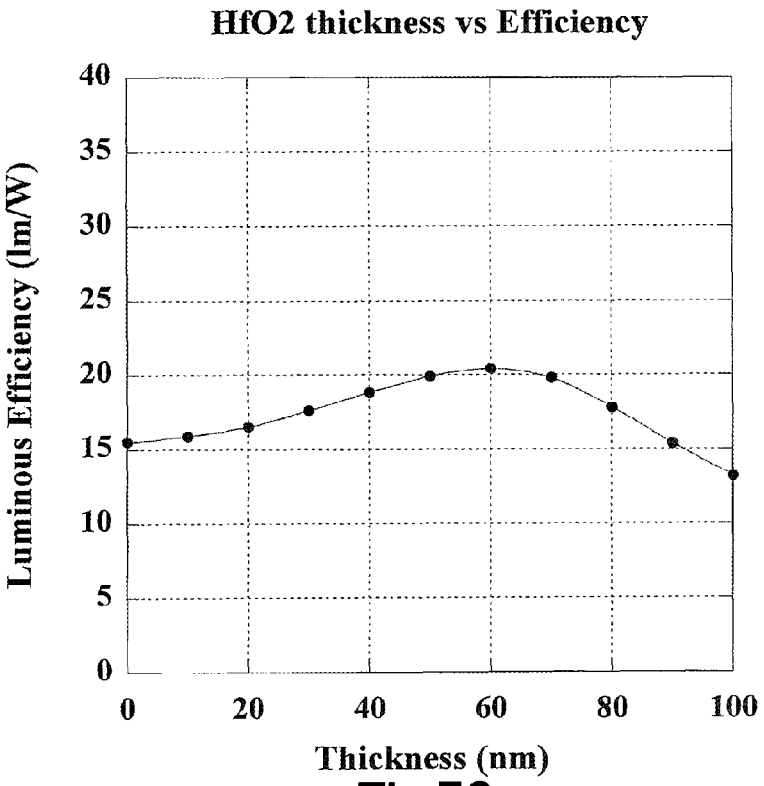
FIG. 72 is a graph showing the film thickness dependency of the luminous efficiency of the filament of Example 5-7 comprising an Re substrate and a visible light reflectance-reducing film ($HfO_2$ film).

FIG. 72 shows the visible luminous efficiency observed in Example 5-7 using an Re substrate and an $HfO_2$ film as the visible light reflectance-reducing film. As shown in FIG. 72, it can be seen that the maximum visible luminous efficiency of 20.4 lm/W was attained with a film thickness of 60 nm.

Figure 73:
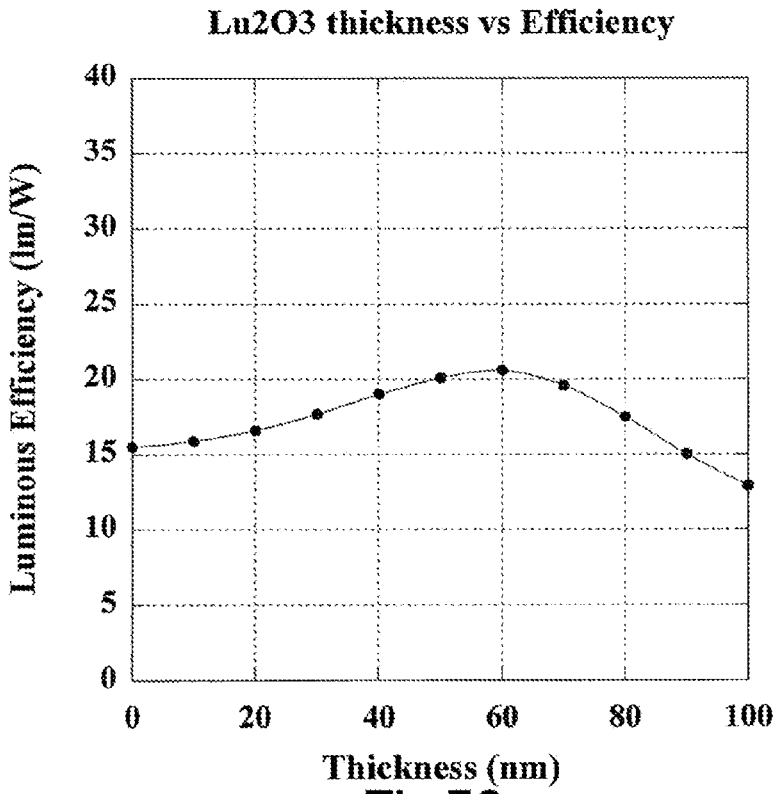
FIG. 73 is a graph showing the film thickness dependency of the luminous efficiency of the filament of Example 5-8 comprising an Re substrate and a visible light reflectance-reducing film ($Lu_2O_3$ film).

FIG. 73 shows the visible luminous efficiency observed in Example 5-8 using an Re substrate and an $Lu_2O_3$ film as the visible light reflectance-reducing film. As shown in FIG. 73, it can be seen that the maximum visible luminous efficiency of 20.6 lm/W was attained with a film thickness of 60 nm.

Figure 74:
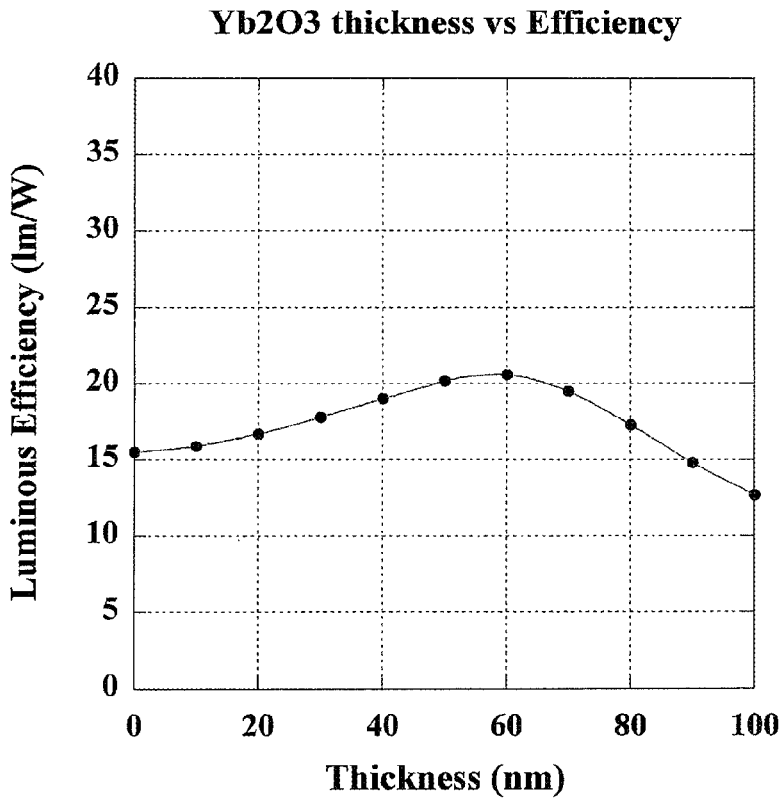
FIG. 74 is a graph showing the film thickness dependency of the luminous efficiency of the filament of Example 5-9 comprising an Re substrate and a visible light reflectance-reducing film ($Yb_2O_3$ film).

FIG. 74 shows the visible luminous efficiency observed in Example 5-9 using an Re substrate and a $Yb_2O_3$ film as the visible light reflectance-reducing film. As shown in FIG. 74, it can be seen that the maximum visible luminous efficiency of 20.6 lm/W was attained with a film thickness of 60 nm.

Figure 75:
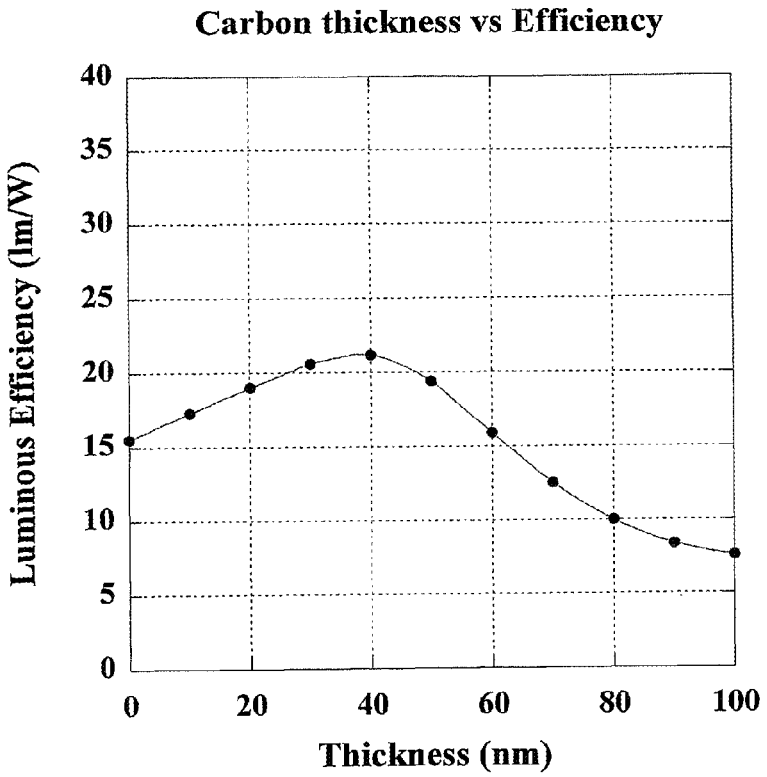
FIG. 75 is a graph showing the film thickness dependency of the luminous efficiency of the filament of Example 5-10 comprising an Re substrate and a visible light reflectance-reducing film (graphite film).

FIG. 75 shows the visible luminous efficiency observed in Example 5-10 using an Re substrate and a carbon (graphite) film as the visible light reflectance-reducing film. As shown in FIG. 75, it can be seen that the maximum visible luminous efficiency of 21.6 lm/W was attained with a film thickness of 40 nm.

Figure 76:
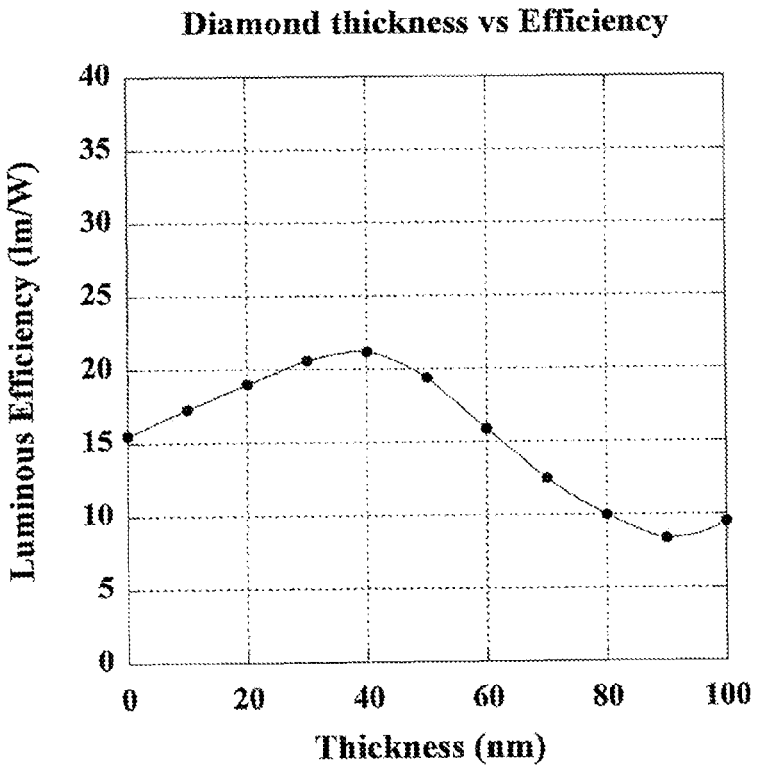
FIG. 76 is a graph showing the film thickness dependency of the luminous efficiency of the filament of Example 5-11 comprising an Re substrate and a visible light reflectance-reducing film (diamond film).

FIG. 76 shows the visible luminous efficiency observed in Example 5-11 using an Re substrate and a diamond film as the visible light reflectance-reducing film. As shown in FIG. 76, it can be seen that the maximum visible luminous efficiency of 21.2 lm/W was attained with a film thickness of 40 nm.

The results of Examples 5-1 to 5-11 are summarized as shown in FIG. 77. The values of the visible luminous efficiency of the filaments of Example 5-2 to 5-12 having the visible light reflectance-reducing film shown in FIGS. 67 to 76 are 19.8 lm/W or larger, and they were increased compared with the visible luminous efficiency 15.5 lm/W of the mirror-polished Re substrate not having the visible light reflectance-reducing film. Therefore, the values of the visible luminous efficiency of the filaments of Example 5-2 to 5-12 could be improved by providing the visible light reflectance-reducing film, as in Example 5-1.

Example 6

Substrate: W

Examples 6-1 to 6-11 mentioned below are examples of constituting the substrate with W.

Example 6-1

In Example 6-1, there is explained a filament in which the substrate is constituted with W, and an MgO film is provided as a visible light reflectance-reducing film on the surface of the substrate.

The W substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 78:
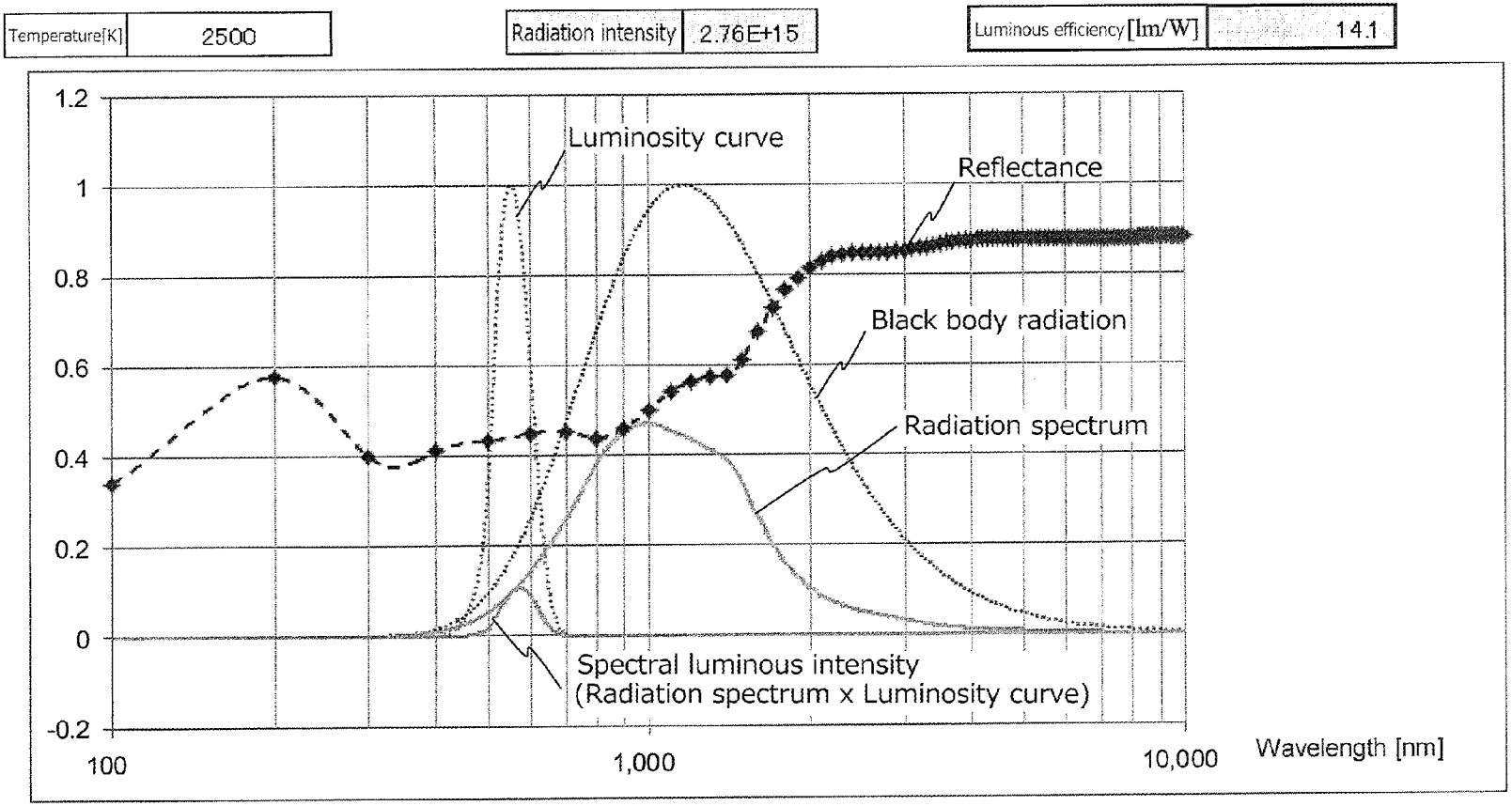
FIG. 78 is a graph showing the wavelength dependency of the reflectance, obtained radiation spectrum, and spectral luminous intensity observed for the W substrate used in Example 6 before polishing.
Figure 79:
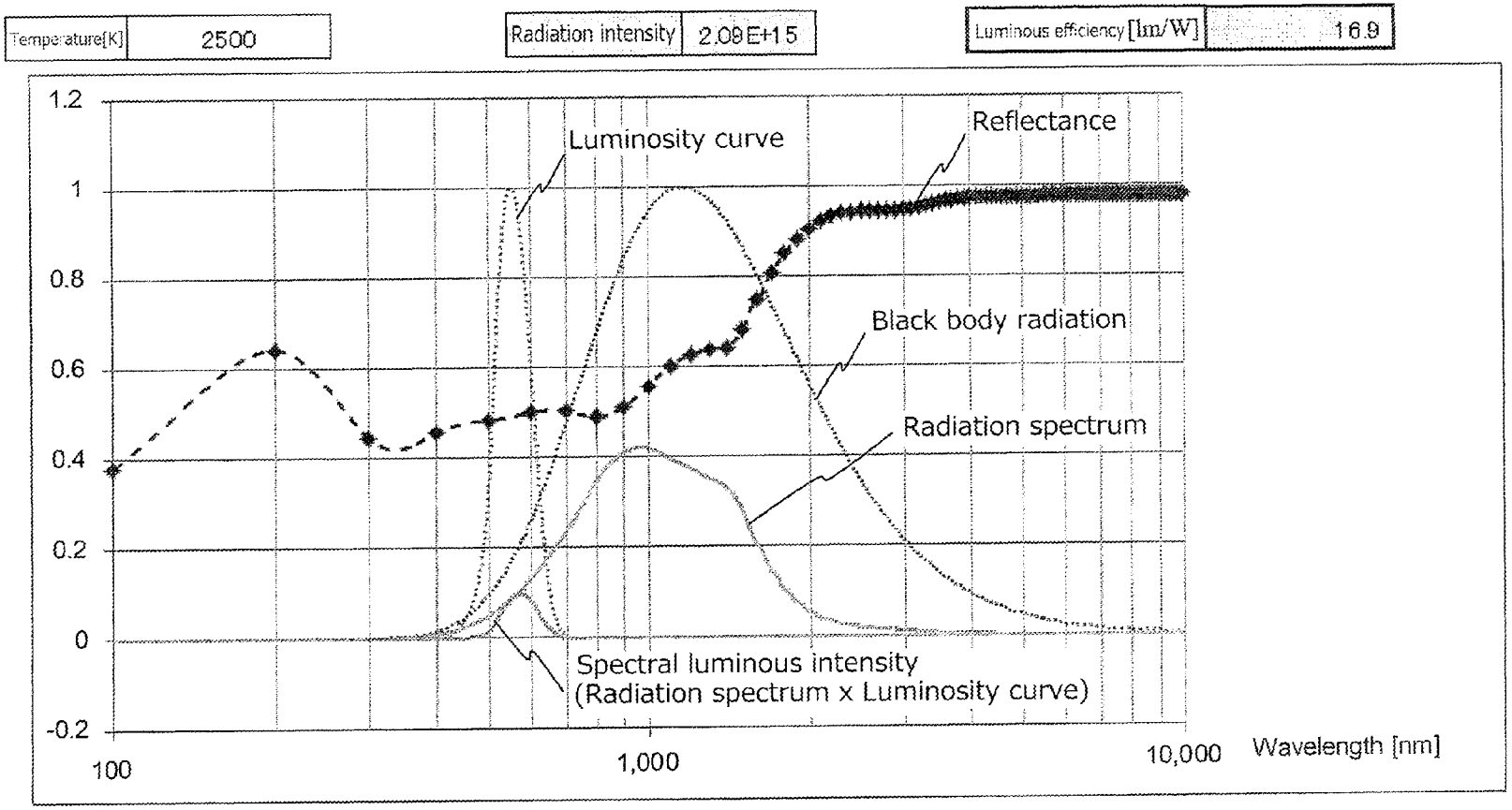
FIG. 79 is a graph showing the wavelength dependency of the reflectance, obtained radiation spectrum, and spectral luminous intensity observed for the W substrate used in Example 6 after polishing.

FIGS. 78 and 79 show reflectance, radiation spectra and spectral luminosity intensity of the substrates in the range where luminosity is obtained, which are for a W substrate not polished and having a rough surface and the mirror-polished W substrate, respectively, and were obtained by simulation and experiments. The both are for a temperature of 2500K.

As shown in FIG. 79, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 78. The emissivity for the infrared wavelength region was suppressed correspondingly to the improvement of the reflectance. As a result, the luminous efficiency (radiation efficiency for visible lights) was increased from 14.1 lm/W to 16.9 lm/W, i.e., improved by 20%.

Figure 80:
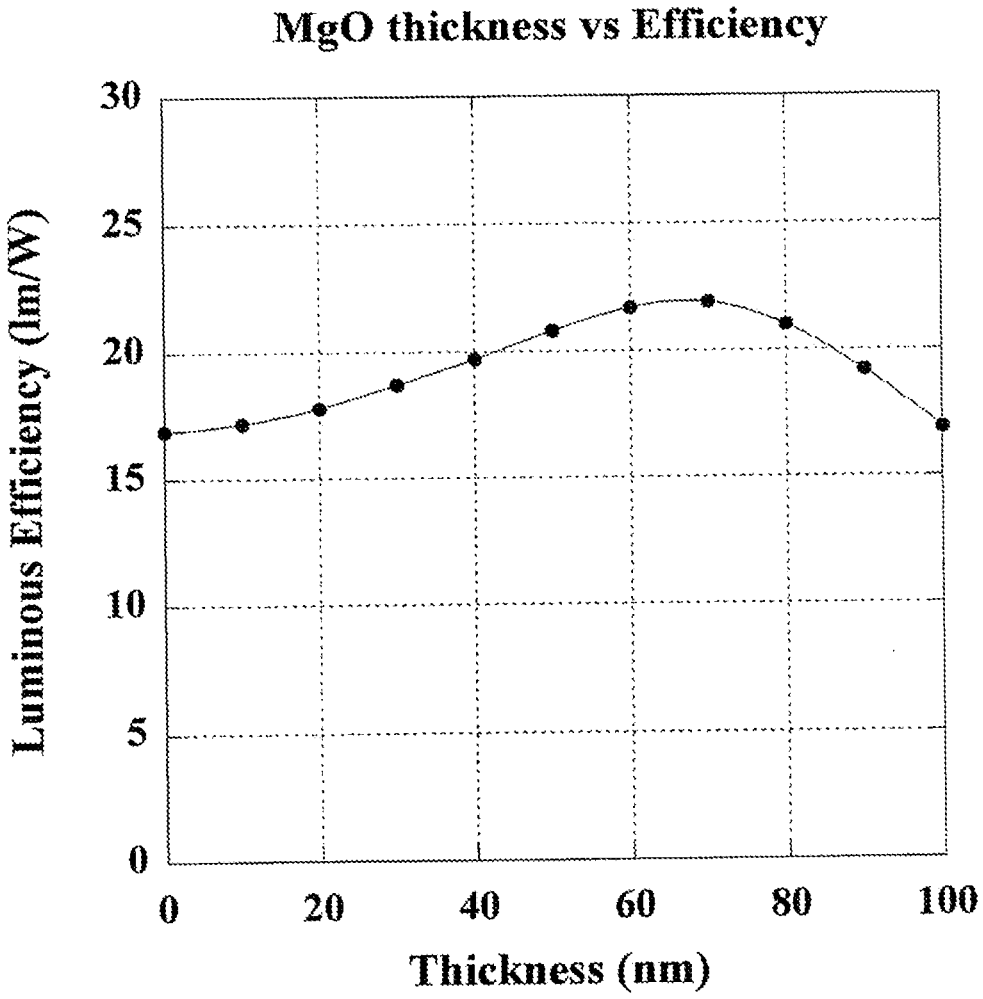
FIG. 80 is a graph showing the film thickness dependency of the luminous efficiency of the filament of Example 6-1 comprising a W substrate and a light reflectance-reducing film (MgO film).

According to the presently disclosed subject matter, a visible light reflectance-reducing film is formed on the surface of the mirror-polished substrate to reduce the visible light reflectance. In Example 6-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 80. From the results shown in FIG. 80, the optimal thickness of the MgO film was determined to be 70 nm. The luminous efficiency for visible lights of the filament coated with the MgO film having the optimal thickness of 70 nm was 21.9 lm/W.

Figure 81:
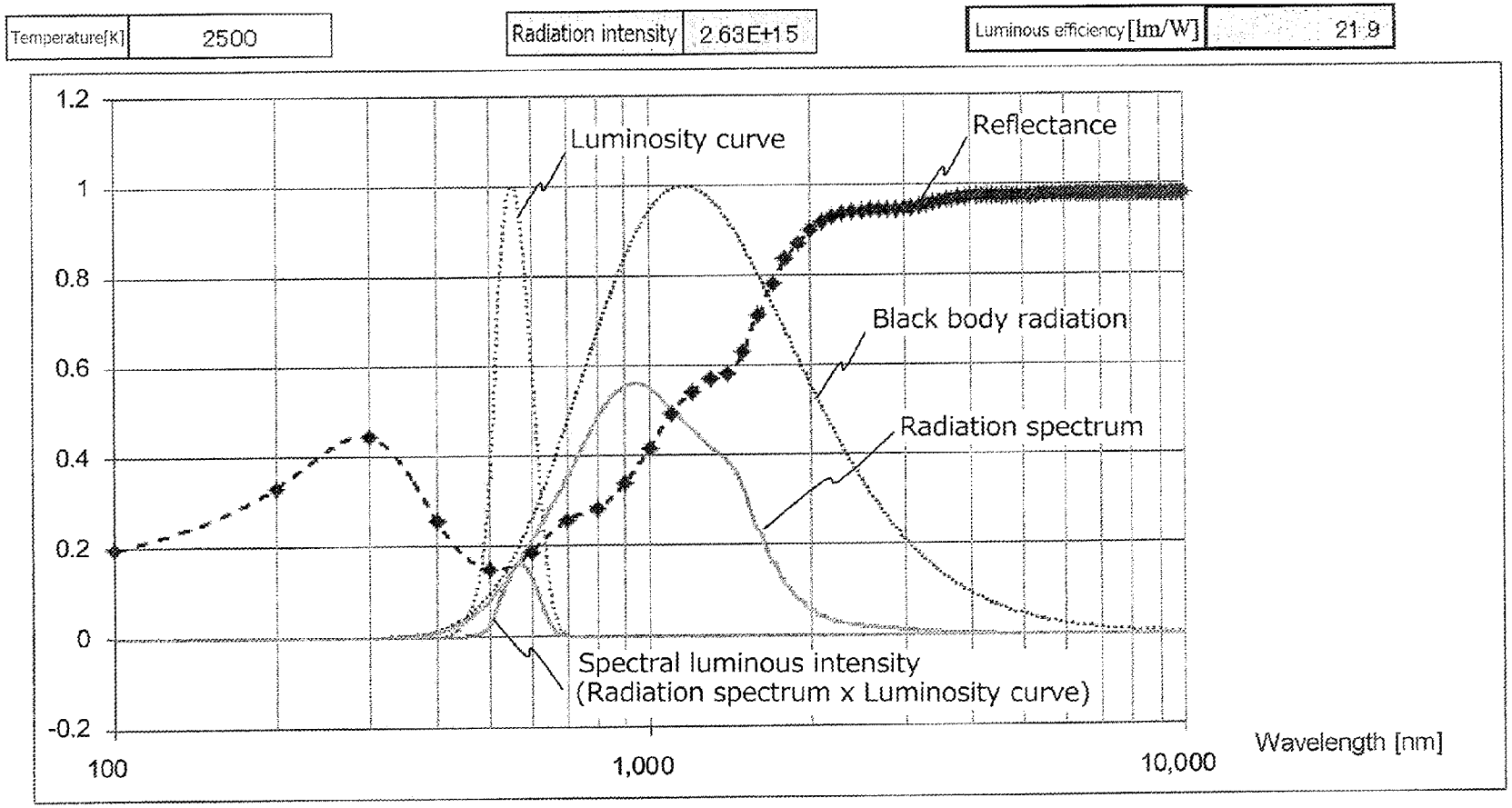
FIG. 81 is a graph showing the wavelength dependency of the reflectance, obtained radiation spectrum, and spectral luminous intensity of the filament of Example 6-1 comprising a W substrate and a visible light reflectance-reducing film (MgO film).

FIG. 81 shows the reflectance, radiation spectrum, and spectral luminous intensity of the substrate in the range where luminosity is obtained, which were obtained for the W substrate (filament) coated with an MgO film of 70 nm thickness by simulation and experiments. From comparison of the reflectance shown in FIG. 81 with the reflectance shown in FIG. 79 observed before forming the MgO film, it can be seen that the reflectance for the visible region was markedly reduced by the formation of the MgO film, i.e., around 50% of the reflectance of the W substrate observed before the formation of the MgO film was decreased to about 15 to 20% by the coating with the MgO film. As a result, the visible luminous efficiency of 16.9 lm/W could be improved to 21.9 lm/W, i.e., improved by 30%.

As described above, in this example, by coating the W substrate with a visible light reflectance-reducing film (MgO film), a filament for light sources and light source device showing an efficiency of about 22 lm/W at 2500K could be provided.

Example 6-2 to 6-11

In Examples 6-2 to 6-11, the substrate was constituted with W, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 6-2 to 6-11, the methods described in Example 6-1 can be used likewise.

Changes of the visible luminous efficiency of the filaments of Examples 6-2 to 6-11 to be observed when the thickness of the visible light reflectance-reducing film is variously changed were obtained by simulation. The results are shown in FIGS. 82 to 91, respectively.

Figure 82:
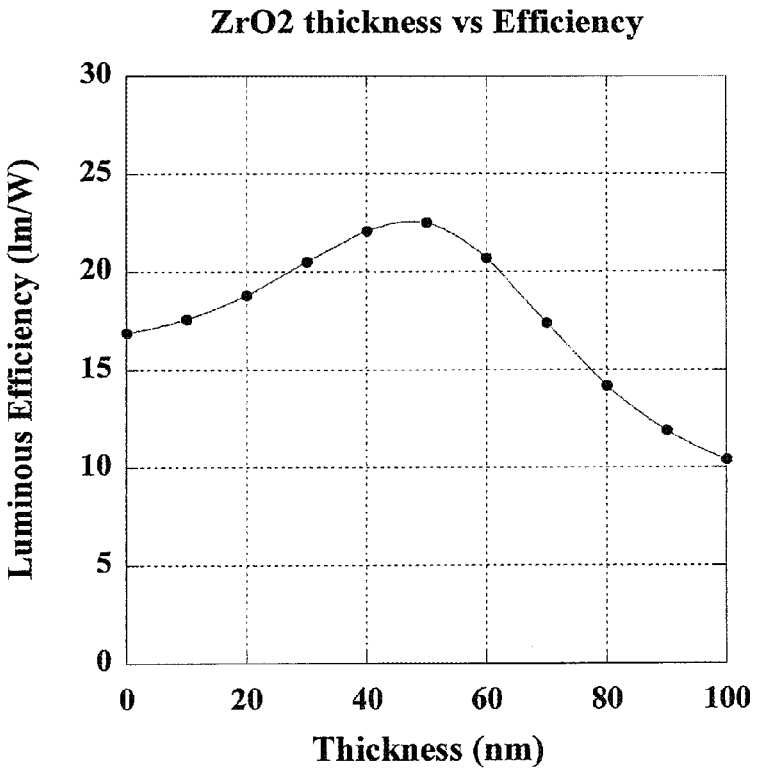
FIG. 82 is a graph showing the film thickness dependency of the luminous efficiency of the filament of Example 6-2 comprising a W substrate and a visible light reflectance-reducing film ($ZrO_2$ film).

FIG. 82 shows the visible luminous efficiency observed in Example 6-2 using a W substrate and a $ZrO_2$ film as the visible light reflectance-reducing film. As shown in FIG. 82, it can be seen that the maximum visible luminous efficiency of 22.5 lm/W was attained with a film thickness of 50 nm.

Figure 83:
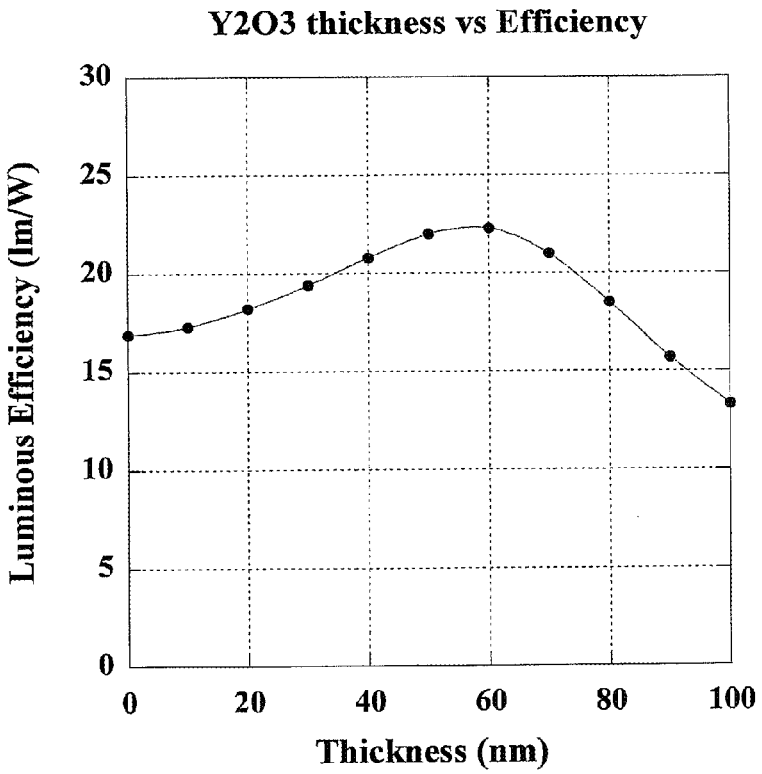
FIG. 83 is a graph showing the film thickness dependency of the luminous efficiency of the filament of Example 6-3 comprising a W substrate and a visible light reflectance-reducing film ($Y_2O_3$ film).

FIG. 83 shows the visible luminous efficiency observed in Example 6-3 using a W substrate and a $Y_2O_3$ film as the visible light reflectance-reducing film. As shown in FIG. 83, it can be seen that the maximum visible luminous efficiency of 22.3 lm/W was attained with a film thickness of 60 nm.

Figure 84:
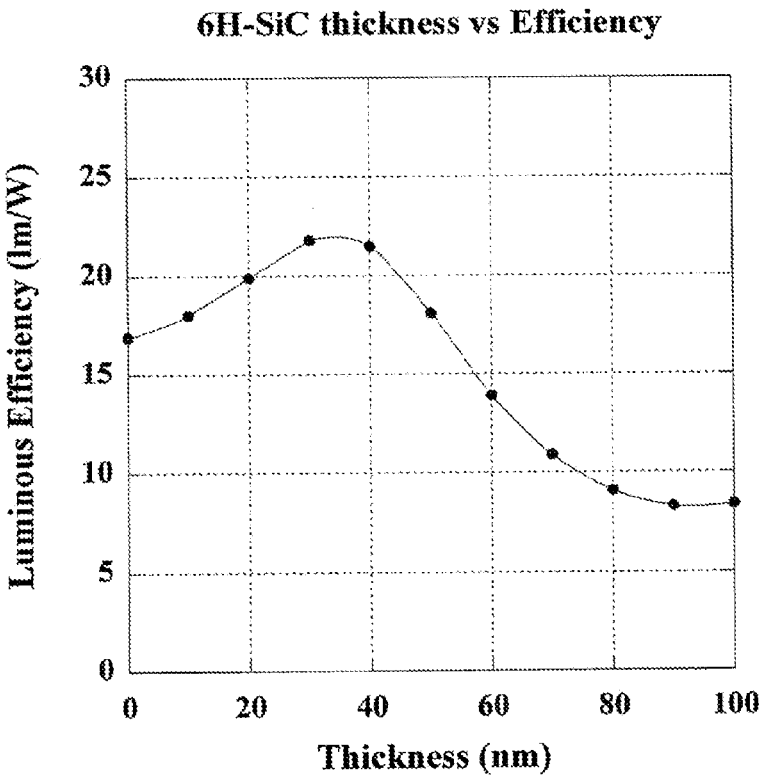
FIG. 84 is a graph showing the film thickness dependency of the luminous efficiency of the filament of Example 6-4 comprising a W substrate and a visible light reflectance-reducing film (6H-SiC (hexagonal SiC) film).

FIG. 84 shows the visible luminous efficiency observed in Example 6-4 using a W substrate and a 6H-SiC (hexagonal SiC) film as the visible light reflectance-reducing film. As shown in FIG. 84, it can be seen that the maximum visible luminous efficiency of 21.8 lm/W was attained with a film thickness of 30 nm.

Figure 85:
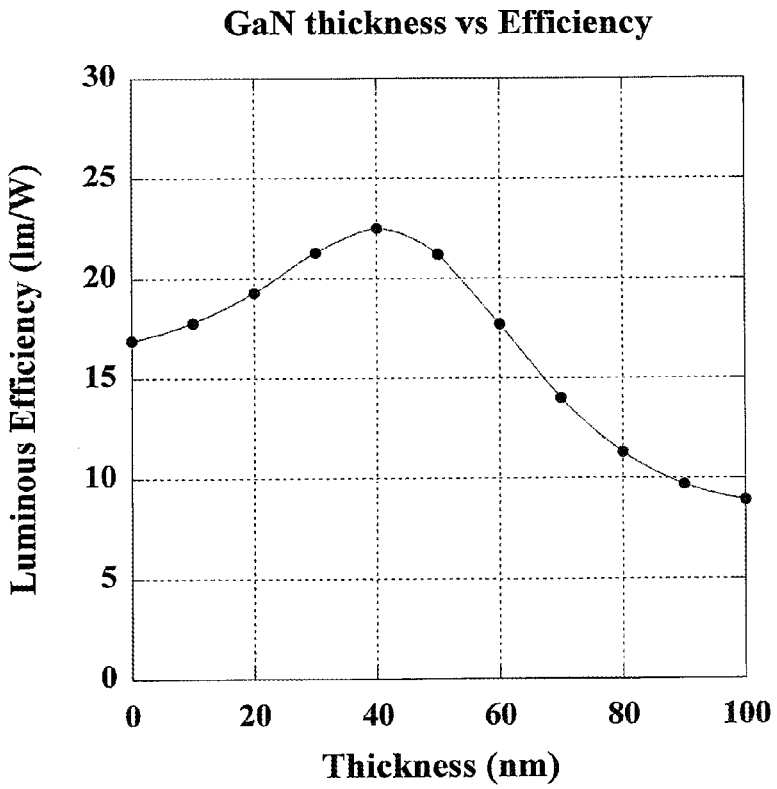
FIG. 85 is a graph showing the film thickness dependency of the luminous efficiency of the filament of Example 6-5 comprising a W substrate and a visible light reflectance-reducing film (GaN film).

FIG. 85 shows the visible luminous efficiency observed in Example 6-5 using a W substrate and a GaN film as the visible light reflectance-reducing film. As shown in FIG. 85, it can be seen that the maximum visible luminous efficiency of 22.5 lm/W was attained with a film thickness of 40 nm.

Figure 86:
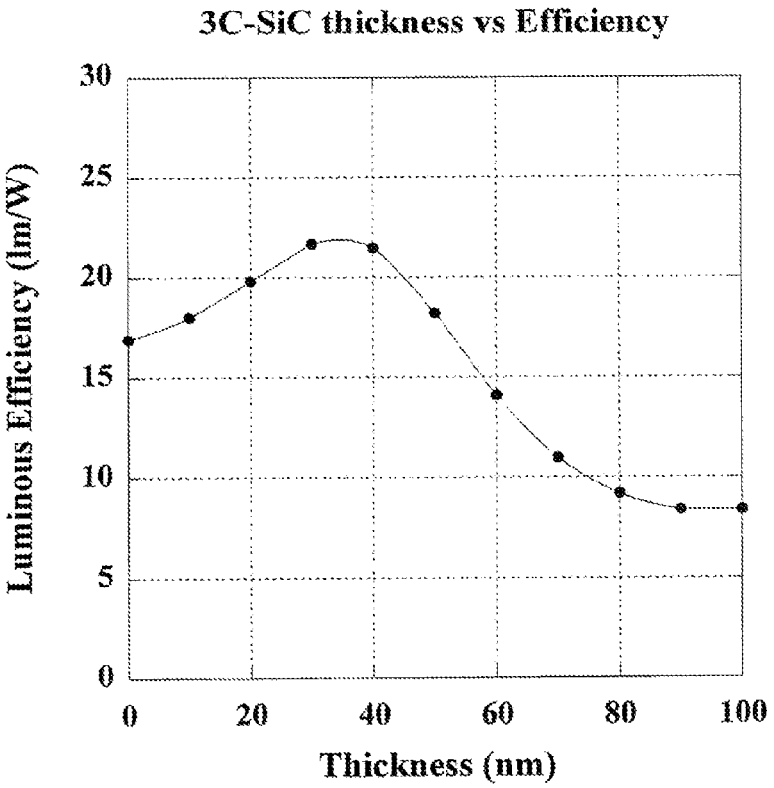
FIG. 86 is a graph showing the film thickness dependency of the luminous efficiency of the filament of Example 6-6 comprising a W substrate and a visible light reflectance-reducing film (3C-SiC (cubic SiC) film).

FIG. 86 shows the visible luminous efficiency observed in Example 6-6 using a W substrate and a 3C-SiC (cubic SiC) film as the visible light reflectance-reducing film. As shown in FIG. 86, it can be seen that the maximum visible luminous efficiency of 21.7 lm/W was attained with a film thickness of 30 nm.

Figure 87:
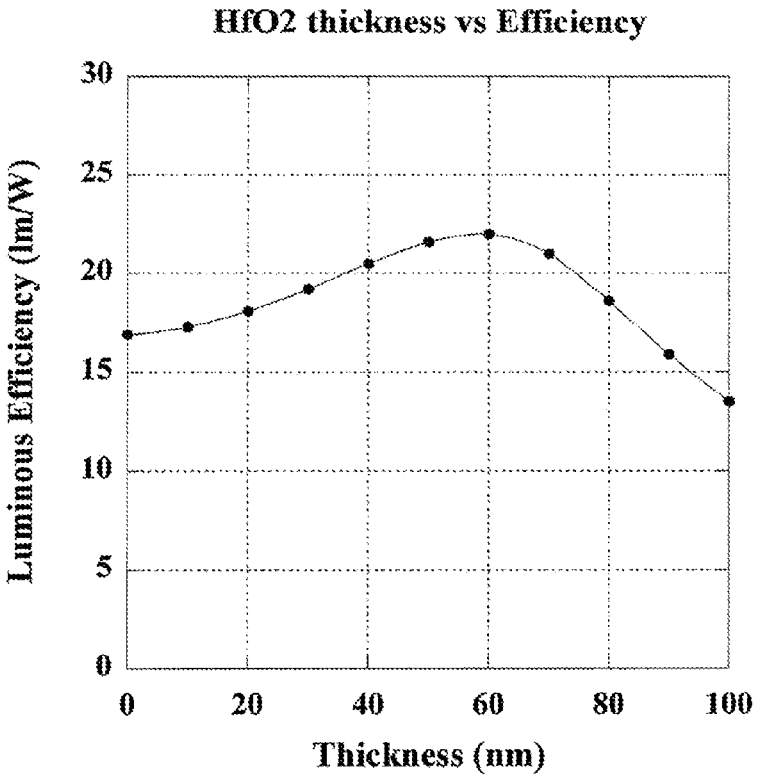
FIG. 87 is a graph showing the film thickness dependency of the luminous efficiency of the filament of Example 6-7 comprising a W substrate and a visible light reflectance-reducing film ($HfO_2$ film).

FIG. 87 shows the visible luminous efficiency observed in Example 6-7 using a W substrate and an $HfO_2$ film as the visible light reflectance-reducing film. As shown in FIG. 87, it can be seen that the maximum visible luminous efficiency of 22.0 lm/W was attained with a film thickness of 60 nm.

Figure 88:
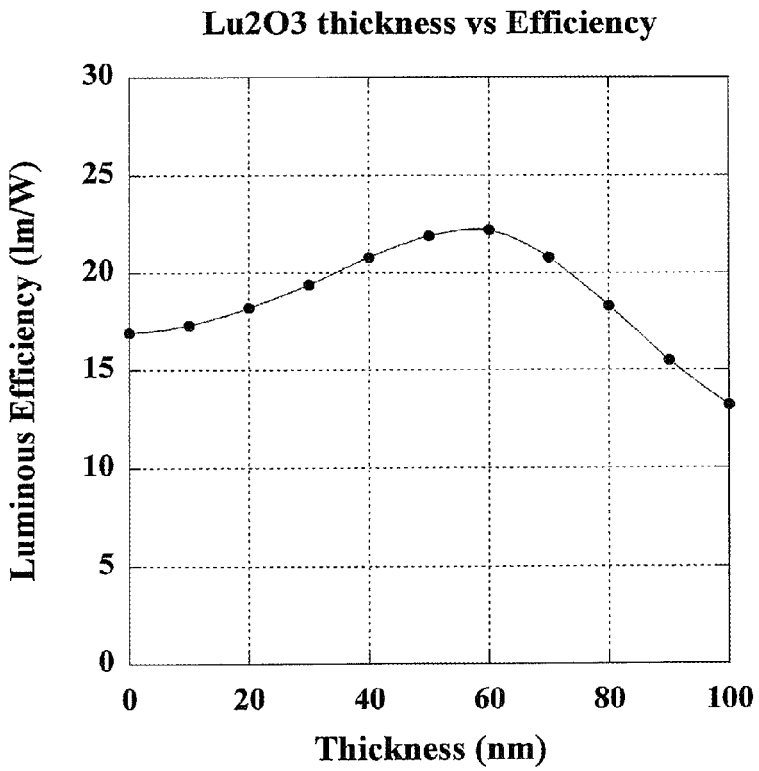
FIG. 88 is a graph showing the film thickness dependency of the luminous efficiency of the filament of Example 6-8 comprising a W substrate and a visible light reflectance-reducing film ($Lu_2O_3$ film).

FIG. 88 shows the visible luminous efficiency observed in Example 6-8 using a W substrate and an $Lu_2O_3$ film as the visible light reflectance-reducing film. As shown in FIG. 88, it can be seen that the maximum visible luminous efficiency of 22.2 lm/W was attained with a film thickness of 60 nm.

Figure 89:
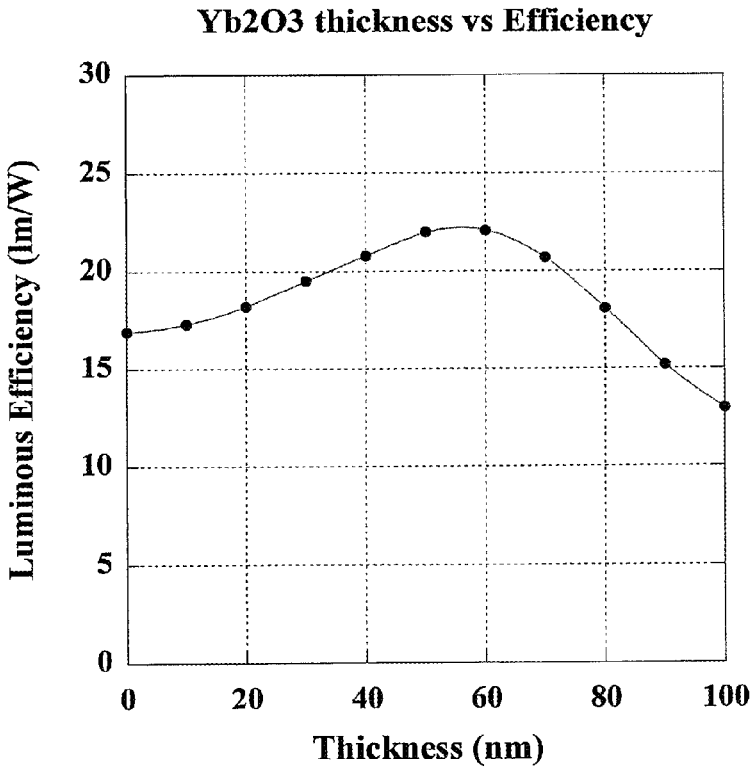
FIG. 89 is a graph showing the film thickness dependency of the luminous efficiency of the filament of Example 6-9 comprising a W substrate and a visible light reflectance-reducing film ($Yb_2O_3$ film).

FIG. 89 shows the visible luminous efficiency observed in Example 6-9 using a W substrate and a $Yb_2O_3$ film as the visible light reflectance-reducing film. As shown in FIG. 89, it can be seen that the maximum visible luminous efficiency of 22.1 lm/W was attained with a film thickness of 60 nm.

Figure 90:
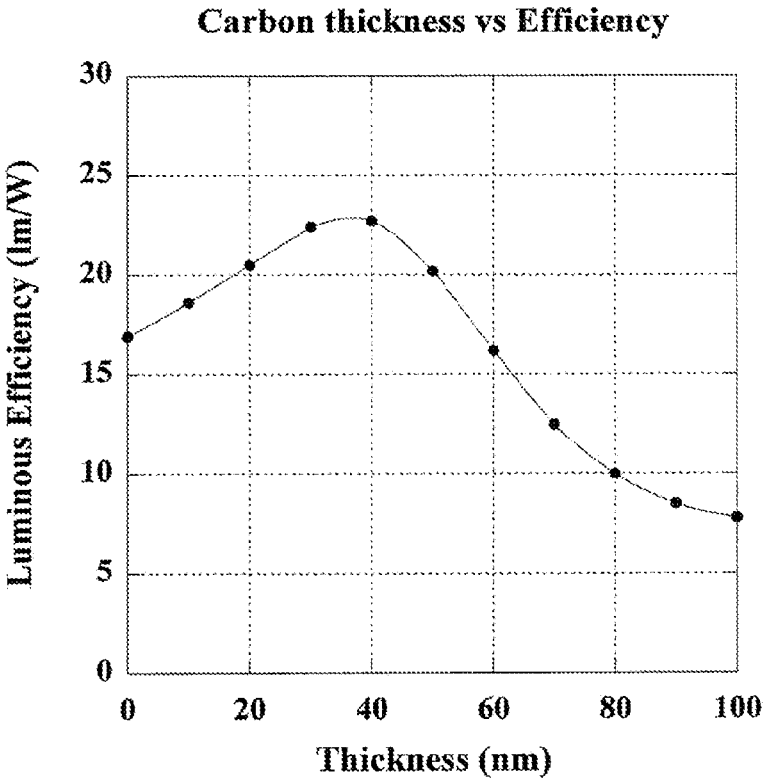
FIG. 90 is a graph showing the film thickness dependency of the luminous efficiency of the filament of Example 6-10 comprising a W substrate and a visible light reflectance-reducing film (graphite film).

FIG. 90 shows the visible luminous efficiency observed in Example 6-10 using a W substrate and a carbon (graphite) film as the visible light reflectance-reducing film. As shown in FIG. 90, it can be seen that the maximum visible luminous efficiency of 22.7 lm/W was attained with a film thickness of 40 nm.

Figure 91:
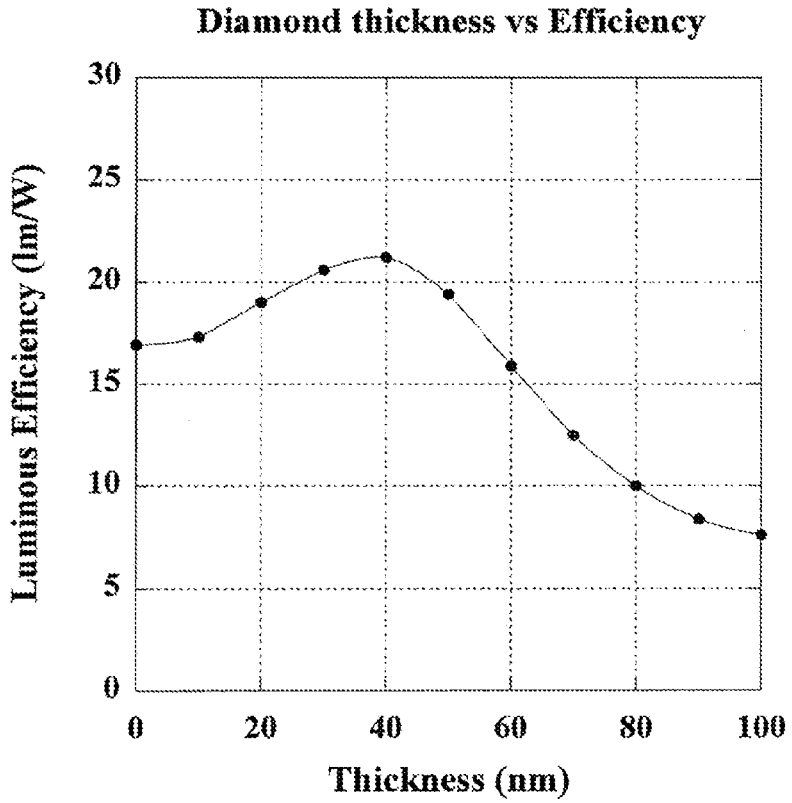
FIG. 91 is a graph showing the film thickness dependency of the luminous efficiency of the filament of Example 6-11 comprising a W substrate and a visible light reflectance-reducing film (diamond film).

FIG. 91 shows the visible luminous efficiency observed in Example 6-11 using a W substrate and a diamond film as the visible light reflectance-reducing film. As shown in FIG. 91, it can be seen that the maximum visible luminous efficiency of 21.2 lm/W was attained with a film thickness of 40 nm.

The results of Examples 6-1 to 6-11 are summarized as shown in FIG. 92. The values of the visible luminous efficiency of the filaments of Example 6-2 to 6-12 having the visible light reflectance-reducing film shown in FIGS. 82 to 91 are 21.2 lm/W or larger, and they were increased compared with the visible luminous efficiency 16.9 lm/W of the mirror-polished W substrate not having the visible light reflectance-reducing film. Therefore, the values of the visible luminous efficiency of the filaments of Example 6-2 to 6-12 could be improved by providing the visible light reflectance-reducing film, as in Example 6-1.

Example 7

Substrate: Ru

Examples 7-1 to 7-11 mentioned below are examples of constituting the substrate with Ru.

Example 7-1

In Example 7-1, there is explained a filament in which the substrate is constituted with Ru, and an MgO film is provided as a visible light reflectance-reducing film on the surface of the substrate.

The Ru substrate is produced by a known process. The substrate is formed in a desired shape, for example, in the form of wire, rod, thin plate, or the like. By polishing the surface of the substrate as in Example 1-1, the reflectance is increased for the infrared wavelength region and further longer wavelength region. The surface roughness is also the same as that described in Example 1-1.

Figure 93:
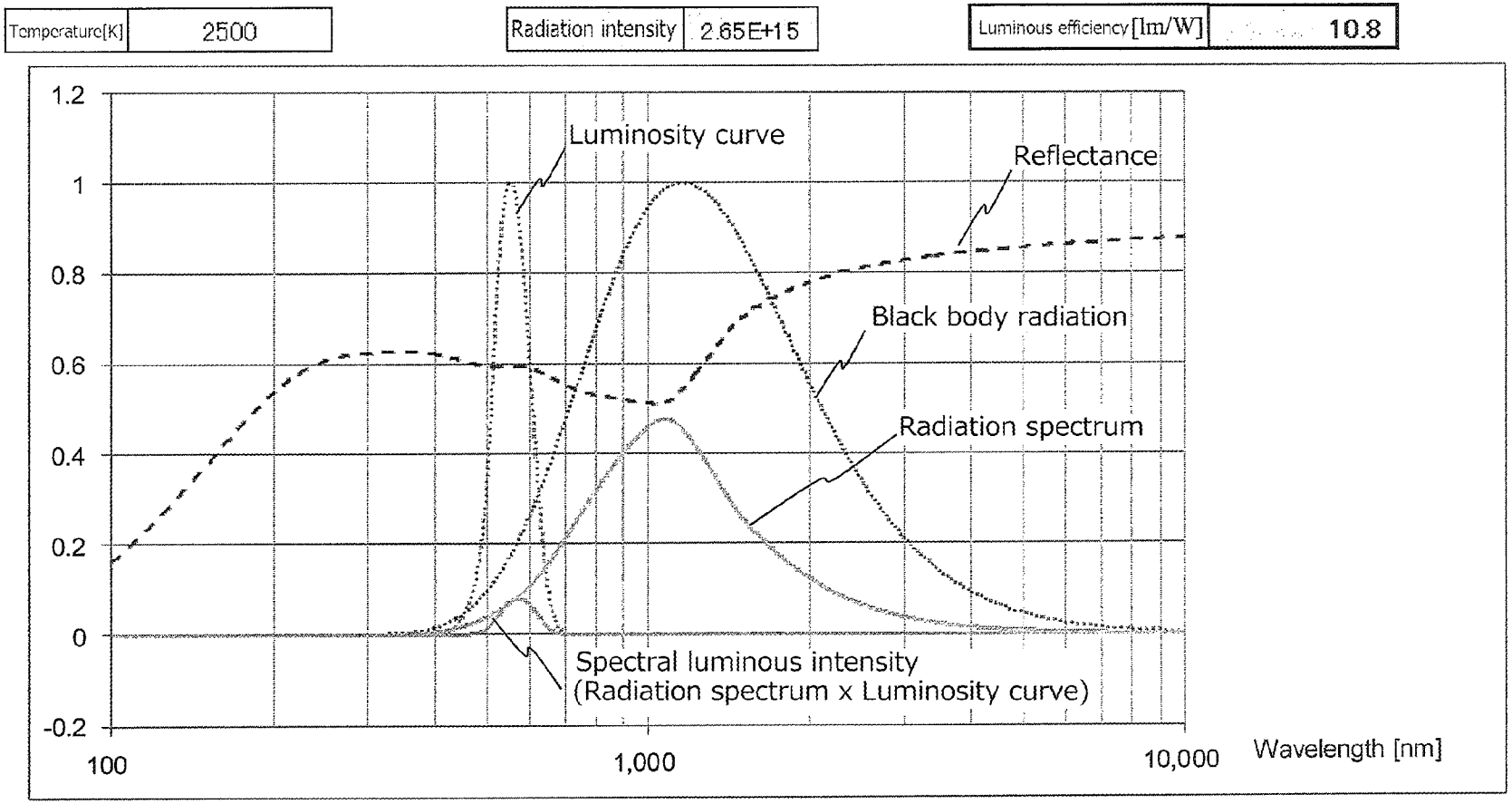
FIG. 93 is a graph showing the wavelength dependency of the reflectance, obtained radiation spectrum, and spectral luminous intensity observed for the Ru substrate used in Example 7 before polishing.
Figure 94:
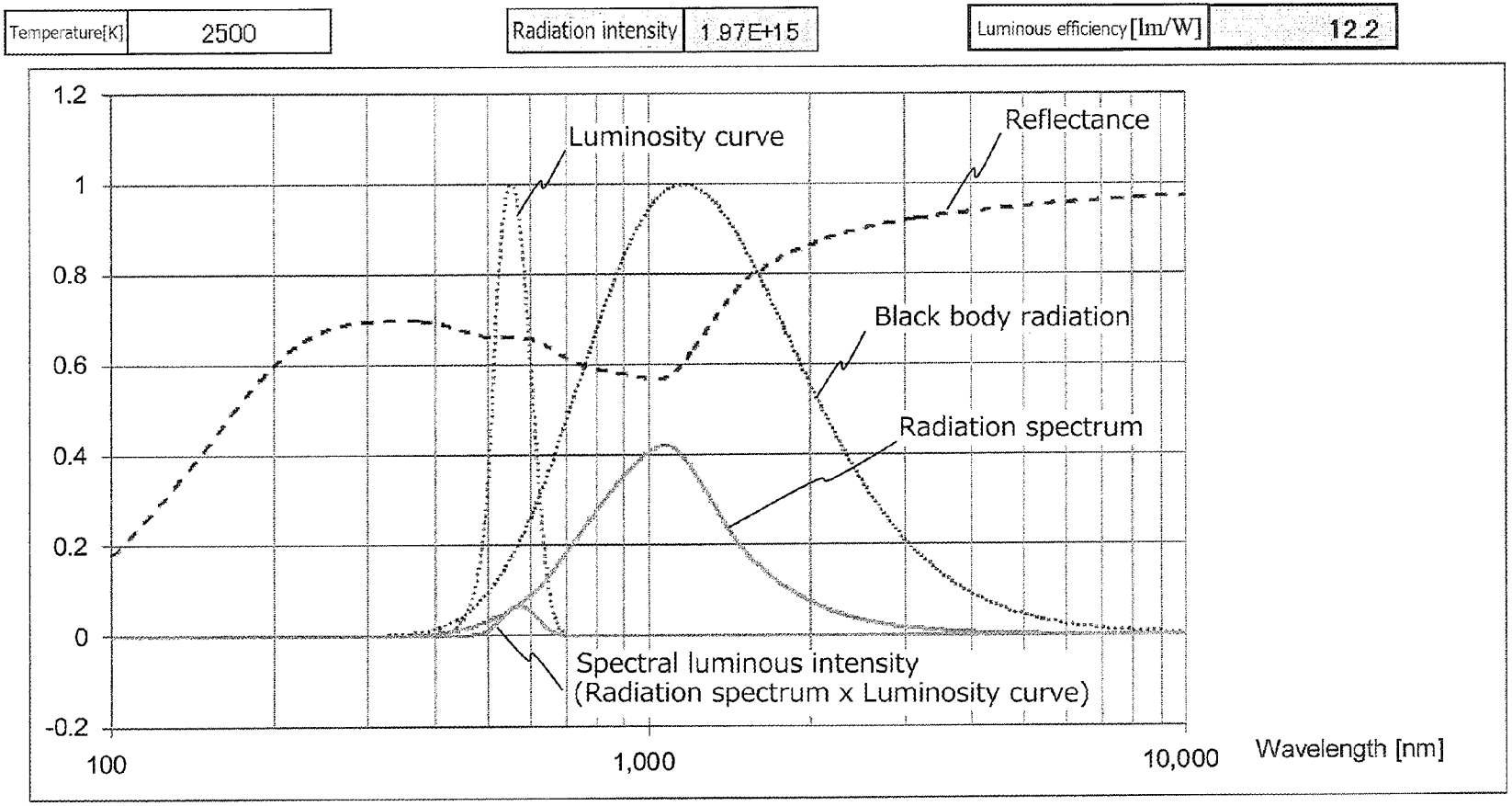
FIG. 94 is a graph showing the wavelength dependency of the reflectance, obtained radiation spectrum, and spectral luminous intensity observed for the Ru substrate used in Example 7 after polishing.

FIGS. 93 and 94 show the reflectance, radiation spectra and spectral luminosity intensity of the substrates in the range where luminosity is obtained, which are for an Ru substrate not polished and having a rough surface and the mirror-polished Ru substrate, respectively, and were obtained by simulation and experiments. The both are for a temperature of 2500K.

As shown in FIG. 94, it can be seen that, by the mirror polishing of the substrate surface, the reflectance of the substrate for the infrared wavelength region of wavelengths of 1 to 10 μm was improved by 10% or more compared with the reflectance of the rough surface shown in FIG. 93. The emissivity for the infrared wavelength region was suppressed correspondingly to the improvement of the reflectance. As a result, the luminous efficiency (radiation efficiency for visible lights) was increased from 10.8 lm/W to 12.2 lm/W, i.e., improved by 13%.

Figure 95:
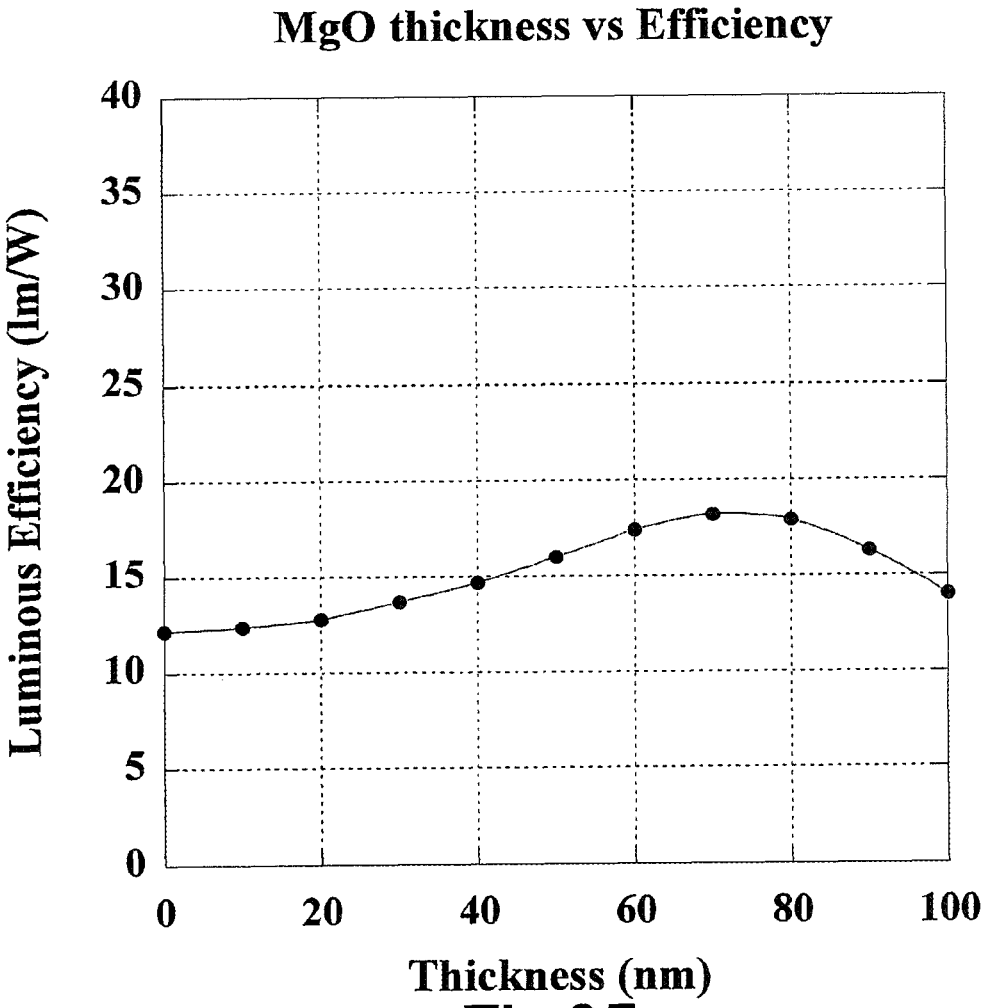
FIG. 95 is a graph showing the film thickness dependency of the luminous efficiency of the filament of Example 7-1 comprising an Ru substrate and a visible light reflectance-reducing film (MgO film).

According to the presently disclosed subject matter, a visible light reflectance-reducing film is formed on the surface of the mirror-polished substrate to reduce the visible light reflectance. In Example 7-1, an MgO film was formed as the visible light reflectance-reducing film. The method for forming the MgO film was as described in Example 1-1. The thickness of the visible light reflectance-reducing film (MgO film) was changed in the range of 0 to 100 nm, and visible luminous efficiency was obtained for each thickness. As a result, thickness dependency of the visible luminous efficiency was observed as shown in FIG. 95. From the results shown in FIG. 95, the optimal thickness of the MgO film was determined to be 70 nm. The luminous efficiency for visible lights of the filament coated with the MgO film having the optimal thickness of 70 nm was 18.2 lm/W.

Figure 96:
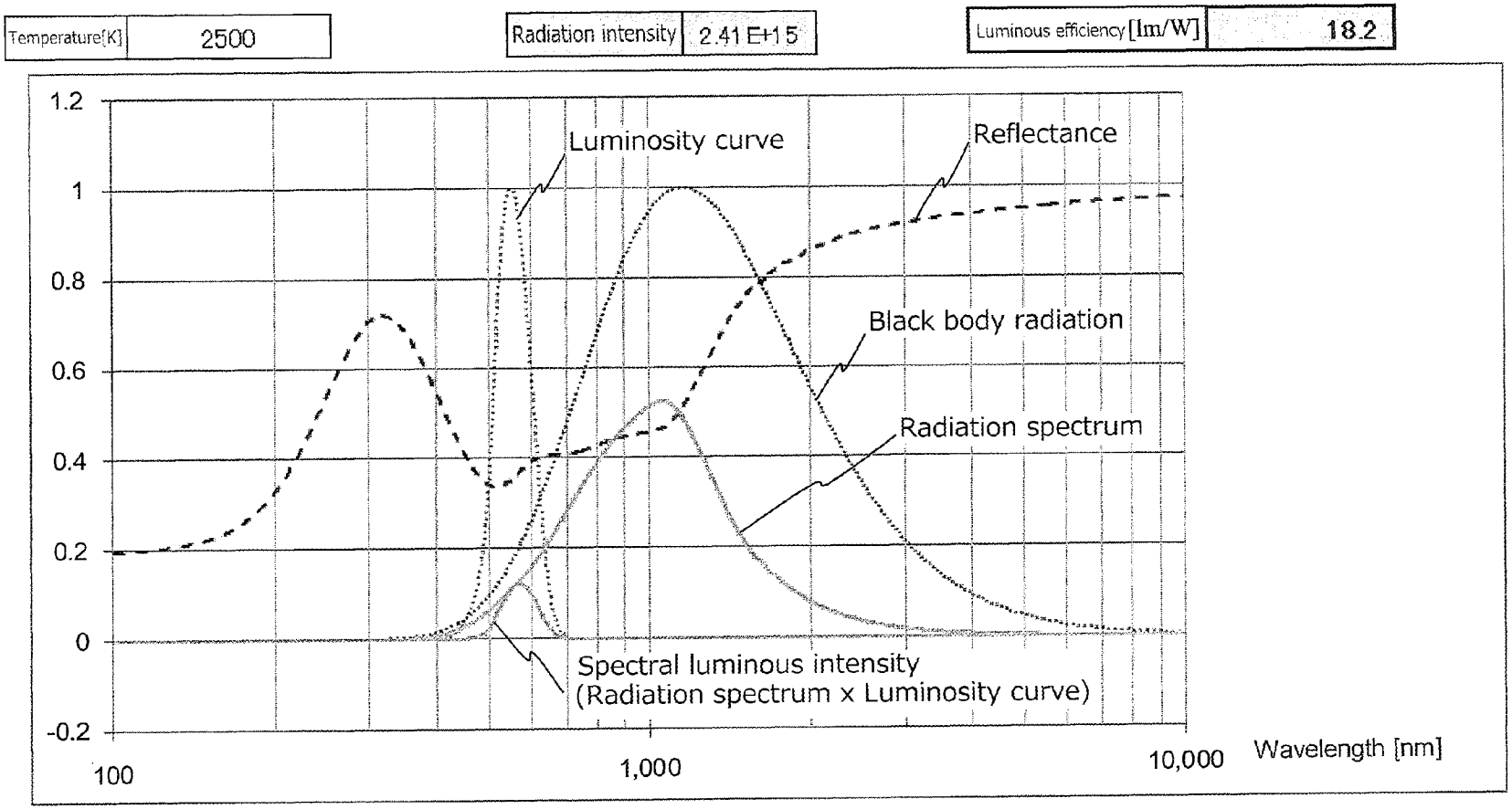
FIG. 96 is a graph showing the wavelength dependency of the reflectance, obtained radiation spectrum, and spectral luminous intensity of the filament of Example 7-1 comprising an Ru substrate and a visible light reflectance-reducing film (MgO film).

FIG. 96 shows the reflectance, radiation spectrum, and spectral luminous intensity of the substrate in the range where luminosity is obtained, which were obtained for the Ru substrate (filament) coated with an MgO film of 70 nm thickness by simulation and experiments. From comparison of the reflectance shown in FIG. 96 with the reflectance shown in FIG. 94 observed before forming the MgO film, it can be seen that the reflectance for the visible region was markedly reduced by the formation of the MgO film, i.e., around 65% of the reflectance of the Ru substrate observed before the formation of the MgO film was decreased to about 35 to 40% by the coating with the MgO film. As a result, the visible luminous efficiency of 12.2 lm/W could be improved to 18.2 lm/W, i.e., improved by 58%.

As described above, in this example, by coating the Ru substrate with a visible light reflectance-reducing film (MgO film), a filament for light sources and light source device showing an efficiency of about 18 lm/W at 2500K could be provided.

Example 7-2 to 7-11

In Examples 7-2 to 7-11, the substrate was constituted with Ru, and the visible light reflectance-reducing film was formed with $ZrO_2$, $Y_2O_3$, 6H-SiC (hexagonal SiC), GaN, 3C-SiC (cubic SiC), $HfO_2$, $Lu_2O_3$, $Yb_2O_3$, carbon (graphite), and diamond, respectively.

As the methods for manufacturing and polishing the substrate, and the method for forming the visible light reflectance-reducing film used in Examples 7-2 to 7-11, the methods described in Example 7-1 can be used likewise.

Changes of the visible luminous efficiency of the filaments of Examples 7-2 to 7-11 to be observed when the thickness of the visible light reflectance-reducing film is variously changed were obtained by simulation. The results are shown in FIGS. 97 to 106, respectively.

Figure 97:
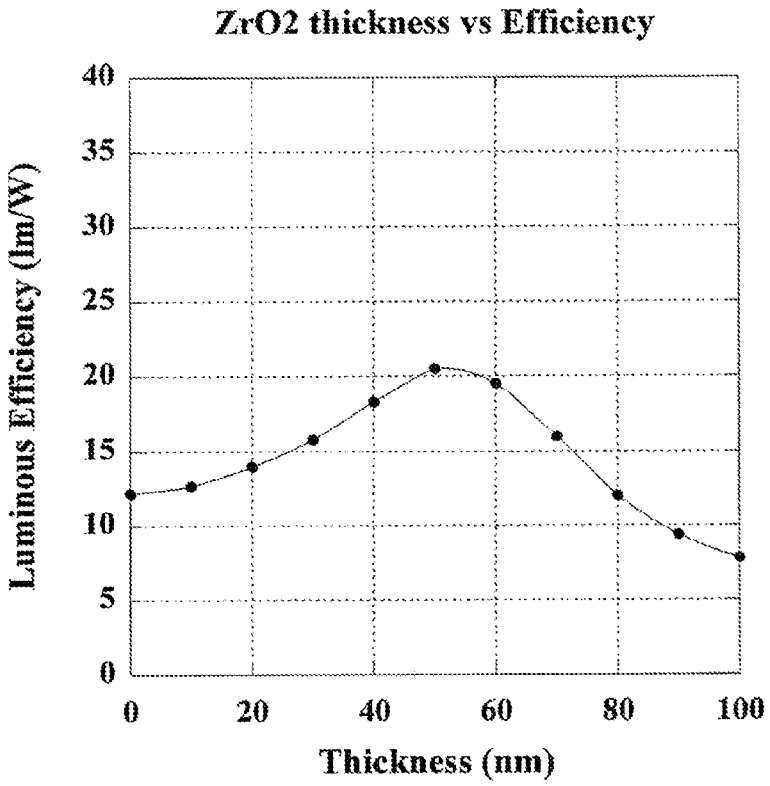
FIG. 97 is a graph showing the film thickness dependency of the luminous efficiency of the filament of Example 7-2 comprising an Ru substrate and a visible light reflectance-reducing film ($ZrO_2$ film).

FIG. 97 shows the visible luminous efficiency observed in Example 7-2 using an Ru substrate and a $ZrO_2$ film as the visible light reflectance-reducing film. As shown in FIG. 97, it can be seen that the maximum visible luminous efficiency of 20.5 lm/W was attained with a film thickness of 50 nm.

Figure 98:
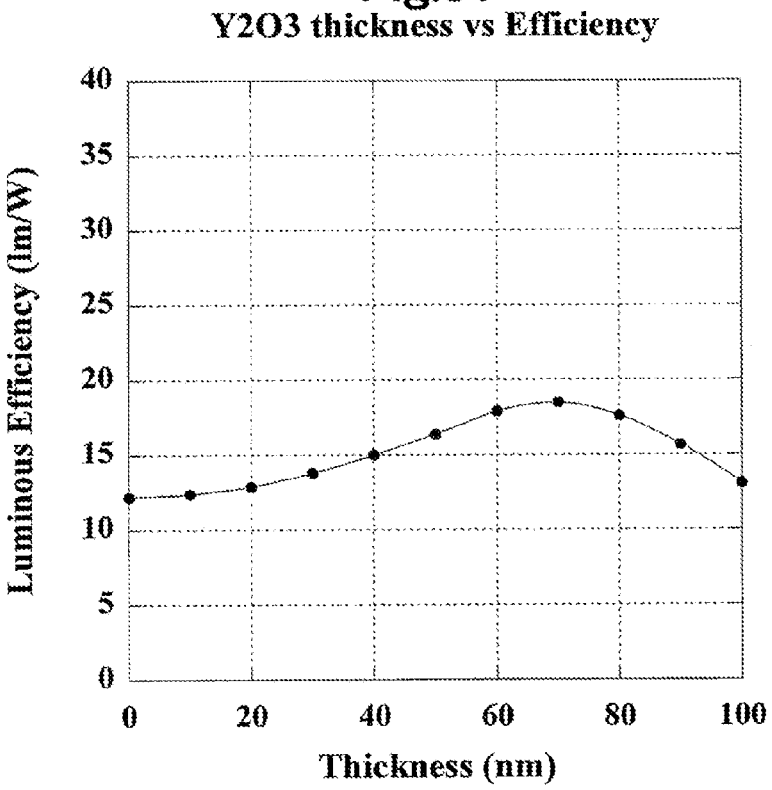
FIG. 98 is a graph showing the film thickness dependency of the luminous efficiency of the filament of Example 7-3 comprising an Ru substrate and a visible light reflectance-reducing film ($Y_2O_3$ film).

FIG. 98 shows the visible luminous efficiency observed in Example 7-3 using an Ru substrate and a $Y_2O_3$ film as the visible light reflectance-reducing film. As shown in FIG. 98, it can be seen that the maximum visible luminous efficiency of 19.4 lm/W was attained with a film thickness of 60 nm.

Figure 99:
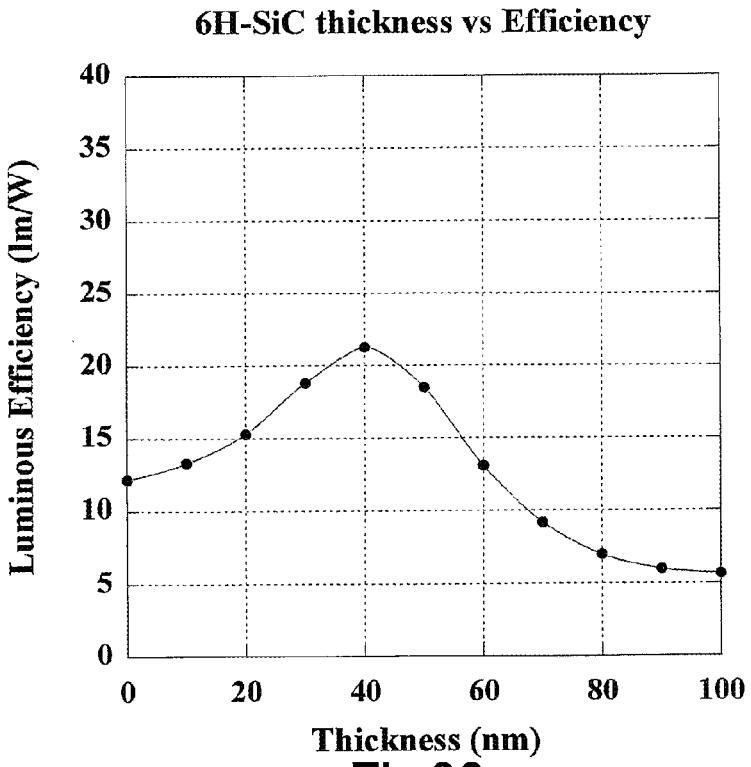
FIG. 99 is a graph showing the film thickness dependency of the luminous efficiency of the filament of Example 7-4 comprising an Ru substrate and a visible light reflectance-reducing film (6H-SiC (hexagonal SiC) film).

FIG. 99 shows the visible luminous efficiency observed in Example 7-4 using an Ru substrate and a 6H-SiC (hexagonal SiC) film as the visible light reflectance-reducing film. As shown in FIG. 99, it can be seen that the maximum visible luminous efficiency of 21.3 lm/W was attained with a film thickness of 40 nm.

Figure 100:
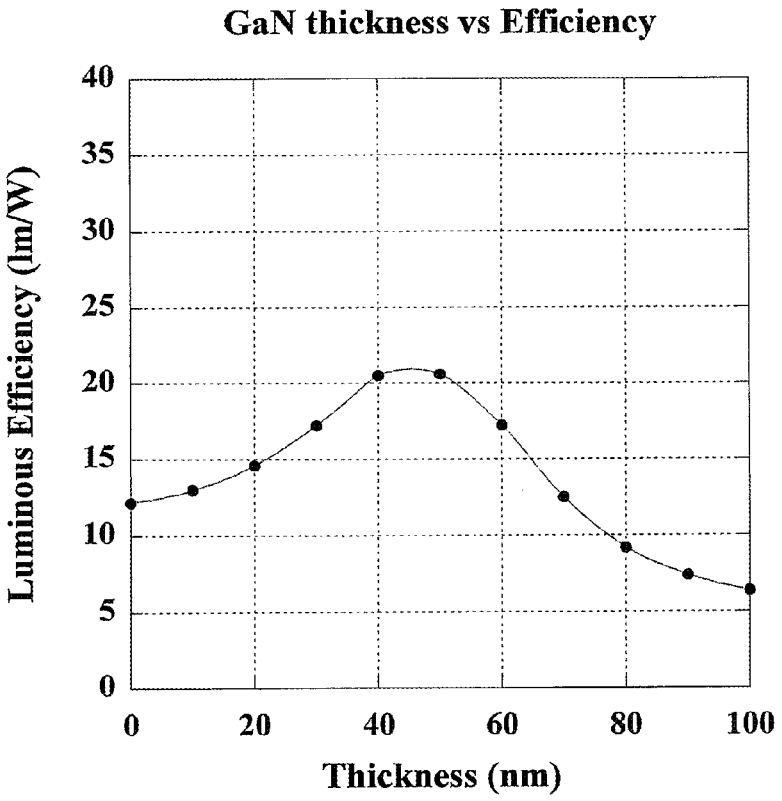
FIG. 100 is a graph showing the film thickness dependency of the luminous efficiency of the filament of Example 7-5 comprising an Ru substrate and a visible light reflectance-reducing film (GaN film).

FIG. 100 shows the visible luminous efficiency observed in Example 7-5 using an Ru substrate and a GaN film as the visible light reflectance-reducing film. As shown in FIG. 100, it can be seen that the maximum visible luminous efficiency of 20.6 lm/W was attained with a film thickness of 50 nm.

Figure 101:
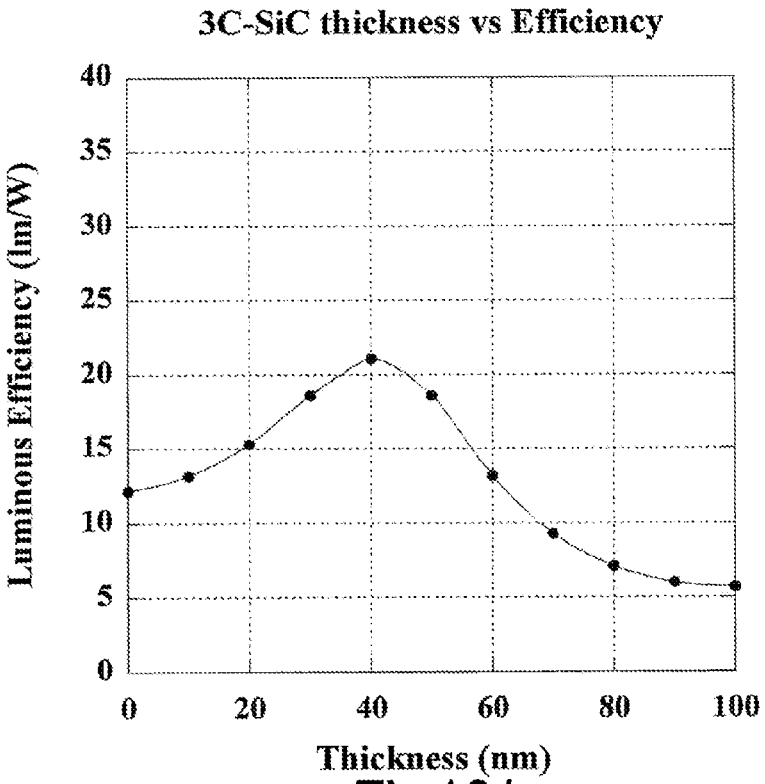
FIG. 101 is a graph showing the film thickness dependency of the luminous efficiency of the filament of Example 7-6 comprising an Ru substrate and a visible light reflectance-reducing film (3C-SiC (cubic SiC) film).

FIG. 101 shows the visible luminous efficiency observed in Example 7-6 using an Ru substrate and a 3C-SiC (cubic SiC) film as the visible light reflectance-reducing film. As shown in FIG. 101, it can be seen that the maximum visible luminous efficiency of 21.1 lm/W was attained with a film thickness of 40 nm.

Figure 102:
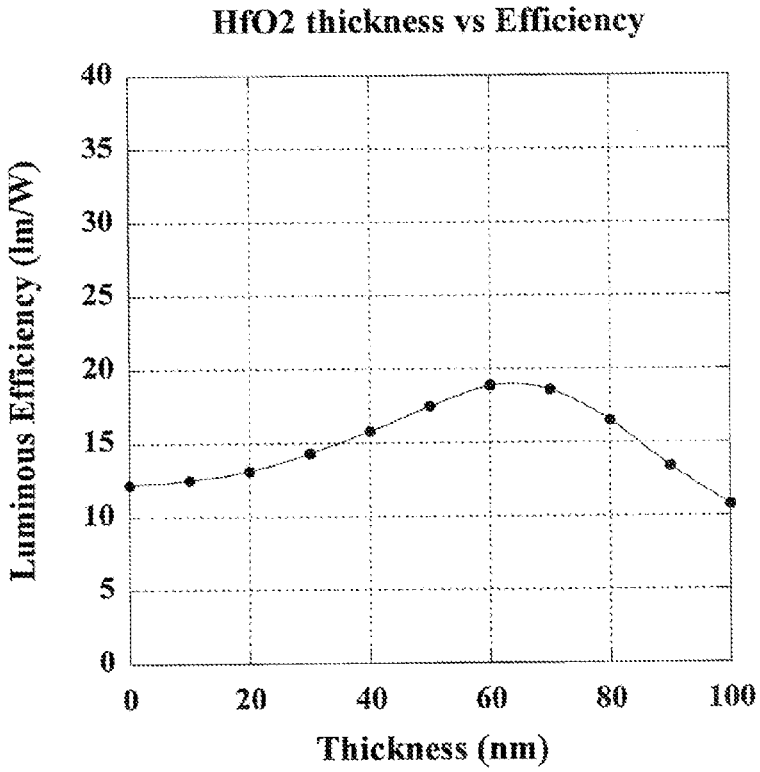
FIG. 102 is a graph showing the film thickness dependency of the luminous efficiency of the filament of Example 7-7 comprising an Ru substrate and a visible light reflectance-reducing film ($HfO_2$ film).

FIG. 102 shows the visible luminous efficiency observed in Example 7-7 using an Ru substrate and an $HfO_2$ film as the visible light reflectance-reducing film. As shown in FIG. 102, it can be seen that the maximum visible luminous efficiency of 18.9 lm/W was attained with a film thickness of 60 nm.

Figure 103:
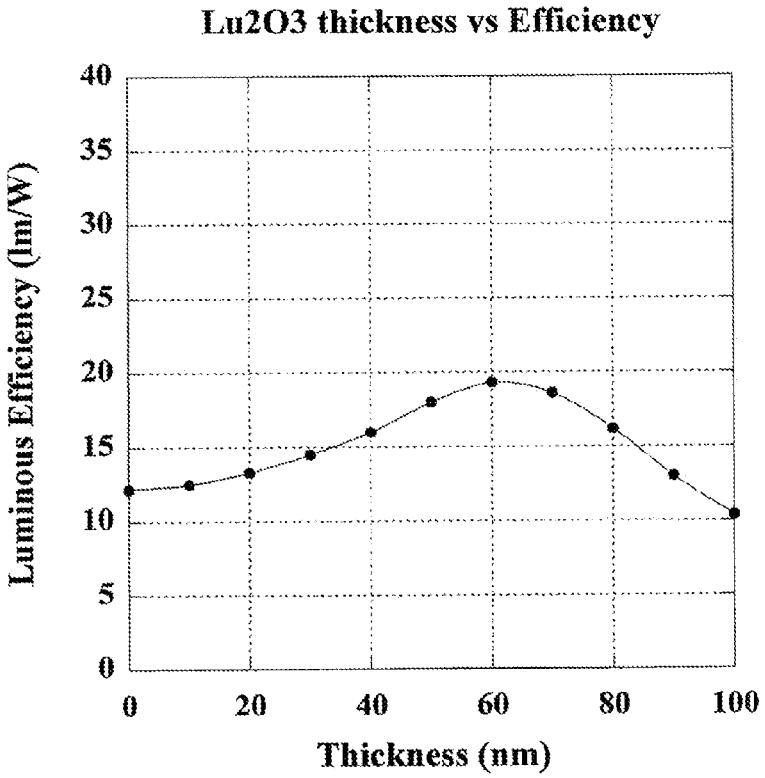
FIG. 103 is a graph showing the film thickness dependency of the luminous efficiency of the filament of Example 7-8 comprising an Ru substrate and a visible light reflectance-reducing film ($Lu_2O_3$ film).

FIG. 103 shows the visible luminous efficiency observed in Example 7-8 using an Ru substrate and an $Lu_2O_3$ film as the visible light reflectance-reducing film. As shown in FIG. 103, it can be seen that the maximum visible luminous efficiency of 19.3 lm/W was attained with a film thickness of 60 nm.

Figure 104:
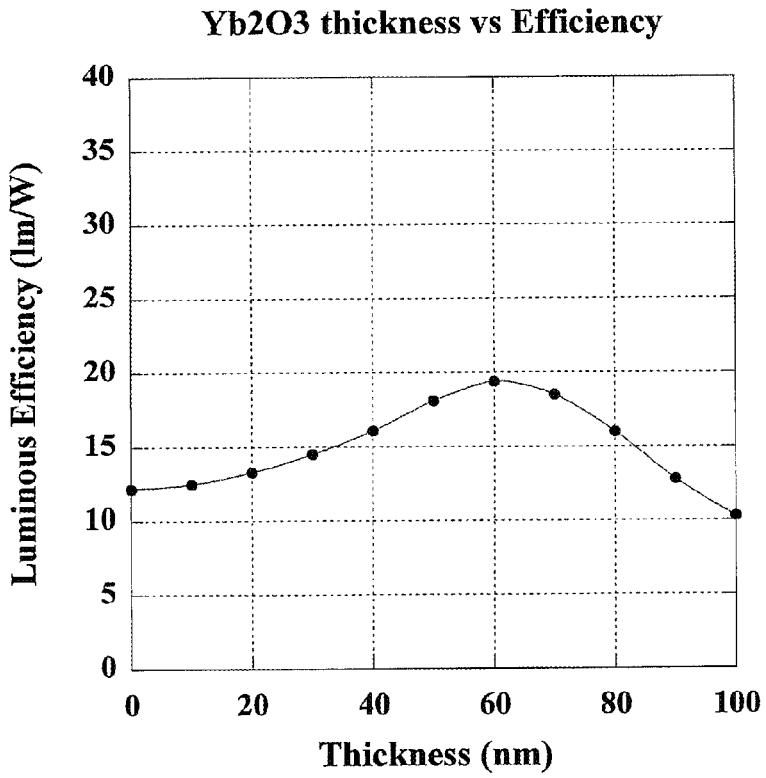
FIG. 104 is a graph showing the film thickness dependency of the luminous efficiency of the filament of Example 7-9 comprising an Ru substrate and a visible light reflectance-reducing film ($Yb_2O_3$ film).

FIG. 104 shows the visible luminous efficiency observed in Example 7-9 using an Ru substrate and a $Yb_2O_3$ film as the visible light reflectance-reducing film. As shown in FIG. 104, it can be seen that the maximum visible luminous efficiency of 19.4 lm/W was attained with a film thickness of 60 nm.

Figure 105:
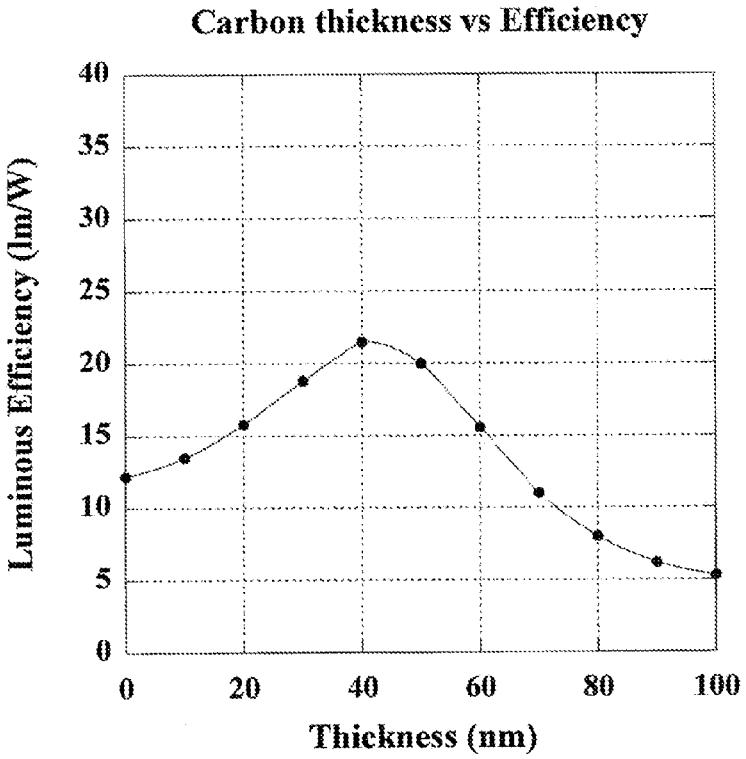
FIG. 105 is a graph showing the film thickness dependency of the luminous efficiency of the filament of Example 7-10 comprising an Ru substrate and a visible light reflectance-reducing film (graphite film).

FIG. 105 shows the visible luminous efficiency observed in Example 7-10 using an Ru substrate and a carbon (graphite) film as the visible light reflectance-reducing film. As shown in FIG. 105, it can be seen that the maximum visible luminous efficiency of 21.5 lm/W was attained with a film thickness of 40 nm.

Figure 106:
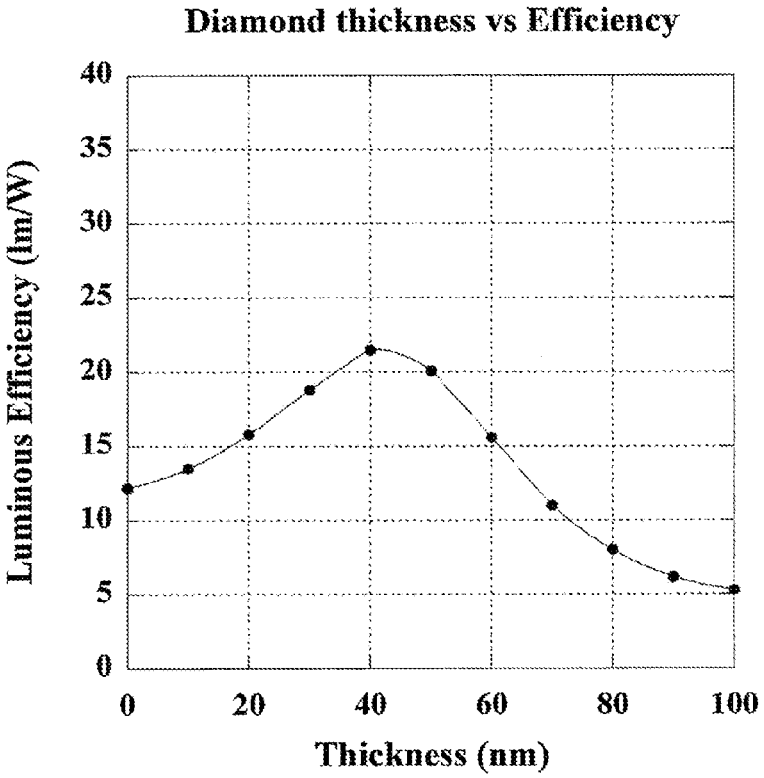
FIG. 106 is a graph showing the film thickness dependency of the luminous efficiency of the filament of Example 7-11 comprising an Ru substrate and a visible light reflectance-reducing film (diamond film).

FIG. 106 shows the visible luminous efficiency observed in Example 7-11 using an Ru substrate and a diamond film as the visible light reflectance-reducing film. As shown in FIG. 106, it can be seen that the maximum visible luminous efficiency of 21.5 lm/W was attained with a film thickness of 40 nm.

The results of Examples 7-1 to 7-11 are summarized as shown in FIG. 107. The values of the visible luminous efficiency of the filaments of Example 7-2 to 7-12 having the visible light reflectance-reducing film shown in FIGS. 97 to 106 are 18.2 lm/W or larger, and they were increased compared with the visible luminous efficiency 12.2 lm/W of the mirror-polished Ru substrate not having the visible light reflectance-reducing film. Therefore, the values of the visible luminous efficiency of the filaments of Example 7-2 to 7-12 could be improved by providing the visible light reflectance-reducing film, as in Example 7-1.

Example 8

In Example 8, an incandescent light bulb is explained as a light source device using any one of the filaments of Examples 1 to 7.

Figure 108:
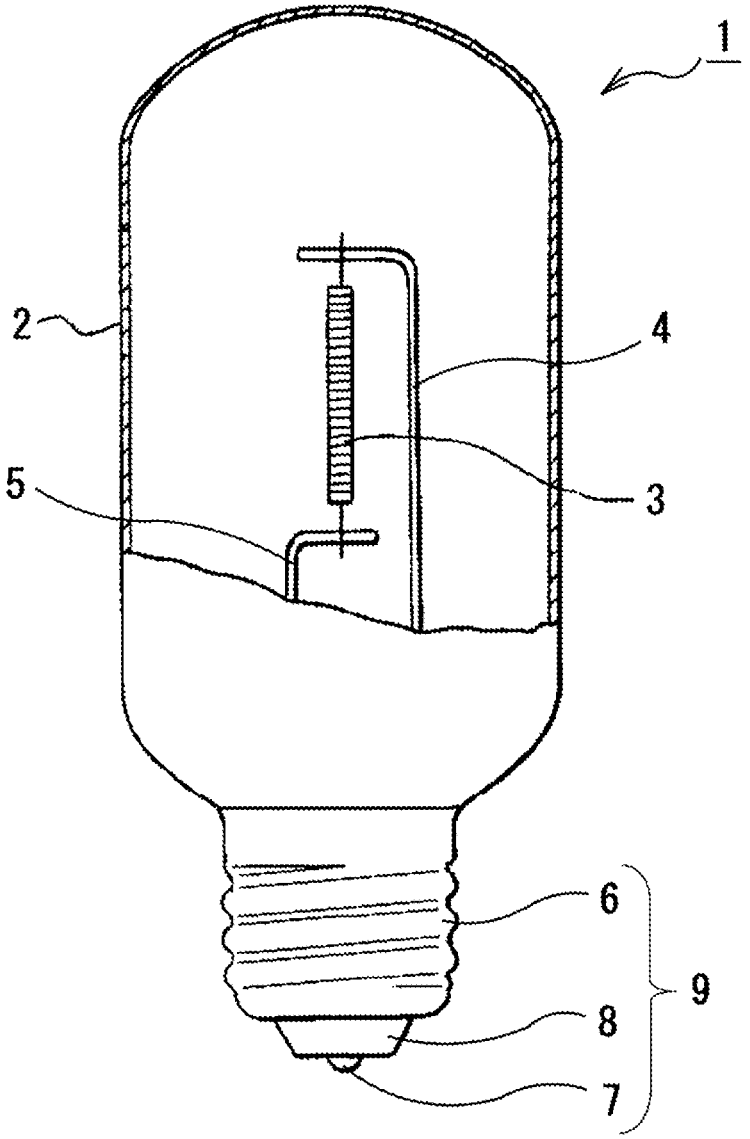
FIG. 108 is a broken sectional view of the incandescent lamp of Example 8.

FIG. 108 shows a broken sectional view of the incandescent light bulb using any one of the filaments of Examples 1 to 7. The incandescent light bulb 1 is constituted with a translucent gastight container 2, a filament 3 disposed in the inside of the translucent gastight container 2, and a pair of lead wires 4 and 5 electrically connected to the both ends of the filament 3 and supporting the filament 3. The translucent gastight container 2 is constituted with, for example, a glass bulb. The inside of the translucent gastight container 2 is maintained to be a high vacuum state of $10^{-1}$ to $10^{-6}$ Pa. If $O_2$, $H_2$, a halogen gas, an inert gas, or a mixed gas of these is introduced into the inside of the translucent gastight container 2 at a pressure of $10^7$ to $10^{-1}$ Pa, sublimation and degradation of the visible light reflectance-reducing film formed on the filament are suppressed, and therefore the lifetime-prolonging effect can be expected, as in the conventional halogen lamps.

A base 9 is adhered to a sealing part of the translucent gastight container 2. The base 9 comprises a side electrode 6, a center electrode 7, and an insulating part 8, which insulates the side electrode 6 and the center electrode 7. One end of the lead wire 4 is electrically connected to the side electrode 6, and one end of the lead wire 5 is electrically connected to the center electrode 7.

The filament 3 is any one of the filaments of Examples 1 to 7, and in this example, it is a filament in the shape of a wire wound into a spiral shape.

Since the filament 3 has the visible light reflectance-reducing film on the substrate as described in Examples 1 to 7, it shows high reflectance for the infrared wavelength region, and low reflectance for the visible region. With such a configuration, high visible luminous efficiency (luminous efficiency) can be realized. Therefore, according to the presently disclosed subject matter, with the simple configuration of providing the visible light reflectance-reducing film on the surface of the filament, infrared radiation can be suppressed, and as a result, input electric power-to-visible light conversion efficiency can be increased. Therefore, an inexpensive and efficient energy-saving electric bulb for illumination can be provided.

In Examples 1 to 7 mentioned above, the reflectance of the filament surface was improved by mechanical polishing.

However, the means for improving the reflectance is not limited to mechanical polishing, and any other method can of course be used, so long as the reflectance of the filament surface can be improved. For example, there can be employed wet or dry etching, a method of contacting the filament with a smooth surface at the time of drawing, forging, or rolling, and so forth.

The filament of the presently disclosed subject matter can also be used for purposes other than light source devices such as incandescent light bulb. For example, it can be used as an electric wire for heaters, electric wire for welding processing, electron source of thermoelectronic emission (X-ray tube, electron microscope, etc.), and so forth. Also in these cases, the filament can be efficiently heated to high temperature with a little input power because of the infrared light radiation suppressing action, and therefore the energy efficiency can be improved.

Further, in the examples, filaments that suppress infrared light radiation and improve visible luminous efficiency are explained. However, it is also possible to provide a filament showing high radiation efficiency not only for visible lights, but also for near-infrared lights, by shifting the wavelength of the infrared region for which radiation is to be suppressed to the longer wavelength side. It is also thereby made possible to obtain a light source device showing high radiation efficiency for near-infrared lights. In particular, when the translucent gastight container consists of a material comprising silicon and oxygen as constituent elements, all of lights of a wavelength of 2 μm or longer are absorbed by the translucent gastight container, but by providing a filament that emits near-infrared lights of a wavelength not longer than 2 μm, there can be provided a light source that shows high radiation efficiency and does not warm the translucent gastight container.

DESCRIPTION OF NUMERICAL NOTATIONS

1 . . . Incandescent light bulb, 2 . . . translucent gastight container, 3 . . . filament, 4 . . . lead wire, 5 . . . lead wire, 6 . . . side electrode, 7 . . . center electrode, 8 . . . insulating part, 9 . . . base

The invention claimed is:

1. A light source device comprising a translucent gastight container, a filament disposed in the translucent gastight container, and a lead wire for supplying an electric current to the filament, wherein:

the filament comprises a substrate formed from a metal material and a visible light reflectance-reducing film coating the substrate for reducing visible light reflectance of the substrate, and the substrate shows a reflectance of 90% or higher for infrared lights of wavelengths of 4000 nm or longer.

2. The light source device according to claim 1, wherein surface of the substrate of the filament is polished into a mirror surface.

3. The light source device according to claim 2, wherein, as for surface roughness of the substrate, the surface of the substrate satisfies at least one of the following conditions: center line average height Ra of 1 μm or smaller, maximum height Rmax of 10 μm or smaller, and ten-point average roughness Rz of 10 μm or smaller.

4. The light source device according to claim 1, wherein the visible light reflectance-reducing film is transparent to visible lights.

5. The light source device according to claim 1, wherein the visible light reflectance-reducing film is a dielectric film having a melting point of 2000K or higher.

6. The light source device according to claim 1, wherein the visible light reflectance-reducing films is any one of a metal oxide film, metal nitride film, metal carbide film and metal boride film having a melting point of 2000K or higher.

7. The light source device according to claim 1, wherein the visible light reflectance-reducing film comprises a film formed from any one of MgO, $ZrO_2$, $Y_2O_3$, 6H-SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$, $ZrB_{12}$, C, $B_4C$, ZrC, TaC, HfC, NbC, ThC, TiC, WC, AlN, BN, ZrN, TiN, HfN, $LaB_6$, $ZrB_2$, $HfB_2$, $TaB_2$, $TiB_2$, CaO, $CeO_2$ and $ThO_2$, or a material comprising any one of these.

8. The light source device according to claim 1, wherein the substrate contains any one of Ta, Os, Ir, Mo, Re, W, Ru, Nb, Cr, Zr, V, Rh, C, $B_4C$, SiC, ZrC, TaC, HfC, NbC, ThC, TiC, WC, AlN, BN, ZrN, TiN, HfN, $LaB_6$, $ZrB_2$, $HfB_2$, $TaB_2$ and $TiB_2$.

9. A filament comprising a substrate formed from a metal material and a visible light reflectance-reducing film coating the substrate for reducing visible light reflectance of the substrate, wherein the substrate shows a reflectance of 90% or higher for infrared lights of wavelengths of 4000 nm or longer.

10. A light source device comprising a translucent gastight container, a filament disposed in the translucent gastight container, and a lead wire for supplying an electric current to the filament, wherein:

surface of the filament shows a reflectance of 80% or higher for lights of wavelengths not shorter than 1000 nm and not longer than 5000 nm, and a reflectance of 50% or lower for lights of wavelengths not shorter than 400 nm and not longer than 600 nm.

11. The light source device according to claim 10, wherein the surface of the filament shows a reflectance of 90% or higher for lights of wavelengths of 4000 nm or longer.

12. The light source device according to claim 10, wherein the surface of the filament shows a reflectance of 20% or lower for lights of wavelengths not shorter than 400 nm and not longer than 700 nm.

13. The light source device according to claim 10, wherein the filament comprises a substrate formed from a metal material, and the surface of the substrate is polished into a mirror surface.

14. The light source device according to claim 13, wherein, as for surface roughness of the substrate, the surface of the substrate satisfies at least one of the following conditions: center line average height Ra of 1 μm or smaller, maximum height Rmax of 10 μm or smaller, and ten-point average roughness Rz of 10 μm or smaller.

15. The light source device according to claim 10, wherein the filament comprises a substrate formed from a metal material and a visible light reflectance-reducing film coating the substrate for reducing visible light reflectance of the substrate.

16. A filament of which surface shows a reflectance of 80% or higher for lights of wavelengths not shorter than 1000 nm and not longer than 5000 nm, and a reflectance of 50% or lower for lights of wavelengths not shorter than 400 nm and not longer than 600 nm.

17. A light source device comprising a translucent gastight container, a filament disposed in the translucent gastight container, and a lead wire for supplying an electric current to the filament, wherein:

difference between a minimum value of reflectance for lights of wavelengths not shorter than 1000 nm and not longer than 5000 nm of surface of the filament and a maximum value of reflectance for lights of wavelengths not shorter than 400 nm and not longer than 600 nm of the same is 30% or larger.

18. The light source device according to claim 17, wherein the difference is 40% or larger.

19. The light source device according to claim 18, wherein the difference is 50% or larger.

20. The light source device according to claim 17, wherein the filament comprises a substrate formed from a metal material, and surface of the substrate is polished into a mirror surface.

21. The light source device according to claim 20, wherein, as for surface roughness of the substrate, the surface of the substrate satisfies at least one of the following conditions: center line average height Ra of 1 μm or smaller, maximum height Rmax of 10 μm or smaller, and ten-point average roughness Rz of 10 μm or smaller.

22. The light source device according to claim 17, wherein the filament comprises a substrate formed from a metal material and a visible light reflectance-reducing film coating the substrate for reducing visible light reflectance of the substrate.

23. A filament showing a difference of 30% or larger between a minimum value of reflectance for lights of wavelengths not shorter than 1000 nm and not longer than 5000 nm and a maximum value of reflectance for lights of wavelengths not shorter than 400 nm and not longer than 600 nm of surface thereof.

* * * * *